US007255969B2

(12) United States Patent
Kojima et al.

(10) Patent No.: US 7,255,969 B2
(45) Date of Patent: Aug. 14, 2007

(54) ELECTROPHOTOGRAPHIC PHOTOSENSITIVE MEMBER

(75) Inventors: Satoshi Kojima, Mishima (JP); Makoto Aoki, Yokohama (JP); Jun Ohira, Shizuoka-Ken (JP); Hironori Owaki, Susono (JP); Kazuto Hosoi, Mishima (JP); Motoya Yamada, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/396,798

(22) Filed: Apr. 4, 2006

(65) Prior Publication Data

US 2006/0194131 A1 Aug. 31, 2006

Related U.S. Application Data

(63) Continuation of application No. PCT/JP2005/023188, filed on Dec. 12, 2005.

(30) Foreign Application Priority Data

Dec. 10, 2004 (JP) ..... 2004-358096
Dec. 10, 2004 (JP) ..... 2004-358098

(51) Int. Cl.
*G03G 5/14* (2006.01)

(52) U.S. Cl. ..... 430/57.4; 430/66

(58) Field of Classification Search ..... 430/57.4, 430/66

See application file for complete search history.

(56) References Cited

U.S. PATENT DOCUMENTS

| | | | | |
|---|---|---|---|---|
| 6,635,397 | B2 * | 10/2003 | Okamura et al. | 430/57.4 |
| 2004/0209179 | A1 * | 10/2004 | Hosoi et al. | 430/57.4 |
| 2005/0026057 | A1 * | 2/2005 | Hosoi et al. | 430/57.4 |

FOREIGN PATENT DOCUMENTS

| | | |
|---|---|---|
| JP | 63-2062 | 1/1988 |
| JP | 1-289963 | 11/1989 |
| JP | 5-150532 | 6/1993 |
| JP | 8-171220 | 7/1996 |
| JP | 2000-258938 | 9/2000 |
| JP | 2002-23401 | 1/2002 |
| JP | 2002-311693 | 10/2002 |

* cited by examiner

*Primary Examiner*—Christopher Rodee
(74) *Attorney, Agent, or Firm*—Fitzpatrick, Cella, Harper & Scinto

(57) ABSTRACT

An electrophotographic photosensitive member is provided minimizing the absorption of image exposure having a short wavelength in a surface layer and keeping good electrophotographic properties including resolving power. The electrophotographic photosensitive member includes a conductive substrate, and a photoconductive layer and a surface region layer sequentially superimposed on the conductive substrate. The surface region layer is composed of a non-single-crystal silicon nitride film containing an Group element in the periodic table and a carbon atom and using at least a silicon atom and a nitrogen atom as base materials. In the surface region layer, the Group 13 element content with respect to the total amount of constituent atoms has distribution having at least two local maximum values in the thickness direction, and an the average concentration of nitrogen atoms is 30 atm % to 70 atm %.

14 Claims, 21 Drawing Sheets

ELECTROPHOTOGRAPHIC PHOTOSENSITIVE MEMBER

This application is a continuation of International Application No. PCT/JP2005/023188, filed Dec. 12, 2005, which claims the benefit of Japanese Patent Application No. 2004-358096, filed Dec. 10, 2004 and Japanese Patent Application No. 2004-358098, filed Dec. 10, 2004.

BACKGROUND OF THE INVENTION

1. Field of the Invention

The present invention relates to an electrophotographic photosensitive member. In particular, the present invention relates to an electrophotographic photosensitive member optimum for a printer, a facsimile, a copying machine, or the like using light having a relatively short wavelength of 380 nm or more and 500 nm or less for exposure.

2. Related Background Art

In the field of image formation, a photoconductive material in a photosensitive member is requested to have properties including the following properties:

1. High sensitivity and a high SN ratio (photo current (Ip)/dark current (Id))

2. An absorption spectrum suited for the spectral characteristics of an electromagnetic wave to be applied 3. High photoresponsiveness and a desired dark resistance value 4. Harmlessness to a human body at the time of use In particular, it is important for an electrophotographic photosensitive member to be incorporated into an electrophotographic device to be used as a business machine in an office to be pollution-free at the time of use.

Amorphous silicon (hereinafter, abbreviated as a-Si) is a photoconductive material exhibiting excellent properties satisfying the above-described properties, and has been attracting attention as a photoreceptive member of an electrophotographic photosensitive member.

A photosensitive member having a photoconductive layer composed of a-Si is generally formed on a conductive substrate heated to 50° C. to 350° C., by a film forming method such as a vacuum deposition method, a sputtering method, an ion plating method, a thermal CVD method, a photo CVD method, or a plasma CVD method. Of those methods, a plasma CVD method has been suitably put into practical use, involving: decomposing a raw material gas by means of a high-frequency wave or through microwave glow discharge; and forming an a-Si deposition film on a substrate.

For example, Japanese Patent Application Laid-open No. H05-150532 or the like discloses an a-Si photosensitive member composed of a substrate, a barrier layer, a photoconductive layer, and a surface protective layer. The photosensitive member is brought into the reverse bias state of a p-i-n junction by: using $SiH_4$, $H_2$, $N_2$, and $B_2H_6$ as raw material gases; and specifying the flow rate ratio of each raw material gas.

In addition, Japanese Patent Application Laid-open No. H08-171220 discloses an electrophotographic photosensitive member including: a conductive substrate; and a photoconductive layer composed of a-Si and a surface layer composed of amorphous silicon nitride on the substrate, in which the outermost surface of the electrophotographic photosensitive member has an element composition ratio N/Si in the range of 0.8 to 1.33 and an element composition ratio O/Si in the range of 0 to 0.9.

In addition, in order to satisfy the recent demand for an increase in image quality, the high definition of an electrostatic latent image as well as a reduction in particle size of toner has been increasingly requested. One possible method of satisfying the demand in, for example, a digital copying system is a method involving reducing the spot diameter of laser to be used for image exposure. To this end, a reduction in wavelength of laser has been requested. Japanese Patent Application Laid-open No. 2000-258938 proposes an image forming apparatus in which a photosensitive layer is formed of an a-Si hydride and which uses an ultraviolet violaceous laser beam oscillator having, as an exposure wavelength, a predominant oscillation wavelength at 380 nm to 450 nm.

Furthermore, Japanese Patent Application Laid-open No. 2002-311693 proposes an electrophotographic device using an a-Si-based photosensitive member in which: an electric field to be applied to the photosensitive member upon exposure with an image forming light beam is 150 kV/cm or more; and the image forming light beam has a wavelength of 500 nm or less.

Examples of a method of charging an a-Si photosensitive member include: a corona charging system in which corona discharge is employed; a roller charging system in which charging is carried out through direct discharge by the use of a conductive roller; and an injection charging system in which a contact area is sufficiently extended by means of magnetic particles or the like and charging is carried out through the direct injection of charges into the surface of a photosensitive member.

Of those, in each of the corona charging system and the roller charging system, a corona product is apt to adhere to the surface of a photosensitive member because each of the systems employs discharge. In addition, an a-Si photosensitive member has a surface layer having a hardness much higher than that of an organic photosensitive member or the like, so the surface layer is difficult to abrade and a corona product is apt to remain on the surface. In that case, the corona product and water bind to each other owing to moisture adsorption of water in a high-humidity environment or the like to reduce the electrical resistance of the surface, hence the charges of the surface is apt to move. As a result, an image deletion phenomenon may occur. To cope with the foregoing, various devices such as a method of rubbing the surface and a method of managing the temperature of the photosensitive member are required in some cases.

In contrast, the injection charging system is a charging system which does not actively employ discharge and involves directly injecting charges from a portion in contact with the surface of a photosensitive member. Therefore, it is difficult for a phenomenon such as the above-described image deletion to occur.

In addition, the injection charging system as contact charging is of a voltage control type while the corona charging system is of a current control type. Therefore, the injection charging system is advantageous in the respect that the unevenness of a charging potential is relatively easy to reduce.

The properties of a conventional a-Si-based electrophotographic photosensitive member such as electrical, optical, and photoconductive properties (such as a dark resistance value, photosensitivity, and photoresponsiveness), service environment properties, stability over time, and durability have been improved. However, at present, there is room for the conventional a-Si-based electrophotographic photosensitive member to be improved for enhancing comprehensive properties.

In particular, in recent years, digitalization and colorization have been rapidly promoted. As a result, there has been a growing demand for an increase in image quality of an electrophotographic device (such as high resolution, high definition, the absence of density unevenness, or the absence of image defects (for example, a void or a black spot)).

In a digital full-color copying machine, negative toner as color toner is used in combination with an image exposure method (a method involving exposing an image portion) having high controllability of a latent image and suited for an increase in image quality and a photosensitive member to be negatively charged. In an a-Si-based photosensitive member for negative charging, the improvement of the properties depends on how well the function of inhibiting the inflow of charges from the surface as much as possible works.

In addition, demands for an increase in speed and an increase in durability have been growing rapidly. Therefore, an electrophotographic photosensitive member is requested to improve in electrical properties, photoconductive properties, and uniformity, to reduce image defects, and to significantly improve in performance such as durability or environmental resistance (adaptability to a change in temperature or humidity).

Not only toner having a small particle size but also a reduction in the spot diameter of laser light for image formation is effective in increasing the resolution of an image. Examples of a method of reducing the spot diameter of laser light include an increase in the accuracy of an optical system for irradiating a photoconductive layer with laser light and an increase in the opening ratio of an imaging lens. However, the spot diameter can be reduced only up to a diffraction limit determined by the wavelength of laser light and the opening ratio of the imaging lens. Therefore, for reducing a spot diameter with the wavelength of laser light kept constant, an increase in the size of a lens, an improvement in machine accuracy, or the like must be performed, so increases in the size and cost of an apparatus are hardly avoided.

In view of the foregoing, in recent years, a technique for increasing the resolution of an electrostatic latent image in which the wavelength of laser light is shortened to reduce the spot diameter has been attracting attention, based on the fact that the lower limit of the spot diameter of laser light is in direct proportion to the wavelength of the laser light.

In a conventional electrophotographic device, laser light having an oscillation wavelength of 600 to 800 nm is generally used in image exposure. By shortening the wavelength, the resolution of an image can be increased. In recent years, a semiconductor laser having a short oscillation wavelength has been rapidly developed, and a semiconductor laser having an oscillation wavelength at around 400 nm has been put into practical use.

An a-Si photosensitive member in which resolution is as high as 2,400 dpi and a semiconductor laser having an oscillation wavelength of about 400 nm is used for image exposure has been desired.

In addition, toner having a small particle size to be used for a high-resolution digital full-color copying machine tends to present problems such as a transfer residue on the surface of a photosensitive member and a cleaning residue. Improvements to cope with the problems have also been requested.

In order for the resolution of an image to be increased by means of any one of the approaches exemplified above, a material for, in particular, the surface region of a photosensitive member has been requested to be further improved so that light having a wavelength in a short wavelength range around 400 nm can be applied to the photosensitive member.

For example, an a-Si-based photosensitive layer has a peak sensitivity at around 600 to 700 nm. The photosensitive layer can have a sensitivity even at around 400 to 410 nm under devised conditions, although the sensitivity is inferior to the peak sensitivity. Therefore, for example, the photosensitive layer can be used even when laser having a wavelength as short as 405 nm is used. However, the sensitivity at around 400 to 410 nm may be about half the peak sensitivity, so it is preferable that almost no absorption of light is present in the surface region of a photosensitive member.

However, with an amorphous silicon carbide (hereinafter, a-SiC) based material or an amorphous carbon (hereinafter, a-C) based material that has been suitably used for a surface layer heretofore, the absorption tends to be large at around 400 to 410 nm. In the case of the a-SiC-based material, the tendency can coped with through an increase in transmittance under devised conditions or a reduction in thickness of the surface layer to some degree. However, the surface layer is gradually abraded inevitably owing to rubbing in a copying machine, so the layer must secure at least a certain thickness. Accordingly, an increase in absorbed amount due to an increase in thickness and sensitivity unevenness due to abrasion unevenness may present a problem in some cases when high-resolution images are to be stably outputted.

In contrast, a film having good transmittance can be formed of the a-C-based material under some conditions. In this case, however, the film has a structure close to that of a polymer, and its hardness may be low or its resistance value may be too high. Therefore, the a-C-based material may establish a trade-off relationship between transmittance and hardness or resistance.

It has been found that an amorphous silicon nitride (hereinafter, a-SiN) based material can be used instead of those materials. However, a film made of such material can be hardly used for the surface layer of a photosensitive member, and it has not been put into practical use yet. For example, Japanese Patent Application Laid-open No. H08-171220 shows that various advantages and disadvantages appear depending on a raw material gas of a-SiN. The document shows that a specific condition must be selected for obtaining suitable conditions for a surface layer.

Japanese Patent Application Laid-open No. H08-171220 discloses optimum values for the N/Si element composition ratio and O/Si element composition ratio of the outermost surface of a photosensitive member and conditions for generating the values. However, in Japanese Patent Application Laid-open No. H08-171220, only a wavelength to be used for exposure up to 550 nm is taken into consideration. Furthermore, Japanese Patent Application Laid-open No. H08-171220 describes that a thickness of a surface layer in excess of 0.8 μm results in a reduction in sensitivity. That is, a thickness of the surface layer in excess of 0.8 μm results in a reduction in sensitivity even at an exposure wavelength of 550 nm. Therefore, light is expected to be absorbed to some extent at a wavelength of, for example, around 400 nm, ans a sufficient sensitivity may not be obtained.

That is, a first important point is that almost no exposure light at a wavelength as short as about 400 nm is absorbed in the surface region of a photosensitive member. A second important point is that the photosensitive member has a sufficient function of blocking the injection of charges from its surface. A third important point is that the photosensitive member is high in resolution so that it can take advantage of a small spot diameter and toner having a small particle size.

SUMMARY OF THE INVENTION

The inventors of the present invention have made extensive studies to solve the above problems and realize a copying process which can be suitably used for a high-image quality, highly durable, and high-speed copying process, and has practically sufficient sensitivity to exposure light at a short wavelength, no optical memory, high chargeability and high contrast. As a result, they have found that the above object can be favorably achieved by adopting a silicon nitride-based material as a surface layer and optimizing conditions for producing the surface layer, thereby achieving the present invention.

That is, according to one aspect of the present invention, an electrophotographic photosensitive member is provided including: a conductive substrate; a photoconductive layer; and a surface region layer which is superimposed on the photoconductive layer, and formed of a non-single-crystal silicon nitride film using silicon atoms and nitrogen atoms as base materials and containing at least a Group 13 element in the periodic table and carbon atoms, in which the content of the Group 13 element in the periodic table with respect to the total amount of constituent atoms has distribution having at least two local maximum values in the thickness direction of the film in the surface region layer.

According to the present invention, an electrophotographic photosensitive member can be provided having extremely good electrophotographic properties capable of minimizing the absorption of light having a short wavelength in a surface region layer and of stably outputting high-resolution and high-quality full-color images.

DESCRIPTION OF THE PREFERRED EMBODIMENTS

Figure 1A:
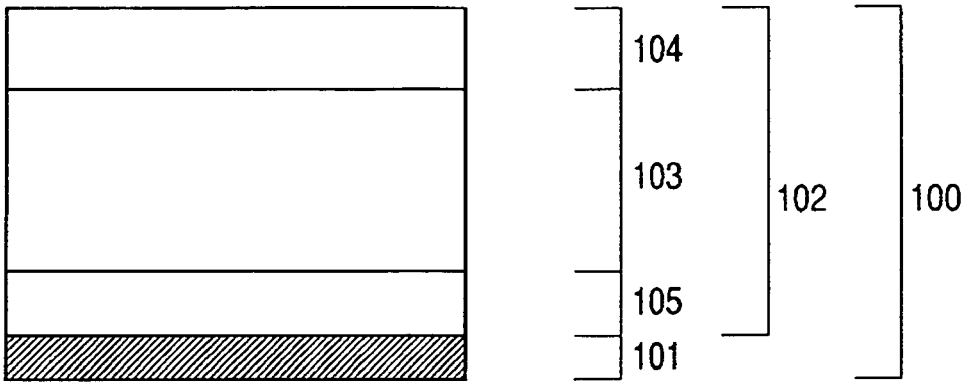
FIGS. 1A, 1B, 1C, and 1D are schematic sectional views each showing an example of an electrophotographic photosensitive member of the present invention.

The inventors of the present invention have made extensive studies with a view to achieving the above object. As a result, they have found that when providing a surface layer produced under specific conditions, good electrophotographic properties including an excellent resolution and high definition can be held with almost no absorption of exposure light having a short wavelength, thereby achieving the present invention.

At first, the inventors of the present invention have produced a thin film made of an a-SiN:H-based material suitable for a surface layer by means of such conventional method as described in Japanese Patent Application Laid-open No. H08-171220 or the like. They have found that a film produced by means of such method has a relatively large absorption coefficient with respect to light having a short wavelength (for example, 400 to 410 nm), and that a photosensitive member having such a surface layer may have an insufficient sensitivity with respect to light having a wavelength near 400 to 410 nm. As a result of additional studies, the inventors have found that absorption at a short wavelength (for example, 405 nm) can be suppressed only under limited production conditions. Specifically, they have found that kinds and flow rates of raw material gases, the ratio between the gases, a ratio of applied electric power to the amount of a gas and the like must be appropriately set, and that a film reduced in absorption cannot be obtained until each of them falls within a specific range. The term "film reduced in absorption" as used herein quantitatively refers to a film having an absorption coefficient at, for example, 405 nm of preferably 5,000 $cm^{-1}$ or less, or more preferably 3,000 $cm^{-1}$ or less.

The absorption coefficient $\alpha$ ($cm^{-1}$) can be represented as shown in the following expression (1) where the light quantity of incident light is denoted by T0, the light quantity of transmitted light is denoted by T, and a film thickness is denoted by t (cm).

$$\alpha=-(ln(T/T0))/t \quad (1)$$

A silicon oxide film is formed because a silicon atom exposed on the outermost surface of a film formed of a compound containing silicon (the film is produced under such conditions) is easily oxidized in the air. Furthermore, there is a possibility that the film adsorbs an element in the atmosphere. Therefore, the outermost surface layer of the film having a thickness of about 10 nm (more preferably about 20 nm) is preferably removed in order to eliminate an influence on the outermost surface of the film before a nitrogen atom concentration in the film is measured.

The influences of an atom adsorbed to the outermost surface and a natural oxide film on the outermost surface can be substantially eliminated by removing the outermost surface layer of the film through sputtering with an Ar atom or the like in vacuum by means of ESCA, SIMS, RBS, or the like.

After an influence on the outermost surface of the film had been eliminated by means of the above method, a nitrogen atom concentration was measured by means of X-ray photoelectron spectroscopy (XPS), Rutherford backscattering spectrometry (RBS), secondary-ion mass spectrometry (SIMS), or the like.

As a result, it has been found that absorption can be permitted when an absorption coefficient is 5,000 $cm^{-1}$ or less at a practical film thickness (about 0.2 μm to 2.0 μm) in the case of a wavelength of 405 nm, and that the value of the nitrogen atom concentration (N/(Si+N)) in this case is preferably 30 atm % or more, or more preferably 35 atm % or more.

Figure 5:
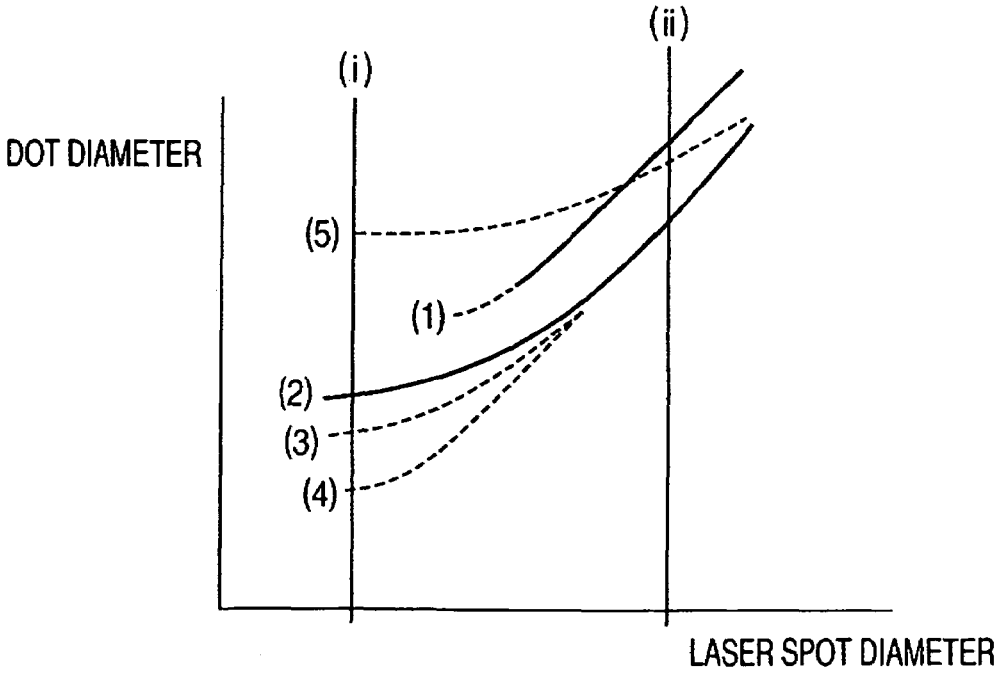
FIG. 5 is a schematic view showing the relationship between the spot diameter of laser for exposure and the diameter of a dot on an outputted image in the present invention.

It has been also found that the upper limit of the concentration is preferably 70 atm % or less, or more preferably 60 atm % or less in view of a relationship with a yield of the film. When the concentration is 70 atm % or less, unevenness such as thickness unevenness, hardness unevenness, or resistance unevenness hardly occurs, the strength of the film can be maintained, and the film can be stably produced in a high yield. Accordingly, the film provides preferable properties when it is used as a surface layer. However, when the concentration exceeds 70 atm %, unevenness such as thickness unevenness, hardness unevenness, or resistance unevenness is apt to occur, hence the yield may remarkably reduce. This is probably because an excessive amount of nitrogen extremely destabilizes the bond between nitrogen atoms in the film Next, an effect of reducing a spot diameter will be described with reference to FIG. 5. In FIG. 5, the abscissa represents laser spot diameters and the ordinate represents dot diameters on latent images or images, assuming that various electrophotographic processes are compared with each other. Specifically, the case where laser light having a wavelength of 655 nm (corresponding to (1) of FIG. 5) and the cases where laser light having a wavelength of 405 nm (corresponding to (2) to (5) of FIG. 5) are taken into consideration.

In (1) of FIG. 5, one can manage to reduce the laser spot diameter by means of, for example, the numerical aperture of an optical system, but the degree of reduction is limited. In contrast, in each of (2) to (5) of FIG. 5, the spot diameter can be reduced beyond the limit because exposure at a short wavelength is employed.

On the other hand, a difference in exposure wavelength affects light absorption at a photoconductive layer as well. That is, light absorption at the photoconductive layer occurs only in an extremely thin region at a short exposure wavelength. Photoproduction carriers are accelerated by an electric field formed by surface charges, and moves in the thickness direction of the film. Then, the carriers opposite in polarity to the surface charges move to the surface to cancel the charges. Thus, an electrostatic latent image is formed. However, the carriers may move to the surface direction (a direction perpendicular to the thickness direction) of the film as well owing to the electrostatic repulsive force between the carriers in carrier movement, thereby leading to the blur of the latent image. Therefore, the distance along which the photoproduction carriers move to cancel the surface charges is preferably shortened for forming an electrostatic latent image pattern more true to an exposure pattern. That is, the region in which the photoproduction carriers are produced is preferably close to the surface.

In the case of conventional exposure at 600 to 800 nm, light reaches an upper portion of the photoconductive layer which is several micrometers to less than 20 micrometers in depth from its surface to produce carriers owing to the optical properties of an a-Si photosensitive member. On the other hand, in the case of exposure at, for example, 405 nm, light absorption is completed in an extremely thin range in the uppermost portion of the photoconductive layer, and photoproduction carriers have almost no room for spreading in the course of reaching the upper portion. As a result, higher resolution may be expected. In view of the foregoing, resolving power is expected to be elevated even at an identical spot diameter (corresponding to (i) of FIG. 5).

When an SiN-based surface region layer is used, a residual potential resulting from the surface region layer is sometimes larger than that of an electrophotographic photosensitive member using a conventional SiC-based surface region layer even when an absorption coefficient at 405 nm is 5,000 $cm^{-1}$ or less.

It has been found that, in such case, resolution such as dot reproducibility or fine-line reproducibility is not improved even when the wavelength of exposure laser is changed from 660 nm to 405 nm.

In view of the foregoing, the inventors of the present invention have variously reviewed conditions under which a surface region layer is formed while paying attention to properties such as chargeability, residual potential, sensitivity, and resolution with a view to optimizing the surface region layer.

As a result, they have found that when adding a slight amount of carbon atoms, a residual potential resulting from the surface region layer can be reduced, hence an effect of exposure at a short wavelength can be obtained to result in an improvement in resolution.

A Group 13 element in the periodic table (hereinafter also referred to simply as a "Group 13 element") must be incorporated into the surface region layer for maintaining sufficient chargeability. The present inventors have found that it is effective to incorporate the element in such a manner that the content of the element has at least two local maximum values.

The reason for this has not been revealed yet, but is considered to be that bonds in an a-SiN-based film with a large stress are relaxed by adding a slight amount of carbon atoms, and the number of defects are reduced. An a-SiN-based film produced to have a high nitrogen concentration as described above is suitably used as a surface layer that does not absorb light having a short wavelength because the film has a small absorption coefficient. However, a stress in the film may increase, and bonds in the film become unstable and property unevenness occurs in some cases. The surface layer of the electrophotographic photosensitive member of the present invention is in an amorphous state, and the Si—Si atomic interval is known to be about 0.24 nm and the interval between SiC atoms is known to be about 0.19 nm, although these values are slightly different from those in a crystalline state.

In contrast, the N—N atomic interval is about 0.11 nm. Accordingly, the number of N—N bonds each having a small atomic interval increases as the nitrogen atom concentration increrases. Therefore, it is considered that strain may be developed in the film to result in property unevenness.

In contrast, the C—C atomic interval is about 0.15 nm. Accordingly, when incorporating a slight amount of carbon atoms into a silicon nitride film in an amorphous state using an Si atom and a nitrogen atom as base materials, strain in the film may be relaxed.

When the amount of carbon atoms is small, no reduction in residual potential is observed because strain in the silicon nitride film in an amorphous state is not alleviated. In addition, sensitivity unevenness such as electric potential unevenness tends to increase due to an increase in the number of Si—C bonds, and at the same time, the transmittance of light having somewhat shorter wavelength is reduced.

Electrons must be prevented from flowing into a layer from the surface for obtaining sufficient chargeability. To sufficiently exert the function, carbon atoms must be incorporated into the film at a content of $5\times10^{18}$ atoms/$cm^3$ or more. However, when the carbon atoms are uniformly incorporated into the entirety of the surface region layer, the resistance of the surface region layer to holes reduces to result in deterioration in dot reproducibility or fine-line reproducibility in some cases.

A Group 13 element in the periodic table must be incorporated into the surface region layer for providing the electrophotographic photosensitive member with good electrical properties such as chargeability and sensitivity. It has been found that, in that case, it is important not to uniformly incorporate the element into the entirety of the surface region layer but to incorporate the element to provide distribution having at least two local maximum values in the thickness direction of the film.

Not only in the case where the element is uniformly incorporated but also in the case where the content of the element has at least two local maximum values in the thickness direction of the film, deterioration in dot reproducibility or fine-line reproducibility may be observed when a local maximum value is placed at a position relatively close to the outermost surface, which is in about 100 nm or less distance from the outermost surface side, or when the local maximum values are close to each other and the interval between them is less than 100 nm.

The reason for this is considered to be that holes of the photocarriers generated by exposure move toward the outermost surface side to be bound to electrons of charges. In this case, spreading toward the in-plane direction increases as a portion containing a large amount of the Group 13 element in the periodic table to have reduced resistance to holes lengthens in the direction in which carriers move. The same holds true for the case where the element is incorporated so that a local maximum value is present at a position relatively close to the outermost surface, and spreading toward the in-plane direction is expected to increase because the distance between a portion that generates photocarriers and a portion of a local maximum value that blocks electrons from the surface lengthens.

Furthermore, the inventors of the present invention have variously reviewed conditions under which a surface layer is produced while paying attention to image quality. As a result, they have found that when adding a slight amount of oxygen atoms, image quality can be further improved while an absorption coefficient is kept small.

This is probably because image quality is improved owing to a reduction in a transfer residue or cleaning reidue of toner having a small particle size to be used for high-resolution full-color printing. In addition, no deterioration in resolution such as dot reproducibility or fine-line reproducibility is observed, and a slight increase in resolution can be observed under some production conditions.

The reason for this has not been revealed yet, but is considered to be that when adding a slight amount of oxygen atoms, bonds in an a-SiN-based film with a large stress can be relaxed more easily than that in the case where only carbon atoms are added, whereby defects are reduced. As described above, an a-SiN-based film having a high nitrogen concentration has a small absorption coefficient and an extremely high hardness, and hence it can be suitably used as a surface layer. However, when the hardness is large, a stress in the film may be also large, and an extremely large residual stress may remain in the film. In such a case, it is considered that bonds are broken to relax a strain due to the stress, and defects may be produced after film deposition. Unlike carbon, oxygen has two bonding valencies. Therefore, the present inventors consider that oxygen is expected to effectively enter the space between atoms to relax the strain of the bond, thereby effectively preventing defects to be produced.

On the other hand, a hydrogen terminal has a effect of repairing defects during film formation. However, it has no effect in the case where forced bonds or weak bonds are changed into defects after film deposition. Therefore, it is considered that the slight amount of oxygen causes the relaxation of bonds, and hence the number of defects produced after film formation is effectively reduced in tandem with the repair of defects by hydrogen. As a result, a general reduction in the number of defects can be realized. When a reduction in the number of defects is realized as described above, the number of shallow traps present in a film is reduced. As a result, for example, carriers trapped after charging are prevented from being excited again to come out before development. Such carriers coming out of shallow traps are originally expected to drift so as to compensate for a potential difference resulting from the formation of a latent image. Therefore, such carriers are expected to make the latent image null or reduce the depth of the latent image. Accordingly, it is considered that if the number of traps decreases, factors for making a latent image null are reduced, resulting in increased resolution. In view of the foregoing, the present inventors consider that the introduction of an appropriate amount of oxygen can increase resolution.

In addition, it is relatively easy for an a-SiN film to exhibit a columnar structure depending on production conditions. In a state that the number of columnar structures is large, the number of structural boundaries appearing on a surface is expected to be large. Therefore, a transfer residue or a cleaning residue is apt to generate in such a state.

It has been found that providing distribution having a local maximum value is more effective in reducing the number of columnar structures than uniformly incorporating carbon atoms.

The addition of slight amounts of carbon and oxygen reduces a transfer residue and a cleaning residue probably because the number of defects decreases as described above to reduce the number of columnar structures, so that the number of structural boundaries appearing on a surface reduces.

In addition, when the amount of oxygen is small, the same action as a valence electron controlling impurity is expected to occur. Such action is expected to correct the inconsistency of a band structure. Such inconsistency of a band structure may cause the accumulation or drift of carriers. As a result, resolving power may be lowered. Therefore, it is desirable to improve the consistency of a band structure.

As described above, it has been found that when appropriately adding oxygen atoms, the effect of the addition can be effectively obtained. On the other hand, the following has been found. When increasing the amount of oxygen atoms, they may serve not as an additive but as a structural member. As a result, an SiO structure or an SiNO structure is established, so that the hardness of a film reduces, the resistance value thereof becomes large to increase a residual potential, or the number of hydrophilic SiO bonds increases. Therefore, a phenomenon in which an image blurs at a high temperature and a high humidity may occur.

Furthermore, the inventors have made studies on the addition of oxygen, and found that when incorporating oxygen to provide a local maximum value in a film, none of the above-described detrimental effects such as a reduction in hardness and an increase in residual potential is not caused, a transfer residue and a cleaning residue are effectively reduced, and resolution can be improved. It has been also found that fluorine has the same effect when added to provide a local maximum value in a film. In addition, it has been found that adding oxygen and fluorine so that each of them has a local maximum value is more preferable.

By adding at least one of oxygen and fluorine at a relatively high concentration into a partial region as described above, rather than uniformly adding at least one of them, a local region for effectively relaxing a stress in a film made of a-SiN or the like with a large stress is formed, whereby the stress relaxation of the entire film is expected to efficiently progress.

As described above, oxygen has two bonding valences. Therefore, oxygen is expected to alleviate the strain of bonds in an a-SiN-based film. On the other hand, fluorine terminates a defect to provide a effect of remedying the defect during film formation. In addition, fluorine has a larger atomic radius than a hydrogen atom, and it can alleviate stress concentration and is expected to prevent forced bonds or weak bonds from being changed into defects after film deposition.

As described above, when incorporating oxygen at a high concentration, there are tendencies to reduce the hardness of a film, to excessively increase the resistance value of the film so that a residual potential increases, or to make the film hydrophilic so that a photosensitive member is used with difficulty at a high humidity.

However, when incorporating oxygen to provide distribution having a local maximum value, none of the above-described detrimental effects are caused even when the oxygen concentration is partially relatively large. This is probably because no layer region expressing properties as a structural member is formed even though the oxygen concentration is locally high.

In addition, fluorine is a terminal element, and effectively leads to termination to increase the degree of freedom of a network. However, if excessively increasing the amount of a terminal element, it may not be preferable because the hardness of a film is reduced or the absorption coefficient thereof increases. However, it has been also found that such problems concerning hardness and absorption as described above can be avoided by incorporating fluorine to provide distribution having a local maximum value of a high concentration. This is probably because a region with a relatively high concentration is formed as in the case of oxygen, and stress relaxation can be intensively performed in the region. In addition, fluorine has a slightly larger atomic radius than hydrogen, and comes to be a terminal atom to establish a situation in which a network structure is different from a region terminated with hydrogen (a bond distance increases). Such difference in film structure is expected to additionally help the stress relaxation. In this case, for example, a chlorine atom has so large an atomic radius that the strain of a bond may increase. In view of the foregoing, when incorporating fluorine atoms so that the concentration distribution of the atoms has a peak, resolving power is expected to improve.

In particular, it has been found that when oxygen and fluorine atoms are incorporated in such a manner that an oxygen atom content and a fluorine atom content each have a local maximum value, an effect of significantly reducing optical memory can be obtained in addition to the effects obtained by incorporating only oxygen atoms or fluorine atoms. The reason for this has not been revealed yet. The present inventors consider the reason to be as follows. In addition to the alleviation of bonds due to oxygen, fluorine effectively serves as a terminal atom to realize both the suppression of the production of defects during film deposition and the prevention of defects produced after the film deposition at high levels. As a result, resolving power increases. At the same time, a reduction in optical memory can be realized owing to an additional reduction in localized level density.

Here, where Omax and Fmax are defined as a maximum oxygen atom content and a maximum fluorine atom content at respective local maximum values, respectively, and Omin and Fmin are defined as a minimum oxygen atom content and a minimum fluorine atom content in the surface region layer, respectively, a ratio of the maximum content Omax to the minimum content Omin and a ratio of the maximum content Fmax to the minimum content Fmin are each controlled to preferably satisfy the relationship of $2 \leqq Omax/Omin$ and the relationship of $2 \leqq Fmax/Fmin$, or more preferably satisfy the relationship of $5 \leqq Omax/Omin$ and the relationship of $5 \leqq Fmax/Fmin$. This is because the improvement of resolving power becomes significant when the ratios are in the above ranges.

In addition, the width of the peak of each of an oxygen atom content and a fluorine atom content corresponding to the half width of a local maximum value of the content is preferably controlled to be 10 nm or more and 200 nm or less. Setting the half width of the local maximum value equal to or larger than 10 nm effectively exerts an influence on film properties due to the formation of a local maximum value, that is, a reduction in the number of defects due to stress relaxation. In addition, setting the half width of the peak equal to or less than 200 nm is expected to enable resolving power or the like to be additionally improved without damaging film quality in a region near the local maximum value.

The inventors of the present invention have made studies on the conditions under which the surface region layer of the present invention is superimposed. As a result, they have found that, for the improvement of image quality and for stability, the surface region layer is preferably superimposed to achieve the optical continuity between the photosensitive layer and the surface region layer so that the minimum value (Min) and maximum value (Max) of a reflectivity (%) in the wavelength range of 350 nm to 680 nm satisfy the relationship of $0\% \leqq Max\ (\%) \leqq 20\%$ and the relationship of $0 \leqq (Max-Min)/(100-Max) \leqq 0.15$.

Next, the embodiment of the present invention will be described in detail with reference to the drawings.

FIGS. 1A to 1D are schematic views each showing the layer constitution of an electrophotographic photosensitive member in the present invention.

An electrophotographic photosensitive member 100 shown in FIG. 1A has a lower injection-blocking layer 105, a photoconductive layer 103, and a surface region layer 104 formed on a conductive substrate 101 in the stated order.

The lower injection-blocking layer 105, the photoconductive layer 103, and the surface region layer 104 formed on the conductive substrate 101 are referred to as a photosensitive layer 102.

Figure 1B:
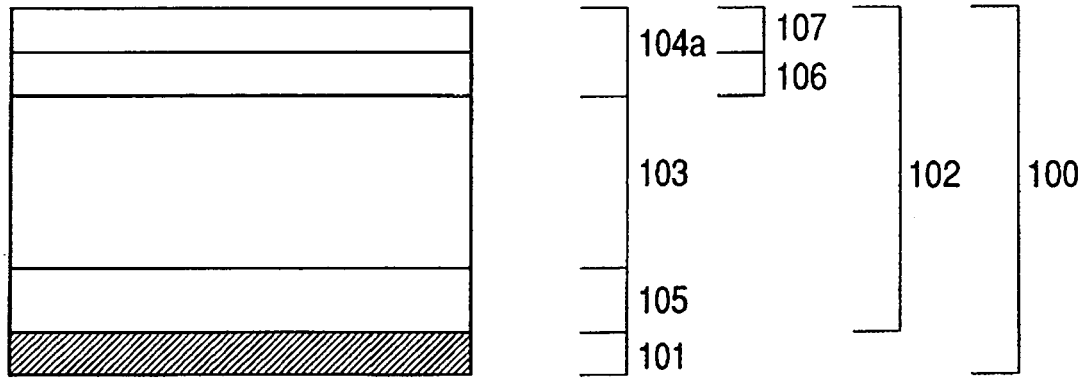
Figure 1C:
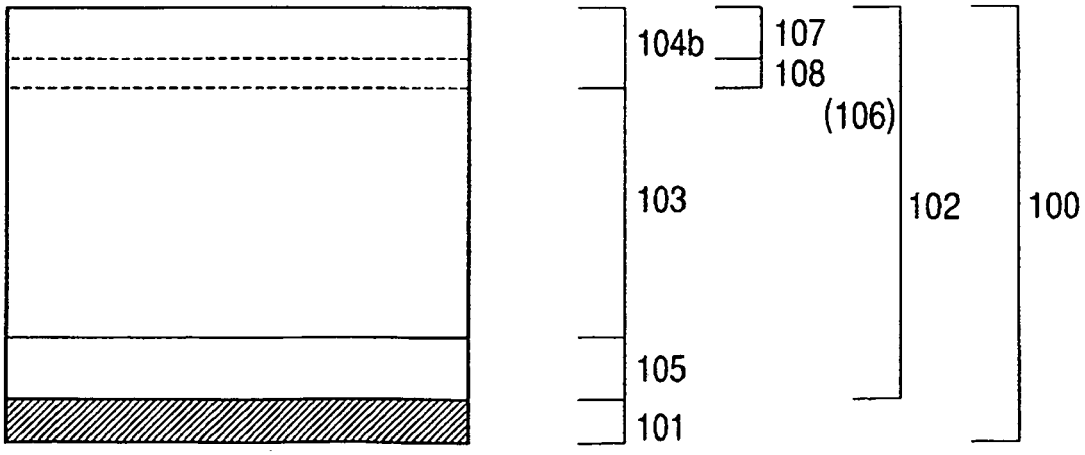
Figure 1D:
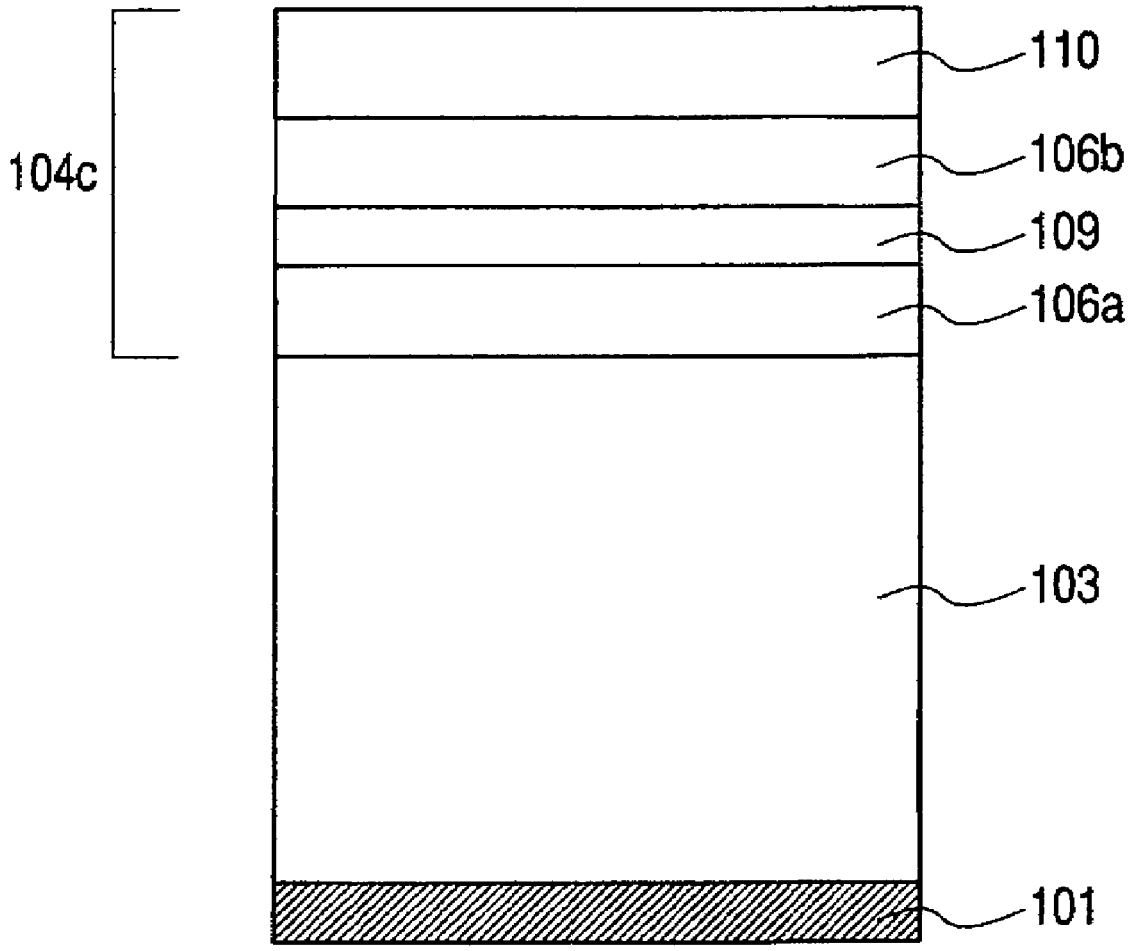

In each of FIGS. 1B to 1D as well, the whole layers formed on the conductive substrate 101 are referred to as the photosensitive layer 102.

The lower injection-blocking layer 105 is positioned in each of FIGS. 1A to 1C because it is preferably provided for blocking the injection of charges from the side of the conductive substrate, although the layer is not necessarily needed. The electrophotographic photosensitive member shown in FIG. 1D may be provided with that layer.

As in the case of FIG. 1A, the photosensitive layer 102 of the electrophotographic photosensitive member 100 shown in FIG. 1B includes the lower injection-blocking layer 105, the photoconductive layer 103, and a surface region layer 104*a* formed on the conductive substrate 101 in the stated order. The surface region layer 104*a* of FIG. 1B includes a top injection-blocking layer 106 and a surface layer 107 formed in the stated order from the side of the photoconductive layer 103. The top injection-blocking layer 106 is a layer positioned for reducing the injection of charges from an upper portion and for improving chargeability. The constitution shown in FIG. 1B is particularly suitable for an electrophotographic photosensitive member for negative charging.

As in the case of FIG. 1A, the photosensitive layer 102 of the electrophotographic photosensitive member 100 shown in FIG. 1C includes the lower injection-blocking layer 105, the photoconductive layer 103, and a surface region layer

104*b* formed on the conductive substrate 101 in the stated order. The surface region layer 104*b* of FIG. 1C includes a change layer 108 and the surface layer 107 formed in the stated order from the side of the photoconductive layer 103. The change layer 108 is a layer formed in such a manner that a change in refractive index becomes continuous between the surface region layer 104 and the photoconductive layer 103. The change layer 108 is preferably a layer having a function of the top injection-blocking layer 106.

As shown in FIG. 1C, the refractive index of the surface layer 107 and that of the photoconductive layer 103 are gently connected to each other through the change layer 108, whereby the reflection of light at a layer interface is suppressed and interference at the surface can be prevented in the case where coherent light is used for exposure.

When the change layer 108 is provided with a function of the top injection-blocking layer, the compositional change between the photoconductive layer 103 and the surface layer 107 can be gently performed. As a result, a layer interface resulting from the difference in refractive index between the layers 103 and 107 can be removed. In addition, the injection of charges from an upper portion can be reduced and chargeability can be improved.

The electrophotographic photosensitive member shown in FIG. 1D includes the photoconductive layer 103 and a surface region layer 104*c* composed of a first top injection-blocking layer (TBL-1) 106*a*, an intermediate layer 109, a second top injection-blocking layer (TBL-2) 106*b*, and a surface protective layer (SL) 110 formed on the conductive substrate 101 in the stated order.

In the case where the top injection-blocking layer 106 is positioned between the surface layer 107 and the photoconductive layer 103 as shown in FIG. 1B, if the difference in refractive index between the top injection-blocking layer 106 and the photoconductive layer 103 is large, a change region the refractive index of which gently changes may be positioned between the top injection-blocking layer 106 and the photoconductive layer 103.

Next, each of the above-described layers in the present invention will be described in detail.

<Surface Region Layer>

Each of the surface region layers 104 to 104*c* is arranged for providing good properties mainly concerning the property of transmitting light having a short wavelength, high resolution, resistance to continuous repeated use, moisture resistance, resistance to service environments, good electrical properties, and the like.

In the case of an electrophotographic photosensitive member for negative charging, a surface region layer is provided with a top injection-blocking function to serve as a charge holding layer. It is also effective to arrange a top injection-blocking layer as described later to provide a function of holding charges.

A material for the surface region layer in the present invention is composed of a non-single-crystal material using silicon atoms and nitrogen atoms as base materials and containing a Group 13 element in the periodic table and carbon atoms. The layer preferably contains hydrogen atoms, oxygen atoms, and/or fluorine atoms in an appropriate manner.

The surface region layer has the surface layer 107 and the change layer 108. It is also effective to arrange the top injection-blocking layer 106 instead of the change layer or between the surface layer and the change layer.

When a surface region layer composed of such a-SiN-based material is formed by means of, for example, a glow discharge method, the following procedure can be basically adopted. A raw material gas for supplying Si capable of supplying silicon atoms (Si), a raw material gas for supplying N capable of supplying nitrogen atoms (N), a raw material gas for supplying C capable of supplying a carbon atom (C), and a raw material gas capable of supplying atoms of a Group 13 element in the periodic table are introduced at a desired ratio into a reaction vessel whose inside can be evacuated, and glow discharge is allowed to take place in the reaction vessel, then a layer composed of an a-SiN-based material is formed on a substrate with a photoconductive layer or the like formed thereon, which has been placed at a predetermined position in advance.

In this case, as described above, the amount of nitrogen in the surface region layer is preferably in the range of 30 atm % to 70 atm % with respect to the sum of silicon and nitrogen atoms. The carbon atom content is preferably in the range of $2.0\times10^{17}$ atm/cm$^3$ to $5.0\times10^{20}$ atm/cm$^3$.

The surface region layer of the present invention must be adapted in such a manner that the content of a Group 13 element in the periodic table becomes distribution having at least two local maximum values in the thickness direction of the film. In that case, the distance between two adjacent local maximum values of the Group 13 element content in the periodic table is preferably in the range of 100 nm to 1,000 nm in the thickness direction of the film for improving electrical properties such as chargeability and a resolution such as dot reproducibility.

It is also preferable to distribute the Group 13 element in such a manner that: a local maximum value of the Group 13 element content placed on a side closest to the photoconductive layer is $5.0\times10^{18}$ atoms/cm$^3$ or more; and the minimum value present between two adjacent local maximum values is $2.5\times10^{18}$ atoms/cm$^3$ or less for improving electrical properties such as chargeability and a resolution such as dot reproducibility.

Figure 4:
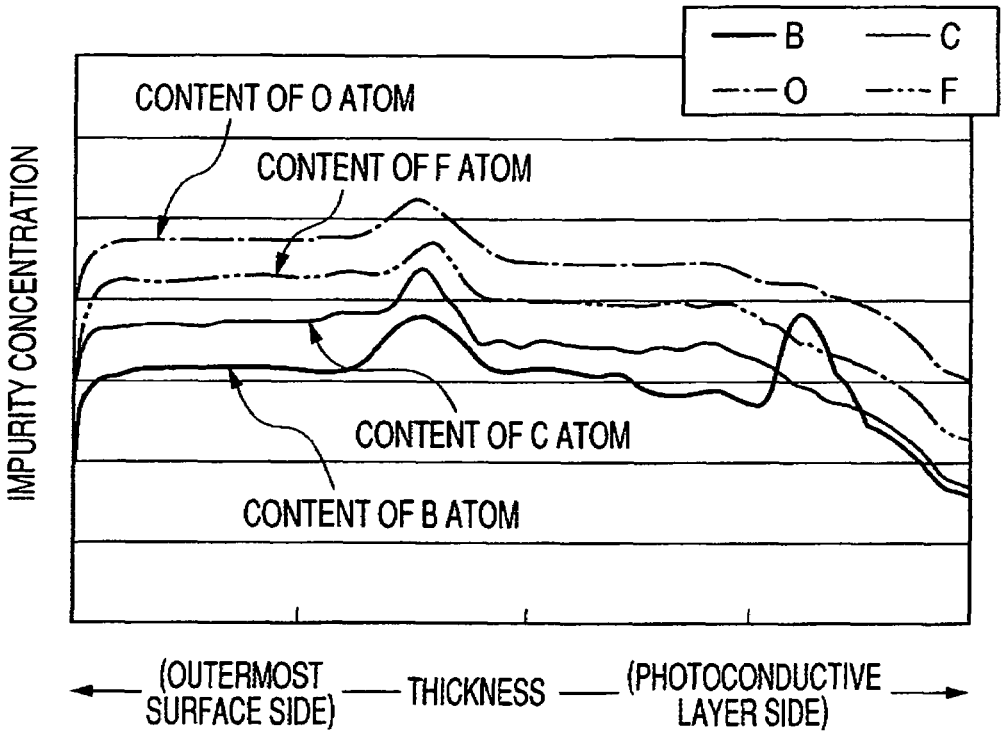
FIG. 4 shows an example of a depth profile for explaining the local maximum values of the contents of a Group 13 element in the periodic table (a boron atom), a carbon atom, an oxygen atom, and a fluorine atom in a surface layer in the present invention.

FIG. 4 is a schematic concentration profile of each element in the surface region layer.

As shown in FIG. 4, in the surface region layer, the local maximum value of a boron atom (a Group 13 element in the periodic table) content and the local maximum value of each of a carbon atom content, a fluorine atom content and an oxygen atom content are created on the outermost surface side, and another local maximum value of the boron atom content is created at a position close to a deeper photoconductive layer side. In other words, the local maximum value of each of the carbon atom content, the fluorine atom content, and the oxygen atom content is observed at one position, and the local maximum values of the boron atom content are observed at two positions.

Here, a local maximum value in the present invention will be described with reference to FIGS. 22 and 23.

Figure 22:
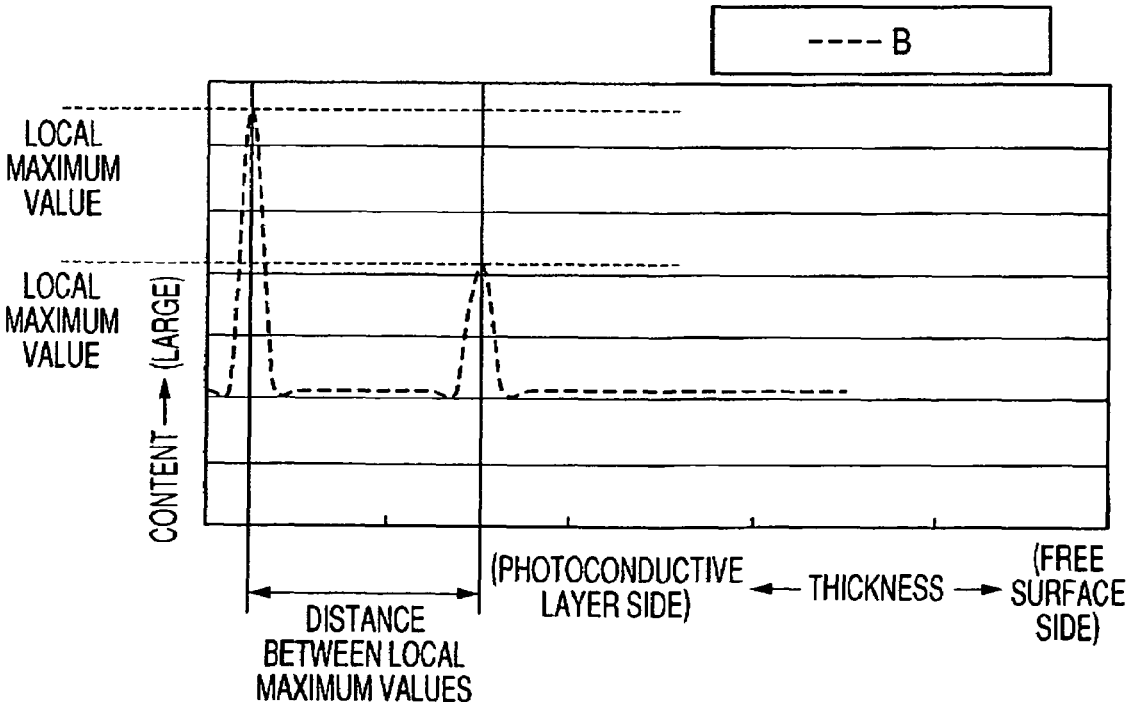
FIG. 22 is a schematic view showing the relationship between the local maximum values and the distance between the local maximum values of a surface region layer.
Figure 23:
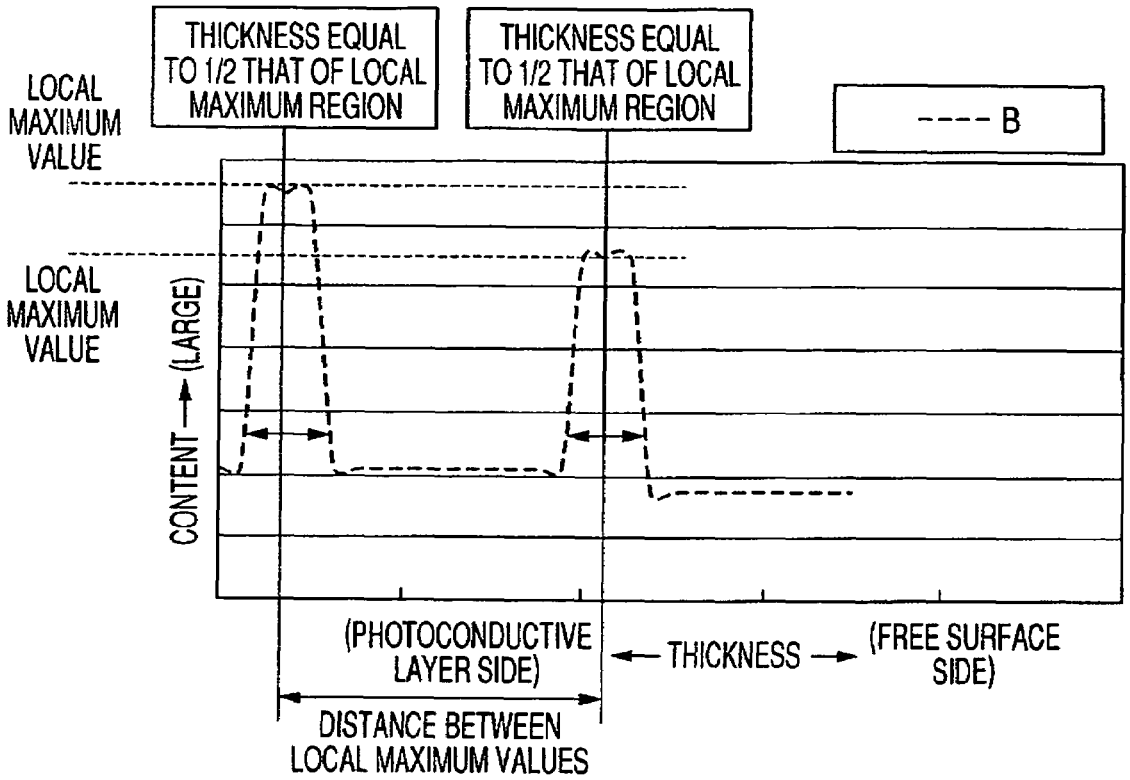
FIG. 23 is a schematic view showing a relationship among the local maximum value region, the local maximum values, and the distance between the local maximum values, of the surface region layer in the present invention.

In the present invention, as shown in FIG. 22, the distribution of each of the Group 13 element content and a carbon atom content preferably shows a shape in which a local maximum value is present at a peak portion and which has no certain region. However, the case where a local maximum value is present in a certain region with a certain width as shown in FIG. 23 is also effective for the case where an element content on the outermost surface side is larger than an adjacent element content in the certain region. The certain region is referred to as a local maximum region.

In the case of a shape having no certain region, a local maximum value is represented by an atom content at a peak portion. In the case of a local maximum region, a local maximum value is represented by an atom content at a position (intermediate point) corresponding to half of the local maximum region in the thickness direction.

In the case of a shape having no certain region, the distance between local maximum values is represented by the interval between peak portions. In the case where a content distribution has a local maximum region, the distance between local maximum values is represented by the distance between two intermediate points.

In the case where the content distribution has one shape having no certain region and one local maximum region, the distance between local maximum values is represented by the distance between the local maximum values of the respective regions.

In the present invention, it is preferable that at least one of the distribution of the oxygen atom content and the distribution of the fluorine atom content also preferably shows a shape having no certain region.

In a film with a large stress composed of a material such as a-SiN, the distribution is desirably of a shape in which a local maximum value is present at a peak portion and which has no certain region because a local region for effectively relaxing a stress is easily formed as compared with a shape having a local maximum region. In this case, as a result, the relaxation of the stress in the entire film is expected to efficiently progress. Furthermore, in the case of a shape having no certain region, it is considered that a region is locally formed in which carriers easily spread to lower dot reproducibility or fine-line reproducibility in the movement of photocarriers at the time of image exposure, and the spreading of the carriers are so suppressed as to be small.

Figure 24:
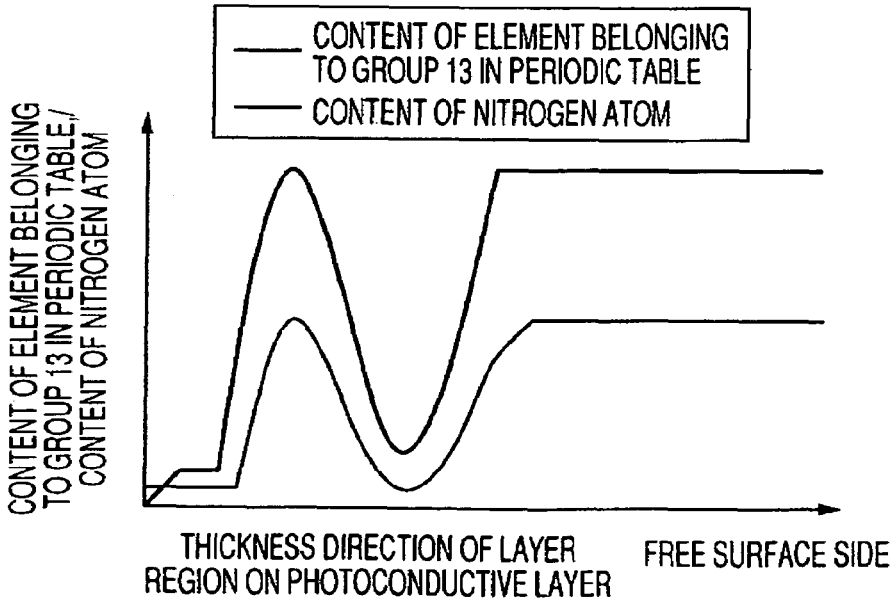
FIG. 24 is a view showing the content distributions of a Group 13 element in the periodic table and a nitrogen atom in the thickness direction of the surface region layer of an example of the electrophotographic photosensitive member of the present invention.

The number of local maximum values of each of the Group 13 element content and the nitrogen atom content in the surface region layer in the thickness direction is required to be two or more. The number of local maximum values of each of the contents may be two or three. Alternatively, the number of local maximum values of one of the contents may be different from the other. For example, the number of local maximum values of one of the contents may be two, and that of the other content may be three or four. Those local maximum values may be placed at any positions in the thickness direction of the surface region layer. For example, as shown in the graph of FIG. 24 showing an Group 13 element content and a nitrogen atom content, the local maximum values of the respective atom contents may be placed at an identical position in the thickness direction. A local maximum value of the nitrogen atom content and a local maximum value of the Group 13 element content in the thickness direction are preferably alternately placed. In this case, the Group 13 element content preferably has a local maximum value on the photoconductive layer side because the chargeability of the photosensitive member can be improved. In addition, it is particularly preferable that the nitrogen atom content has a local maximum value on the free surface side from the viewpoint of the flaw resistance and wear resistance of the photosensitive member. A surface region layer having such local maximum value can have a layer constitution in which two or more top injection-blocking layers each having one local maximum value of the Group 13 element content in a thickness direction and one or two or more intermediate layers each having one local maximum value of a nitrogen atom content in the thickness direction are alternately arranged on a photoconductive layer and a surface protective layer having one local maximum value of the nitrogen atom content in the thickness direction is arranged as an outermost layer having a free surface. An example of such layer constitution includes a constitution in which four layers (a first top injection-blocking layer, an intermediate layer, a second top injection-blocking layer and the surface layer 107) are arranged in the stated order on the photoconductive layer 103.

Figure 25A:
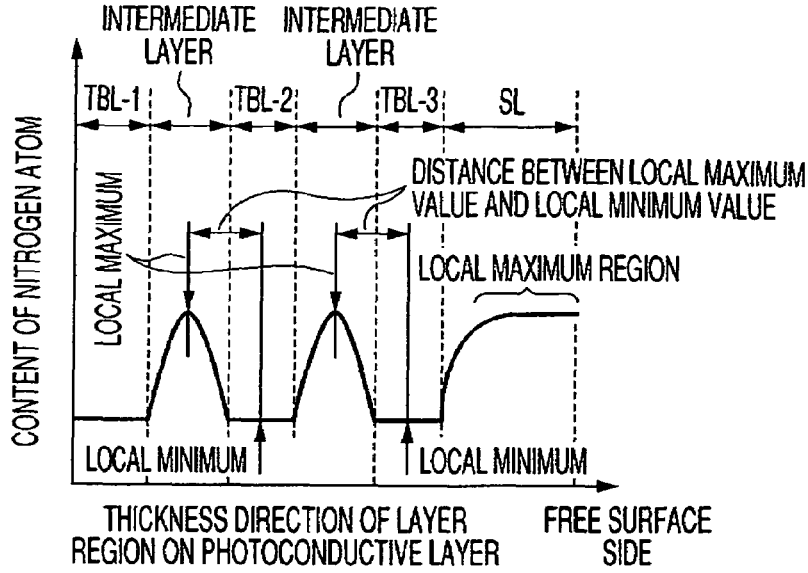
FIG. 25A is a view showing the content distribution of a nitrogen atom in the thickness direction of the surface region layer of an example of the electrophotographic photosensitive member of the present invention.

Here, the local maximum values of the nitrogen atom content, the Group 13 element content, and the carbon atom content in the surface region layer will be described. In the surface region layer, a local maximum value of the nitrogen atom content in the thickness direction may be of a peak shape like a local maximum value in an intermediate layer shown in each of FIGS. 25A, 25C, and 25D, or may be of a shape having a certain value (referred to as a local maximum region) in a certain length in the thickness direction like a local maximum value in an intermediate layer shown in FIG. 25B or in a surface layer (SL) shown in each of FIGS. 25A to 25D. When the content has such local maximum region, a local maximum value is represented by an atom content at a position (intermediate point) corresponding to half of the local maximum region in the thickness direction, and the distance between a local maximum value and a minimum value between local maximum values is represented by a distance from the intermediate point as an origin. A nitrogen atom content at a local maximum value represented by N/(Si+N) is preferably 30 atm % or more and a ratio of a local maximum value of the nitrogen atom content to the minimum value thereof (present in the top injection-blocking layer) (local maximum value/minimum value) is preferably 1.10 or more for improving sensitivity, wear resistance, and flaw resistance. The distance between a local maximum value on the photoconductive layer side out of adjacent local maximum values of the nitrogen atom content in the thickness direction and a minimum value between the local maximum values is more preferably in the range of 40 nm to 300 nm for improving chargeability and sensitivity to light having a short wavelength. Such distance between the local maximum value and minimum value of the nitrogen atom content can be adjusted by changing the thickness of the top injection-blocking layer.

Figure 26A:
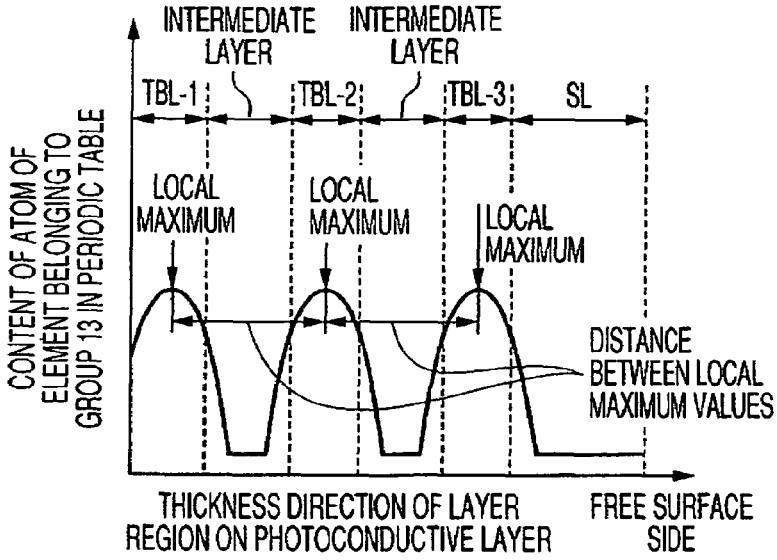
FIG. 26A is a view showing the content distribution of a Group 13 element in the periodic table in the thickness direction of the surface region layer of an example of the electrophotographic photosensitive member of the present invention.
Figure 26B:
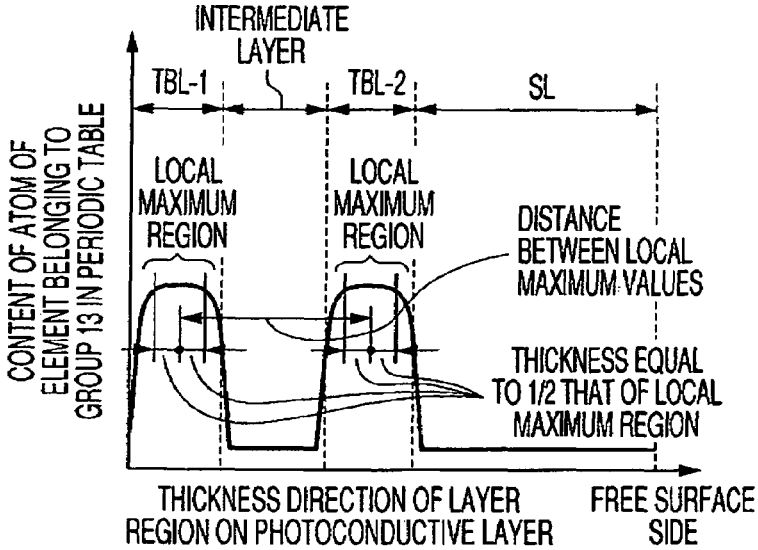
FIG. 26B is a view showing the content distribution of a Group 13 element in the periodic table in the thickness direction of the surface region layer of an example of the electrophotographic photosensitive member of the present invention.

In addition, in the surface region layer, a local maximum value of the Group 13 element content in the thickness direction may be of a peak shape as shown in each of FIG. 26A and FIGS. 26C to 26E, or may be of a shape having a certain value in a certain length in the thickness direction (referred to as a local maximum region) as shown in FIG. 26B.

When the content has such a local maximum region, a local maximum value is represented by an atom content at a position (intermediate point) corresponding to half of the local maximum region in the thickness direction, and the distance between local maximum values is represented by a distance from the intermediate point as an origin. When the content has one local maximum value and one local maximum region in the surface region layer, the distance between the intermediate point of the local maximum region and the local maximum value is defined as the distance between local maximum values. A local maximum value or local maximum region closest to the photoconductive layer among the local maximum values or local maximum regions of the Group 13 element content is preferably highest (FIG. 26E). Specifically, the Group 13 element content at the local maximum value placed on the side closest to the photoconductive layer is preferably $5.0\times10^{18}$ atoms/cm$^3$ or more, and the Group 13 element content at the minimum value of the Group 13 element content present between two adjacent local maximum values is preferably $2.5\times10^{18}$ atoms/cm$^3$ or less from the viewpoint of sensitivity, chargeability and resolution. The term "minimum value" as used herein refers to the smallest value among the Group 13 element contents present between local maximum values. For example, when three or more local maximum values are present, the term refers to the smallest value among two or more local minimum values of the Group 13 element contents each of which is present between any two adjacent local maximum values. In FIGS. 26A to 26E, as for the Group 13 element content in the intermediate layer and the surface layer, the local minimum value is represented by a base value. When none of the elements belonging to Group 13 in the periodic table is incorporated into those layers, the base value represents the detection limit value of a means for analyzing the content. The distance between the two adjacent local maximum values of the Group 13 element content in the thickness direction in the surface region layer is preferably in the range of 100 nm to 1,000 nm from the viewpoint of dot reproducibility and fine-line reproducibility. Such distance between the local maximum values of the Group 13 element content can be adjusted by changing the thickness of the intermediate layer.

In such a surface region layer, the local maximum value of the Group 13 element content and a local maximum value of the nitrogen atom content are preferably present alternately in the thickness direction, and are preferably present in the order of the local maximum value of the Group 13 element content and the local maximum value of the nitrogen atom content from the photoconductive layer toward a free surface in terms of the flaw resistance and wear resistance of the photosensitive member.

Figure 27A:
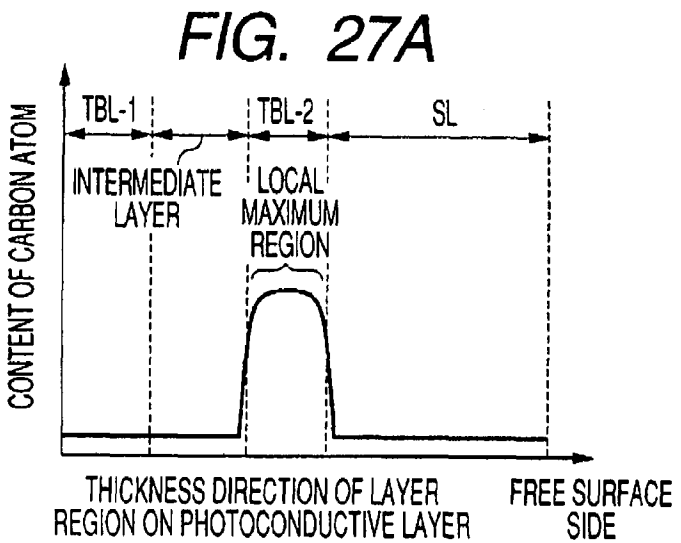
FIG. 27A is a view showing the content distribution of a carbon atom in the thickness direction of the surface region layer of an example of the electrophotographic photosensitive member of the present invention.

In addition, in the surface region layer, the carbon atom content preferably has a local maximum value as shown in each of FIGS. 27A to 27D. The local maximum value of the carbon atom content in the thickness direction may be present in any of the intermediate layer, the top injection-blocking layer and the surface layer. The distribution of the carbon atom content may be of a peak shape as shown in each of FIG. 27B and FIG. 27C, or may be of a shape having a certain value in a certain length in the thickness direction (referred to as a local maximum region) as shown in FIG. 27A. When the content has such a local maximum region, a local maximum value is represented by an atom content at a position (intermediate point) corresponding to half of the local maximum region in the thickness direction. In FIGS. 27A to 27D, as for the carbon atom content in the surface region layer, the local minimum value is represented by a base value. It should be noted that there is no need to incorporate carbon atoms over the entire region of the surface region layer. That is, a layer region free of carbon atoms may be present. In such a case, the base value represents the detection limit value of a means for analyzing the content.

Hydrogen atoms are preferably incorporated into the surface region layer. Hydrogen atoms compensate for unused bonding valences of silicon atoms to improve the quality of the layer, in particular, the photoconductive properties and charge holding properties of the layer. In ordinary cases, an average hydrogen content in the layer is preferably 5 to 70 atm %, more preferably 8 to 60 atm %, or still more preferably 10 to 50 atm % with respect to the total amount of constituent atoms.

Examples of a substance that can be effectively used as a gas for supplying silicon (Si) to be used for forming the surface region layer include: gaseous substances such as $SiH_4$, $Si_2H_6$, $Si_3H_8$, and $Si_4H_{10}$; and silicon hydrides (silanes) capable of being gasified. Of those, $SiH_4$ and $Si_2H_6$ are preferable in terms of easiness of handling in the production of the layer, good efficiency of Si supply, and the like. Such raw material gas for supplying Si may be diluted with a gas such as $H_2$, He, Ar, or Ne as required.

Examples of a substance that can be effectively used as a gas for supplying nitrogen include: gaseous substances such as $N_2$, $NH_3$, NO, $N_2O$, and $NO_2$; and compounds capable of being gasified. Examples of a substance that can be effectively used as a gas for supplying carbon include: gaseous substances such as $CH_4$, $C_2H_2$, $CF_4$, $C_2F_6$, CO, and $CO_2$; and compounds capable of being gasified.

Of those, nitrogen is a preferable gas for supplying nitrogen because best properties can be obtained. $CH_4$ is a preferable gas for supplying carbon for the same reason. NO is a preferable gas for supplying oxygen for the same reason.

Each of those raw material gases for supplying nitrogen, carbon and oxygen may be diluted with a gas such as $H_2$, He, Ar, or Ne as required. In particular, in the case where a slight amount of oxygen is added, for example, an NO gas is diluted with an He gas before it is supplied. As a result, the flow rate of the gas can be accurately controlled.

Examples of a substance that can be effectively used as a gas for supplying oxygen include: gaseous substances such as $O_2$, CO, $CO_2$, NO, $N_2O$, and $NO_2$; and compounds capable of being gasified.

Of those, NO is a preferable gas for supplying oxygen because best properties can be obtained.

A fluorine gas ($F_2$), an interhalogen compound such as BrF, ClF, $ClF_3$, $BrF_3$, $BrF_5$, $IF_3$, or $IF_7$, or a silicon fluoride such as $SiF_4$ or $Si_2F_6$ may be introduced for supplying a fluorine atom.

Specific examples of a raw material substance for introducing an atom belonging to Group 13 in the periodic table include: raw material substances for introducing boron atoms including boron hydrides (such as $B_2H_6$, $B_4H_{10}$, $B_5H_9$, $B_5H_{11}$, $B_6H_{10}$, $B_6H_{12}$, and $B_6H_{14}$) and boron halides (such as $BF_3$, $BCl_3$, and $BBr_3$); $AlCl_3$; $GaCl_3$; $Ga(CH_3)_3$; $InCl_3$; and $TlCl_3$.

The gas pressure of a reaction vessel, discharge electric power, and the temperature of the substrate must be appropriately set for forming the surface region layer 104. In general, the substrate temperature whose optimum range is appropriately selected in accordance with the layer design is in the range of preferably 150° C. to 350° C., more preferably 180° C. to 330° C., or still more preferably 200° C. to 300° C.

In general, the pressure in the reaction vessel whose optimum range is similarly appropriately selected in accordance with the layer design is in the range of preferably $1\times10^{-2}$ Pa to $1\times10^{3}$ Pa, more preferably $5\times10^{-2}$ Pa to $5\times10^{2}$ Pa, or still more preferably $1\times10^{-1}$ Pa to $1\times10^{2}$ Pa.

In the present invention, the above-described ranges are exemplified as preferable numerical ranges for the temperature of the conductive substrate and the gas pressure for forming the surface region layer. However, in general, conditions are not determined independently or separately. Optimum values are preferably determined on the basis of mutual and organic relatedness for forming a photosensitive member having desired properties.

In addition, for example, when the surface region layer is produced by means of a glow discharge method using a high-frequency wave in an RF band, discharge electric power is suitably in the range of 10 W to 5,000 W, or about 2 mW/cm$^2$ to 1.4 W/cm$^2$ in terms of electric power per cathode electrode area (cm$^2$). A flow rate FSi of a silicon-containing gas (unit: mL/min (normal)), a flow rate FN of a nitrogen-containing gas (unit: mL/min (normal)), and discharge electric power W (unit: W) must establish an appropriate relationship for obtaining an a-SiN-based film having a good transmitting property as a result of the realization of the above nitrogen range. That is, it has been found that the product of "electric power per unit gas amount, in particular, electric power per unit gas amount of a silicon-containing gas (W/FSi)" by "a gas concentration ratio of a nitrogen-containing gas to the silicon-containing gas (FN/FSi)", that is, $W \cdot FN/FSi^2$ is in the range of preferably 50 W·min/mL (normal) to 300 W·min/mL (normal), or more preferably 80 W·min/mL (normal) to 200 W·min/mL (normal).

The surface region layer having the above constitution is produced under the above production conditions, whereby a film suitable for the surface region layer which can transmit light having a short wavelength can be produced. The surface region layer can have an optical band gap of about 2.8 eV or more and an absorption coefficient of 5,000 $cm^{-1}$ or less. When the product of the electric power by the flow rate ratio is smaller than 50 W·min/mL (normal), an absorption coefficient becomes large, and light having a short wavelength comes to be difficult to transmit. In addition, when the product exceeds 300 W·min/mL (normal), the hardness of the film tends to decrease. This is probably because damage from plasma is introduced in the production of the film.

The reason why the above ranges of the production conditions are preferable, which has not been revealed yet, is probably as follows. The radicals of raw material substances present in plasma must be appropriately balanced for obtaining a desired film. When multiple raw material gases are used, a radical concentration upon decomposition of a raw material gas is probably determined by a raw material gas concentration ratio and electric power. However, decomposition efficiency varies depending on kinds of gas. Therefore, it is considered that a radical concentration does not fall within an appropriate range unless each of an electric power value and a gas flow rate ratio is allowed to fall within an appropriate range.

Furthermore, in the present invention, it is preferable to control the Group 13 element content in the surface region layer to have a local maximum value. Furthermore, it is more preferable to control each of a carbon atom content, an oxygen atom content, and a fluorine atom content to have a local maximum value.

A local maximum value can be formed by controlling a gas for supplying the Group 13 element and a raw material gas for supplying each of a carbon atom, an oxygen atom, and a fluorine atom during the formation of the surface region layer. The control of a raw material gas for forming a local maximum value includes appropriately controlling conditions for forming a deposition film such as a gas concentration, a gas flow rate, high-frequency electric power, and substrate temperature.

Where Omax and Fmax are defiend as a maximum oxygen atom content and a maximum fluorine atom content, respectively, and Omin and Fmin are defined as a minimum oxygen atom content and a minimum fluorine atom content in the entire surface region layer, respectively, a ratio of the maximum content Omax to the minimum content Omin and a ratio of the maximum content Fmax to the minimum content Fmin preferably satisfy the relationship of $2 \leqq Omax/Omin$ and the relationship of $2 \leqq Fmax/Fmin$, respectively. The minimum content defined herein refers to the value of the minimum content in the surface region layer free of the change layer 108 or the like to be arbitrarily inserted. In FIG. 4, the right end of the graph corresponds to a portion where the deposition of the surface region layer starts, and values in the region correspond to Omin and Fmin.

The average oxygen atom content in the surface region layer represented in the form of O/(Si+N+O) is in the range of 0.01 atm % to 20 atm %, preferably 0.1 atm % to 10 atm %, or optimally 0.5 atm % to 8 atm %. If an oxygen atom-containing gas such as NO diluted with a gas such as He is introduced at a flow rate accurately controlled through a massflow controller, it is sufficient to adjust the content to such a range.

The average fluorine atom content in the surface region layer represented in the form of F/(Si+N+F) is in the range of preferably 0.01 atm % to 20 atm %, more preferably 0.1 atm % to 10 atm %, or still more preferably 0.5 atm % to 8 atm %.

If a fluorine atom-containing gas such as $SiF_4$ or $CF_4$ diluted with a gas such as He is introduced at a flow rate accurately controlled through a massflow controller, it is sufficient to adjust the content to such a range.

In general, the thickness of the surface region layer is in the range of preferably 0.01 to 5 μm, more preferably 0.05 to 3 μm, or still more preferably 0.1 to 1 μm. When the thickness is larger than 0.01 μm, the surface region layer is not lost owing to abrasion or the like during the use of a light-receiving member. No deterioration in electrophotographic properties such as an increase in residual potential occur as long as the thickness does not exceed 5 μm.

The temperature of a substrate, gas pressure in a reaction vessel and the like must be appropriately set as desired for forming such a surface region layer as described above.

The substrate temperature whose optimum range is appropriately selected in accordance with the layer design is normally in the range of preferably 200° C. to 350° C., more preferably 230° C. to 330° C. (both inclusive), or still more preferably 250° C. to 300° C.

The pressure in the reaction vessel whose optimum range is similarly appropriately selected in accordance with the layer design is normally in the range of preferably $1\times10^{-2}$ Pa to $2\times10^{3}$ Pa, more preferably $5\times10^{-1}$ Pa to $5\times10^{2}$ Pa, or still more preferably $1\times10^{1}$ Pa to $1\times10^{2}$ Pa.

In the present invention, the above-described ranges are exemplified as preferable numerical ranges for the substrate temperature and the gas pressure for forming the surface region layer. However, in general, conditions are not determined independently or separately. Optimum values are preferably determined on the basis of mutual and organic relevance for forming an electrophotographic photosensitive member having desired properties. Each of the layers to be formed in the surface region layer will be described.

<Surface Layer>

The surface layer 107 is a portion of the surface region layer where the composition ratio between a silicon atom and a nitrogen atom is substantially constant, and is positioned as a surface protective layer for providing good properties mainly concerning the property of transmitting light having a short wavelength, high resolution, resistance to continuous repeated use, moisture resistance, resistance to service environments, and the like.

<Surface Protective Layer>

The surface protective layer positioned in the surface region layer in the present invention has a free surface, is composed of a non-single-crystal silicon nitride film using a silicon atom and a nitrogen atom as base materials, has one local maximum value of a nitrogen atom content in a thickness direction, and imparts moisture resistance, resistance to continuous repeated use, a high withstand voltage, resistance to service environments, and durability to the photosensitive member. The local maximum value of the nitrogen atom content in the thickness direction, the shape of the local maximum value, the relationship between the local maximum value and the minimum value of the nitrogen atom content in a top injection-blocking layer, an average nitrogen atom content and the like are the same as those of an intermediate layer to be described later.

The surface protective layer contains carbon atoms, oxygen atoms, halogen atoms such as fluorine atoms, hydrogen atoms or the like as required on the basis of a relationship with the top injection-blocking layer or the intermediate layer. An average nitrogen atom concentration in the surface layer (N/(Si+N)) (atm %) preferably satisfies the relationship of 30 atm % ≦N/(Si+N))≦70 atm % in terms of sensitivity and yield. At least one of hydrogen and halogen in the surface protective layer compensates for unused bonding valences of constituent atoms such as silicon to improve the quality of the layer, in particular, the photoconductive properties and charge holding properties of the layer. From such a viewpoint, a hydrogen content is preferably in a range of 30 atm % to 70 atm %, more preferably 35 atm % to 65 atm %, or still more preferably 40 atm % to 60 atm % with respect to the total amount of constituent atoms. In addition, a halogen atom content, for example, a fluorine atom content is in the range of 0.01 atm % to 15 atm %, preferably 0.1 atm % to 10 atm %, or more preferably 0.6 atm % to 4 atm %.

The thickness of the surface protective layer is in the range of 10 nm to 3,000 nm, preferably 50 nm to 2,000 nm, or more preferably 100 nm to 1,000 nm. When the thickness is equal to or larger than 10 nm, the surface layer is not lost owing to abrasion or the like during the use of a photosensitive member. When the thickness is 3,000 nm or less, an increase in residual potential or the like does not occur, and excellent electrophotographic properties can be obtained.

A surface protective layer having properties with which the object of the present invention can be achieved can be formed by means of, for example, a glow discharge method. The temperature of a substrate and gas pressure in a reaction vessel can be appropriately set as desired in the formation of the surface protective layer by means of the glow discharge method. For example, the substrate temperature (Ts) whose optimum range is appropriately selected in accordance with the layer design is in the range of 150° C. to 350° C., preferably 180° C. to 330° C., or more preferably 200° C. to 300° C. The pressure in the reaction vessel whose optimum range is similarly appropriately selected in accordance with the layer design is in the range of $1\times10^{-2}$ Pa to $1\times10^{3}$ Pa, preferably $5\times10^{-2}$ Pa to $5\times10^{2}$ Pa, or more preferably $1\times10^{-1}$ Pa to $1\times10^{2}$ Pa. The above-described ranges are exemplified as preferable numerical ranges for the substrate temperature and the gas pressure for forming the surface protective layer. However, in general, conditions are not determined independently or separately. Optimum values are preferably determined on the basis of mutual and organic relevance for forming a photosensitive member having desired properties.

<Change Layer>

The change layer 108 is a portion of the surface region layer where the composition ratio between a silicon atom and a nitrogen atom changes, and is a layer arranged mainly for forming the optical continuity between the surface layer 107 as a surface protective layer and at least one of the photoconductive layer 103 and the top injection-blocking layer 106. The arrangement of the change layer improves the adhesiveness between the surface layer and the photoconductive layer, and smoothens the movement of photocarriers into the surface, and besides, can additionally reduce an influence of interference due to the reflection of light at an interface between the photoconductive layer and the surface layer.

The change layer is preferably positioned to achieve optical continuity with which the minimum value (Min) and maximum value (Max) of a reflectivity (%) in the wavelength range of 350 nm to 680 nm satisfy the relationship of 0% ≦Max (%)≦20% and the relationship of 0≦(Max−Min)/(100−Max)≦0.15.

Arranging the change layer 108 in such a manner that the minimum and maximum values satisfy the above relationships exhibits an effect of preventing interference of exposure, improves electrical connectivity and sensitivity, reduces ghosts, and improves the mobility of photocarriers due to image exposure. As a result, good properties for high resolution and the like can be effectively obtained.

It is also effective to adapt the change layer 108 in such a manner that the Group 13 element content and the carbon atom content each have a local maximum value. For obtaining chargeability, a reduction in residual potential, and a dark/light attenuation electric potential as good electrical properties, the Group 13 element and carbon atoms are preferably incorporated into the change layer 108 in such a manner that the Group 13 element content and the carbon atom content each have a local maximum value, and the change layer is preferably provided with a top injection-blocking function.

<Top Injection-blocking Layer>

As shown in FIG. 1B, it is also useful to arrange the top injection-blocking layer 106 on the side of the photoconductive layer 103 in the surface region layer 104. In addition, as shown in FIG. 1D, two or more top injection-blocking layers can be positioned with an intermediate layer interposed therebetween.

The function of each of the top injection-blocking layers 106*a* and 106*b* is to block the penetration of charges from an upper portion (that is, from the surface layer side) to improve chargeability.

Specific examples of the Group 13 element in the periodic table include boron (B), aluminum (Al), gallium (Ga), indium (In), and thallium (Tl). Of those, boron is particularly suitable.

When incorporating an element belonging to Group 13 in the periodic table into the top injection-blocking layer, conductivity can be controlled. The content of the Group 13 element in the periodic table is preferably distributed to have a local maximum value. A local maximum region having a certain region is also effective. In this case, a local maximum value is preferably $5\times10^{18}$ atoms/cm$^3$ or more.

In each of the two or more (first, second, . . . ) top injection-blocking layers 106*a* and 106*b* positioned in the surface region layer shown in FIG. 1D, a local maximum value of the content of the element belonging to Group 13 in the periodic table is in the range of preferably 50 atm ppm to 3,000 atm ppm, or more preferably 100 atm ppm to 1,500 atm ppm with respect to the total amount of the constituent atoms of the top injection-blocking layer.

Incorporating an element belonging to Group 13 in the periodic table into the top injection-blocking layer, conductivity can be controlled. The atoms of the Group 13 element in the periodic table are incorporated with uniform distribution in the in-plane direction parallel to the surface of the substrate, whereby properties in the in-plane direction can be uniformized.

The top injection-blocking layer is composed of a non-single-crystal material using a silicon atom and a nitrogen atom as base materials and containing a Group 13 element and a carbon atom, and preferably contains hydrogen atoms, oxygen atoms, and/or fluorine atoms in an appropriate manner.

The content of nitrogen atoms incorporated into the top injection-blocking layer 106 is in the range of preferably 5 atm % to 35 atm %, more preferably 10 atm % to 30 atm % (both inclusive), or still more preferably 15 atm % to 30 atm % with respect to the sum of silicon atoms and nitrogen atoms as constituent atoms.

In addition, the contents of nitrogen atoms, carbon atoms, and oxygen atoms incorporated into each of the top injection-blocking layers 106*a* and 106*b* are related to the contents of these atoms in the intermediate layer or the surface protective layer, and are appropriately determined in such a manner that the object of the present invention is effectively achieved. When atoms of one kind are incorporated, a ratio of the amount of the atoms to the sum of that amount and the amount of silicon is in the range of preferably 10 atm % to 70 atm %, more preferably 15 atm % to 65 atm %, or still more preferably 20 atm % to 60 atm %. When atoms of two or more kinds are incorporated, a ratio of the amount of the atoms to the sum of that amount and the amount of silicon is in the range of preferably 10 atm % to 70 atm %, more preferably 15 atm % to 65 atm %, or still more preferably 20 atm % to 60 atm %.

Hydrogen atoms are preferably incorporated into the top injection-blocking layer. Hydrogen atoms are indispensable to compensate for unused bonding valences of silicon atoms, thereby improving the quality of the layer, in particular, the photoconductive properties and charge holding properties of the layer. In general, a hydrogen content is in the range of preferably 30 atm % to 70 atm %, more preferably 35 atm % to 65 atm %, or still more preferably 40 atm % to 60 atm % with respect to the total amount of the constituent atoms in the top injection-blocking layer.

The thickness of the top injection-blocking layer in the present invention is in the range of preferably 5 nm to 1,000 nm, more preferably 10 nm to 800 nm, or still more preferably 15 nm to 500 nm in terms of, for example, desired electrophotographic properties and an economic effect. When the thickness is equal to or larger than 5 nm, a sufficient ability to block the injection of charges from the surface side can be obtained, and sufficient chargeability can be obtained. As a result, no deterioration in electrophotographic properties occurs. As long as the thickness dose not exceed 1,000 nm, no deterioration in electrophotographic properties such as sensitivity occurs.

It is also effective to continuously change the composition of the top injection-blocking layer from the side of the photoconductive layer 103 toward the surface region layer 104. The continuous change has, for example, an effect of improving adhesiveness and a effect of preventing interference.

The mixing ratio between a gas for supplying silicon atoms and a gas for supplying nitrogen atoms, gas pressure in a reaction vessel, discharge electric power, and the temperature of a substrate must be appropriately set for forming a top injection-blocking layer having properties with which the above object can be achieved.

In general, the pressure in the reaction vessel whose optimum range is similarly appropriately selected in accordance with the layer design is in the range of preferably $1\times10^{-2}$ Pa to $1\times10^{3}$ Pa, more preferably $5\times10^{-2}$ Pa to $5\times10^{2}$ Pa, or still more preferably $1\times10^{-1}$ Pa to $1\times10^{2}$ Pa.

Furthermore, in general, the substrate temperature whose optimum range is appropriately selected in accordance with the layer design is in the range of preferably 150° C. to 350° C., more preferably 180° C. to 330° C., or still more preferably 200° C. to 300° C.

<Intermediate Layer>

The intermediate layer positioned in the surface region layer of the present invention is composed of a non-single-crystal silicon nitride film using silicon atoms and nitrogen atoms as base materials, and has one local maximum value of the nitrogen atom content in a thickness direction. Such an intermediate layer is arranged between a first top injection-blocking layer (TBL-1) and a second top injection-blocking layer (TBL-2) or between the second top injection-blocking layer (TBL-2) and a third top injection-blocking layer (TBL-3). As a result, the content of an Group 13 element in the periodic table with respect to the total number of the constituent atoms in the surface region layer has at least two local maximum values or local maximum regions in the thickness direction of the surface region layer, and has a minimum value to be inevitably formed between the two local maximum values. Furthermore, the distribution of a nitrogen atom content having two or more local maximum values in the thickness direction of the surface region layer including a local maximum value placed at the surface protective layer is formed.

Nitrogen atoms, carbon atoms, and/or oxygen atoms to be incorporated into one intermediate layer are incorporated into the intermediate layer at a content in the range of preferably 10 atm % to 90 atm %, more preferably 15 atm % to 85 atm %, or still more preferably 20 atm % to 80 atm % with respect to the total amount of all atoms constituting the intermediate layer in terms of sensitivity and electrical properties. However, in any case, the atoms must be evenly incorporated with uniform distribution in the in-plane direction parallel to the surface of the substrate for uniformizing properties in the in-plane direction. In addition, the nitrogen atom content of the intermediate layer is preferably larger than that of the first or second top injection-blocking layer. A Group 13 element in the periodic table may be incorporated into the intermediate layer. In this case, the content is preferably $2.5\times10^{18}$ atoms/cm$^3$ or less in terms of sensitivity.

Such intermediate layer can be formed by means of, for example, a glow discharge method. In the formation of the intermediate layer by means of the glow discharge method, a raw material gas or the like similar to that in the case of the formation of the top injection-blocking layer can be used, and a mixing ratio between gases, gas pressure in a reaction vessel, discharge electric power, and the temperature of a substrate can be appropriately set.

<Substrate>

Examples of a conductive substrate to be used in the present invention include metals such as Al, Cr, Mo, Au, In, Nb, Te, V, Ti, Pt, Pd, and Fc, and alloys of them such as stainless steel.

In addition, a film or sheet made of a synthetic resin (such as polyester, polyethylene, polycarbonate, cellulose acetate, polypropylene, polyvinyl chloride, polystyrene, or polyamide), or an electrical insulating substrate (such as a glass or ceramic) is used after at least the surface of the film, sheet, or substrate on a side on which a light-receiving layer is to be formed has been subjected to conductive treatment.

The substrate may be of a cylindrical or endless belt shape having a smooth surface or an irregular surface. The thickness of the substrate is appropriately determined in such a manner that such a light-receiving member as desired can be formed. When flexibility is demanded for the light-receiving member, the thickness of the substrate can be reduced to the extent that the substrate can sufficiently exert its function. However, the thickness of the substrate is typically 10 μm or more in terms of, for example, production, handling, and mechanical strength.

<Photoconductive Layer>

When a photoconductive layer is formed by means of, for example, a glow discharge method, the following procedure can be basically adopted. A raw material gas for supplying Si capable of supplying silicon atoms (Si), a raw material gas for supplying H capable of supplying hydrogen atoms (H) and, as required, a raw material gas for supplying X capable of supplying halogen atoms (X) are introduced in desired gas states into a reaction vessel the pressure in which can be reduced, thereby causing glow discharge in the reaction vessel. Then, a layer composed of a-Si:H,X is formed on a predetermined substrate placed at a predetermined position in advance.

Hydrogen atoms in the photoconductive layer and halogen atoms to be added as required each compensate for unused bonding valences of silicon atoms to improve the quality of the layer, in particular, the photoconductive properties and charge holding properties of the layer.

A hydrogen atom content, which is not particularly limited, is preferably 10 to 40 atm % with respect to the sum of silicon and hydrogen atoms. It is preferable that the shape of the distribution of the content is adjusted appropriately by, for example, changing the content in relation to a wavelength in an exposure system.

In particular, it is known that when a hydrogen atom content or a halogen atom content is increased to some extent, an optical band gap increases and a sensitivity peak shifts to the shorter wavelength side. Such expansion of the optical band gap is preferable when exposure at a short wavelength is employed. In this case, the hydrogen atom content is preferably 15 atm % or more with respect to the sum of silicon and hydrogen atoms.

Examples of a substance that can be effectively used as a gas for supplying Si include: gaseous substances such as $SiH_4$, $Si_2H_6$, $Si_3H_8$, and $Si_4H_{10}$; and silicon hydrides (silanes) capable of being gasified. Of those, $SiH_4$ and $Si_2H_6$ are preferable in terms of easiness of handling in the production of the layer, good efficiency of Si supply and the like. Each of the gases may be used singly, or two or more of them may be mixed at a predetermined mixing ratio.

Furthermore, those gases can be mixed with the desired amount of one or more kinds of gases selected from $H_2$, He and a silicon compound containing a hydrogen atom before the layer is formed in consideration of, for example, the controllability of the physical properties of the film and convenience in gas supply. Specific examples of a raw material gas for supplying halogen atoms include: a fluorine gas ($F_2$); an interhalogen compound such as BrF, ClF, $ClF_3$, $BrF_3$, $BrF_5$, $IF_3$ or $IF_7$; and a silicon fluoride such as $SiF_4$ or $Si_2F_6$.

In order to control the amount of the halogen element to be incorporated into the photoconductive layer, it is sufficient to control, for example, the temperature of a substrate, the amount of a raw material to be introduced into a reaction vessel, the pressure in a discharge space, and a discharge electric power source.

In addition, atoms for controlling conductivity are preferably incorporated into the photoconductive layer in a non-uniform distribution state in the thickness direction of the photoconductive layer. This is effective in improving chargeability, reducing an optical memory, and increasing sensitivity because the travelling properties of carriers in the photoconductive layer are adjusted or secured to balance those properties in a high level.

In general, the content of the atoms for controlling conductivity, which is not particularly limited, is preferably 0.05 to 5 atm ppm. In addition, a range at which light arrives can be controlled to be substantially free of any atom for controlling conductivity (in other words, no active addition is performed).

The content of the atoms for controlling conductivity may include a region where the content changes continuously or stepwise in the thickness direction, or may include a region in which the content is constant in the thickness direction.

Atoms belonging to Group 13 in the periodic table (hereinafter also abbreviated as the Group 13 atom(s)) or atoms belonging to Group 15 in the periodic table (hereinafter also abbreviated as the Group 15 atom(s)) can be used as atoms for controlling conductivity.

Specific examples of the Group 13 atoms include boron (B), aluminum (Al), gallium (Ga), indium (In), and thallium (Tl). Of those, B, Al, and Ga are particularly suitable.

Specific examples of a raw material substance for introducing the Group 13 atoms include: raw material substances for introducing boron atoms including boron hydrides (such as $B_2H_6$, $B_4H_{10}$, $B_5H_9$, $B_5H_{11}$, $B_6H_{10}$, $B_6H_{12}$, and $B_6H_{14}$) and boron halides (such as $BF_3$, $BCl_3$, and $BBr_3$); $AlCl_3$; $GaCl_3$; $Ga(CH_3)_3$; $InCl_3$; and $TlCl_3$. Specific examples of the Group 15 atoms include nitrogen (N), phosphorus (P), arsenic (As), antimony (Sb), and bismuth (Bi). Of those, P, As, and Sb are particularly suitable.

Specific examples of a raw material substance for introducing the Group 15 atoms that can be effectively used include raw material substances for introducing phosphorus atoms including phosphorus hydrides (such as $PH_3$ and $P_2H_4$) and phosphorus halides (such as $PH_4I$, $PF_3$, $PF_5$, $PCl_5$, $PBr_3$, $PBr_5$, and $PI_3$). In addition, examples of an effective starting substance for introducing the Group 15 atoms include $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, and $BiBr_3$.

In addition, such raw material substance for introducing atoms for controlling conductivity may be diluted with $H_2$ and/or He as required before use.

The thickness of the photoconductive layer is appropriately determined as desired in terms of, for example, desired electrophotographic properties and an economic effect, and is in the range of preferably 5 to 50 μm, more preferably 10 to 45 μm, or still more preferably 20 to 40 μm.

When the thickness is equal to or larger than 5 μm, electrophotographic properties such as chargeability and sensitivity are practically sufficient. When the thickness dose not exceed 50 μm, a time period for producing the photoconductive layer does not lengthen and the production cost does not increase.

The mixing ratio between a gas (such as a gas for supplying Si or a gas for supplying halogen) and a diluent gas, gas pressure in a reaction vessel, discharge electric power, and substrate temperature are preferably set in an appropriate manner for forming a photoconductive layer having desired film properties.

The optimum range of the flow rate of at least one of $H_2$ and He to be used as diluent gases is appropriately selected in accordance with the layer design. In general, the flow rate of He is controlled to be preferably 3 to 30 times, more preferably 4 to 15 times, or still more preferably 5 to 10 times as large as that of the gas for supplying Si.

In general, the pressure in the reaction vessel whose optimum range is similarly appropriately selected in accordance with the layer design is in the range of preferably $1\times10^{-2}$ Pa to $1\times10^{3}$ Pa, more preferably $5\times10^{-2}$ Pa to $5\times10^{2}$ Pa, or still more preferably $1\times10^{-1}$ Pa to $2\times10^{2}$ Pa.

The discharge electric power is similarly appropriately selected from an optimum range in accordance with the layer design. A ratio of the discharge electric power to the flow rate of the gas for supplying Si is set to fall within the range of preferably 0.5 to 8, or more preferably 2 to 6.

Furthermore, the substrate temperature whose optimum range is appropriately selected in accordance with the layer design is in the range of preferably 200° C. to 350° C., more preferably 210° C. to 330° C., or still more preferably 220° C. to 300° C.

The above-described ranges are exemplified as preferable numerical ranges for the substrate temperature and the gas pressure for forming the photosensitive layer. However, in general, conditions are not determined independently or separately. Optimum values are preferably determined on the basis of mutual and organic relevance for forming a light-receiving member having desired properties.

<Lower Injection-blocking Layer>

As shown in each of FIGS. 1A to 1C, it is effective to arrange the lower injection-blocking layer 105 that serves to block the injection of charges from the side of the conductive substrate 101 as a layer on the substrate 101. The lower injection-blocking layer 105 has a function of blocking the injection of charges from the side of the substrate 101 to the side of the photoconductive layer 103 when the free surface of the photosensitive layer 102 is subjected to treatment to be charged in a certain polarity.

The lower injection-blocking layer 105 can be obtained by incorporating an element for controlling conductivity together with silicon atoms as a base material. The lower injection-blocking layer 105 preferably contains a relatively larger amount of the element for controlling conductivity than that of the photoconductive layer 103.

In the case of an electrophotographic photosensitive member for negative charging, a Group 13 element in the periodic table can be used as an impurity element to be incorporated into the lower injection-blocking layer 105. The content of the element for controlling conductivity to be incorporated into the lower injection-blocking layer 105 is appropriately determined as desired in such a manner that the object of the present invention can be effectively achieved. The content is in the range of preferably 10 atm ppm to 10,000 atm ppm, more preferably 50 atm ppm to 7,000 atm ppm, or still more preferably 100 atm ppm to 5,000 atm ppm, with respect to the total amount of the constituent atoms in the lower injection-blocking layer.

Furthermore, when incorporating carbon, nitrogen, and oxygen into the lower injection-blocking layer 105, the adhesiveness between the lower injection-blocking layer 105 and the substrate 101 can be improved. In addition, in the case of an electrophotographic photosensitive member for negative charging, an excellent lower injection-blocking ability can be imparted by optimally incorporating nitrogen and oxygen even when the lower injection-blocking layer 105 is free of any element for controlling conductivity.

Specifically, incorporating nitrogen and oxygen atoms into the entire region of the lower injection-blocking layer 105, lower injection-blocking ability can be improved. In this case, the total content of the nitrogen and oxygen atoms to be incorporated is in the range of preferably 0.1 atm % to 40 atm %, or more preferably 1.2 atm % to 20 atm % with respect to the total amount of the constituent atoms in the lower injection-blocking layer.

In addition, hydrogen atoms are preferably incorporated into the lower injection-blocking layer 105 in the present invention. In this case, the hydrogen atoms incorporated compensate for an unused bonding valences present in the layer to exhibit an effect of improving the quality of the layer. The content of hydrogen atoms to be incorporated into the lower injection-blocking layer 105 is in the range of preferably 1 atm % to 50 atm %, more preferably 5 atm % to 40 atm %, or still more preferably 10 atm % to 30 atm %, with respect to the total amount of the constituent atoms in the lower injection-blocking layer.

Furthermore, carbon atoms are preferably incorporated into the lower injection-blocking layer 105 in the present invention. In this case, the carbon atoms incorporated compensate for unused bonding valences present in the layer to exhibit an effect of improving the quality of the layer. The content of carbon atoms to be incorporated into the lower injection-blocking layer 105 is in the range of preferably 1 atm % to 50 atm %, more preferably 5 atm % to 40 atm %, or still more preferably 10 atm % to 30 atm %, with respect to the total amount of the constituent atoms in the lower injection-blocking layer.

The thickness of the lower injection-blocking layer 105 in the present invention is in the range of preferably 100 nm to 5,000 nm, more preferably 300 nm to 4,000 nm, or still more preferably 500 nm to 3,000 nm in terms of, for example, desired electrophotographic properties and an economic effect.

When the thickness is in the range of 100 nm to 5,000 nm (both inclusive), a sufficient ability to block the injection of charges from the substrate 101 can be obtained, so sufficient chargeability can be obtained. In addition, the improvements of electrophotographic properties can be expected, and no detrimental effects such as an increase in residual potential occur.

The gas pressure in a reaction vessel, discharge electric power, and a substrate temperature must be appropriately set for forming the lower injection-blocking layer 105. In general, the temperature of the conductive substrate (Ts) whose optimum range is appropriately selected in accordance with the layer design is in the range of preferably 150° C. to 350° C., more preferably 180° C. to 330° C., or still more preferably 200° C. to 300° C.

The pressure in the reaction vessel whose optimum range is similarly appropriately selected in accordance with the layer design is normally in the range of preferably $1\times10^{-2}$ Pa to $1\times10^{3}$ Pa, more preferably $5\times10^{-2}$ Pa to $5\times10^{2}$ Pa, or optimally $1\times10^{-1}$ Pa to $1\times10^{2}$ Pa.

<Apparatus for Producing Electrophotographic Photosensitive Member>

Next, an apparatus for producing the photosensitive layer 102 of the present invention and a method of forming the layer will be described in detail.

Figure 2:
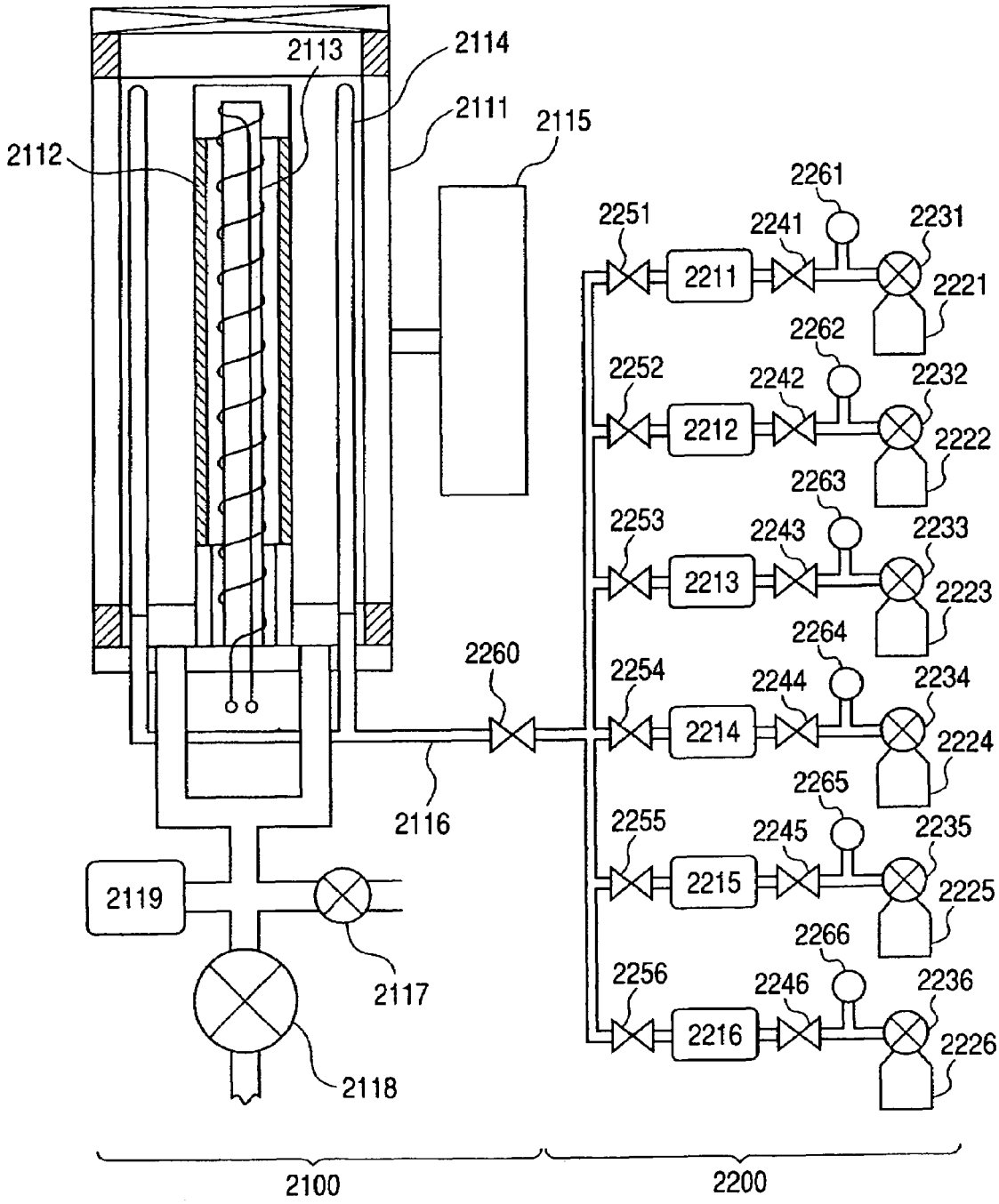
FIG. 2 is a view schematically showing an example of a suitable constitution of a plasma CVD deposition apparatus using a high-frequency wave in an RF band that can be used for producing the electrophotographic photosensitive member of the present invention.

FIG. 2 is a schematic block diagram showing an example of an apparatus for producing an electrophotographic photosensitive member according to a high-frequency plasma CVD method using an RF band as a power source frequency (hereinafter also abbreviated as the RF-PCVD). The constitution of the production apparatus shown in FIG. 2 is as follows.

The apparatus mainly includes a deposition device 2100, a raw material gas-supplying device 2200, and an exhaust device (not shown) for reducing a pressure in a reaction vessel 2111. A cylindrical substrate 2112, a heater 2113 for heating the substrate, and a raw material gas-introducing pipe 2114 are placed in the reaction vessel 2111 in the deposition device 2100. Furthermore, a high-frequency matching box 2115 is connected to the device.

The raw material gas-supplying device 2200 is composed of bombs 2221 to 2226 for raw material gases such as $SiH_4$, $GeH_4$, $H_2$, $CH_4$, $B_2H_6$, and $PH_3$, valves 2231 to 2236, 2241 to 2246, and 2251 to 2256, and massflow controllers 2211 to 2216. The bomb for each raw material gas is connected to the gas-introducing pipe 2114 in the reaction vessel 2111 via an auxiliary valve 2260.

A deposition film can be formed by means of the apparatus, for example, as follows.

At first, the cylindrical substrate 2112 is placed in the reaction vessel 2111. Then, the inside of the reaction vessel 2111 is evacuated by means of the exhaust device (not shown) (such as a vacuum pump). Subsequently, the temperature of the cylindrical substrate 2112 is controlled to be a predetermined temperature of 150° C. to 350° C. by means of the heater 2113 for heating the substrate.

Before a raw material gas for forming a deposition film is caused to flow in the reaction vessel 2111, the fact that the valves 2231 to 2236 of the gas bombs and a leak valve 2117 of the reaction vessel are closed and the fact that the gas inflow valves 2241 to 2246, the gas outflow valves 2251 to 2256, and the auxiliary valve 2260 are opened are confirmed. Then, a main valve 2118 is opened so that the inside of each of the reaction vessel 2111 and a raw material gas pipe 2116 is exhausted.

Next, the auxiliary valve 2260 and the gas outflow valves 2251 to 2256 are closed when about 0.1 Pa or less is read on a vacuum gauge 2119. After that, the respective gases are introduced from the gas bombs 2221 to 2226 by opening the vales 2231 to 2236 of the raw material gas bombs, and then the pressure of each gas is adjusted to 0.2 MPa by means of each of pressure regulators 2261 to 2266. Next, the gas inflow valves 2241 to 2246 are gradually opened so that the respective gases are introduced into the massflow controllers 2211 to 2216.

After completing preparation for film formation, each layer is formed through the following procedures.

When the temperature of the cylindrical substrate 2112 reaches a predetermined temperature, one or more necessary valves among the outflow valves 2251 to 2256 and the auxiliary valve 2260 are gradually opened. Then, predetermined gases are introduced from the gas bombs 2221 to 2226 into the reaction vessel 2111 via the raw material gas-introducing pipe 2114. Next, each of the massflow controllers 2211 to 2216 is used to adjust the flow rate of each raw material gas to a predetermined flow rate. In that case, the opening of the main valve 2118 is adjusted while looking at the vacuum gauge 2119 so that the pressure in the reaction vessel 2111 becomes a predetermined pressure of $1\times10^2$ Pa or less. After the internal pressure has been stabilized, the electric power of an RF power source having a frequency of 13.56 MHz (not shown) is set to be predetermined electric power, and the RF electric power is introduced into the reaction vessel 2111 through the high-frequency matching box to bring about glow discharge. A raw material gas introduced into the reaction vessel is decomposed by the discharge energy, whereby a deposition film mainly composed of predetermined silicon is formed on the cylindrical substrate 2112. After a film having a desired thickness has been formed, the supply of the RF electric power is stopped, and the one or more opened outflow valves are closed to stop the flow of a gas into the reaction vessel. Thus, the formation of the deposition film is completed.

A similar operation is repeated multiple times, whereby a light-receiving layer having a desired multilayer structure is formed. It is needless to say that all the outflow valves for gases except a necessary gas must be closed in the formation of each layer. In addition, an operation is performed involving: closing the outflow valves 2251 to 2256; opening the auxiliary valve 2260; and fully opening the main valve 2118 so that the inside of the system is exhausted to a high vacuum once as required for preventing each gas from remaining in the reaction vessel 2111 or in the pipe communicating the outflow valves 2251 to 2256 to the reaction vessel 2111.

During layer formation, rotating the cylindrical substrate 2112 at a predetermined speed by means of a driving device (not shown) is also effective in uniformizing film formation.

Furthermore, it is needless to say that the above-described kinds of gas and valve operations are changed in accordance with conditions under which each layer is formed.

A means for heating the substrate is required to be used in vacuum. More specific examples of the heating element include: an electrical resistance heating element such as a winding heater of a sheath-like heater, a plate-like heater, or a ceramic heater; a heat radiation lamp heating element such as a halogen lamp or an infrared lamp; and a heating element on the basis of heat exchange means using a liquid, a gas, or the like as a heating medium. A metal (such as stainless steel, nickel, aluminum, or copper), a ceramic, or a heat-resistant polymer resin, or the like can be used as a material for the surface of the heating means.

In addition to the foregoing, a method is employed involving: positioning a vessel for heating in addition to the reaction vessel; heating the substrate; and conveying the substrate into the reaction vessel in vacuum.

<Electrophotographic Device>

Figure 3:
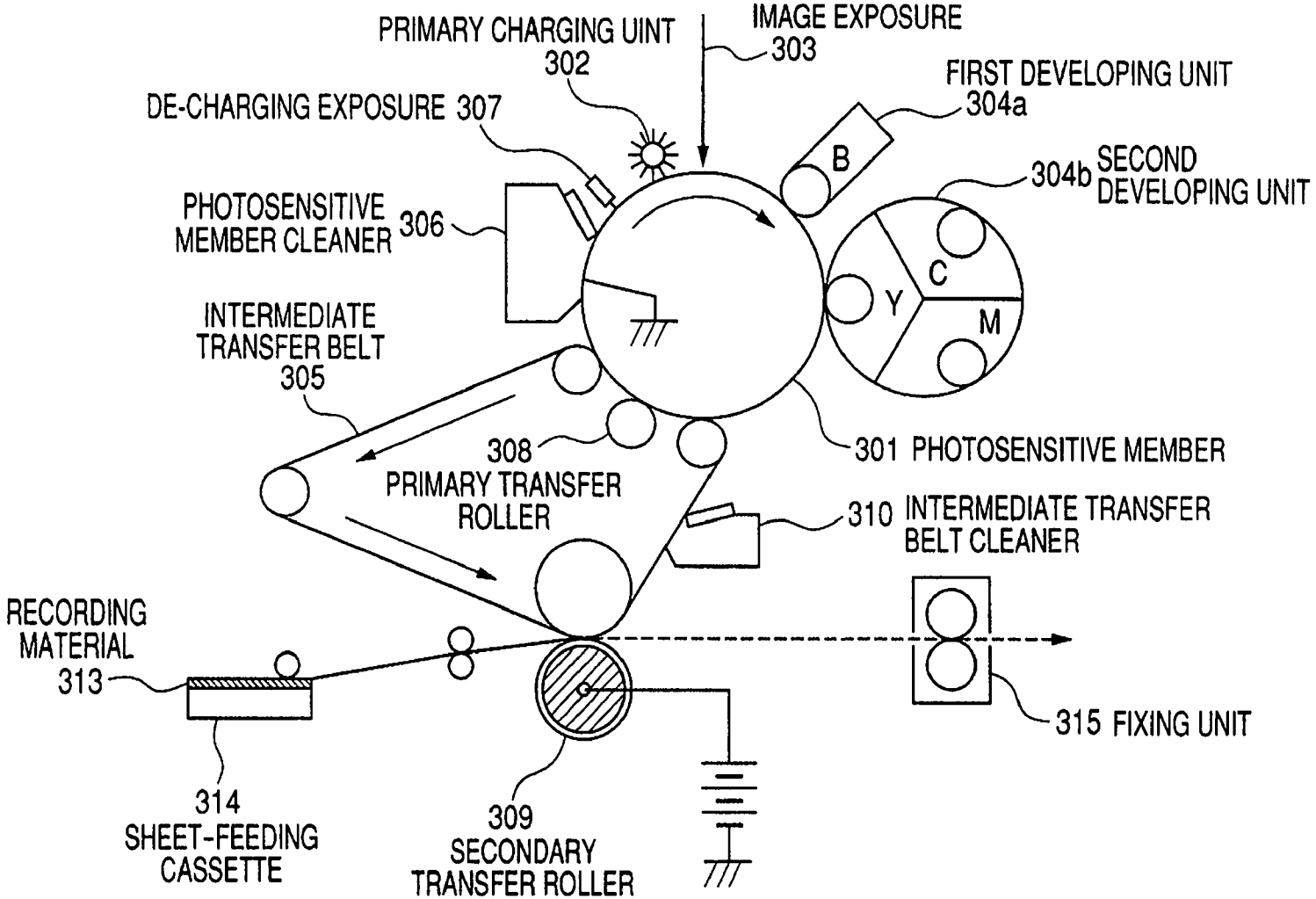
FIG. 3 is a schematic view showing an example of the constitution of a color electrophotographic device in the present invention.

FIG. 3 is a schematic view of a color image forming apparatus (a copying machine or a laser beam printer) utilizing an electrophotographic process in which an intermediate transfer belt 305 composed of a film-like dielectric belt is used to perform transfer.

In the image forming apparatus, a first image-bearing member is constituted by a photosensitive drum 301 composed of a rotating drum-type electrophotographic photosensitive member to be repeatedly used. An electrostatic latent image is formed on the surface of the first image-bearing member, and toner adheres to the electrostatic latent image to form a toner image.

A primary charging unit 302 for uniformly charging the surface of the photosensitive drum 301 to a predetermined electric potential with a predetermined polarity and an image exposing device (not shown) for performing image exposure 303 on the surface of the charged photosensitive drum 301 to form an electrostatic latent image are arranged around the photosensitive drum 301. Furthermore, a first developing unit **304*a* for adhering black toner (B) the formed electrostatic latent image, and a second developing unit 304*b* of a rotating type including a developing unit for adhering yellow toner (Y), a developing unit for adhering magenta toner (M), and a developing unit for adhering cyan toner (C) are arranged as developing units for adhering toner to the formed electrostatic latent image for development. Furthermore, a photosensitive member cleaner 306 for cleaning the photosensitive drum 301 after a toner image has been transferred onto the intermediate transfer belt 305 and a de-charging exposure 307 for removing charges from the photosensitive drum 301** are arranged.

The intermediate transfer belt 305 is positioned to be driven through a nip portion in contact with the photosensitive drum 301, and a primary transfer roller 308 for transferring the toner image formed on the photosensitive drum 301 onto the intermediate transfer belt 305 is positioned inside the belt. A bias power source (not shown) for applying a primary transfer bias for transferring the toner image on the photosensitive drum 301 onto the intermediate transfer belt 305 is connected to the primary transfer roller 308. A secondary transfer roller 309 for transferring the toner image transferred on the intermediate transfer belt 305 onto a recording material 313 is positioned around the intermediate transfer belt 305 to be brought into contact with the lower surface portion of the intermediate transfer belt 305.

A bias power source for applying a secondary transfer bias for transferring the toner image on the intermediate transfer belt 305 onto the recording material 313 is connected to the secondary transfer roller 309. In addition, an intermediate transfer belt cleaner 310 for cleaning transfer residual toner remaining on the surface of the intermediate transfer belt 305 after the toner image on the intermediate transfer belt 305 has been transferred onto the recording material 313 is positioned.

The image forming apparatus is additionally provided with a sheet-feeding cassette 314 for holding multiple recording materials 313 on each of which an image is to be formed and a conveying mechanism for conveying each of the recording materials 313 from the sheet-feeding cassette 314 through a nip portion where the intermediate transfer belt 305 and the secondary transfer roller 309 are brought into contact with each other. A fixing unit 315 for fixing the toner image transferred onto each of the recording materials 313 to the recording material 313 is arranged on a path along which the recording material 313 is conveyed.

A charging unit of a magnetic brush system or the like is used as the primary charging unit 302. A color separation/imaging exposure optical system for a original color image, a scanning exposure system by means of a laser scanner that outputs a laser beam modulated in accordance with a time-series electrical digital pixel signal of image information, or the like is used as the image exposing device.

Next, the operation of the image forming apparatus will be described.

At first, as shown by an arrow in FIG. 3, the photosensitive drum 301 is rotated clockwise at a predetermined peripheral speed (process speed), and the intermediate transfer belt 305 is rotated counterclockwise at the same peripheral speed as that of the photosensitive drum 301.

In the course of the rotation of the photosensitive drum 301, the drum is uniformly charged by the primary charging unit 302 to a predetermined electric potential with a predetermined polarity, and is then subjected to the image exposure 303. As a result, an electrostatic latent image corresponding to a first color component image (for example, a magenta component image) of a target color image is formed on the surface of the photosensitive drum 301. Next, the second developing unit rotates so that the developing unit for adhering magenta toner (M) to the electrostatic latent image is set at a predetermined position. As a result, the electrostatic latent image is developed with the magenta toner (M) as a first color. In this case, the first developing unit 304*a* does not operate. As a result, the unit does not act on the photosensitive drum 301, and there is no influence on the magenta toner image as the first color.

In the course of passing through the nip portion between the photosensitive drum 301 and the intermediate transfer belt 305, the magenta toner image as the first color thus formed and carried on the photosensitive drum 301 is sequentially intermediately transferred onto the outer peripheral surface of the intermediate transfer belt 305 by an electric field formed by the application of the primary transfer bias from the bias power source (not shown) to the primary transfer roller 308.

The surface of the photosensitive drum 301 that has already transferred the magenta toner image as the first color onto the intermediate transfer belt 305 is cleaned by the photosensitive member cleaner 306. Next, a toner image as a second color (for example, a cyan toner image) is formed on the cleaned surface of the photosensitive drum 301 in the same manner as in the toner image as the first color. The toner image as the second color is superimposed and transferred onto the surface of the intermediate transfer belt 305 onto which the toner image as the first color has been transferred. Hereinafter, a toner image as a third color (for example, a yellow toner image) and a toner image as a fourth color (for example, a black toner image) are sequentially superimposed and transferred onto the intermediate transfer belt 305 in a similar manner, so that a composite color toner image corresponding to the target color image is formed.

Next, each of the recording materials 313 is fed from the sheet-feeding cassette 314 to the nip portion where the intermediate transfer belt 305 and the secondary transfer roller 309 come in contact with each other at a predetermined timing. The secondary transfer roller 309 is brought into contact with the intermediate transfer belt 305, and the secondary transfer bias is applied from the bias power source to the secondary transfer roller 309. Thus, the composite color toner image superimposed and transferred onto the intermediate transfer belt 305 is transferred onto the recording material 313 as a second image-bearing member. After the completion of the transfer of the toner image onto the recording material 313, the transfer residual toner on the intermediate transfer belt 305 is cleaned by the intermediate transfer belt cleaner 310. The recording material 313 onto which the toner image has been transferred is introduced to the fixing unit 315 where the toner image is fixed to the recording material 313 by heating.

During the operation of the image forming apparatus, the secondary transfer roller 309 and the intermediate transfer belt cleaner 310 may be separated from the intermediate transfer belt 305 at the time of sequentially transferring the toner images as the first to fourth colors from the photosensitive member 301 onto the intermediate transfer belt 305.

Such color image forming apparatus according to electrophotography using an intermediate transfer belt has the following characteristics.

A first characteristic is such that color shift in which the positions at which toner images of respective colors are formed shift from each other in superimposition is reduced. In addition, as shown in FIG. 3, a toner image can be transferred from the intermediate transfer belt 305 without processing or controlling the recording material 313 (for example, holding the material by a gripper, adsorbing the material, or providing the material with curvature). As a result, any one of various recording materials can be used as the recording material 313. For example, a recording material selected from recording materials having various thicknesses ranging from thin paper (40 g/m$^2$ paper) to thick paper (200 g/m$^2$ paper) can be used as the recording material 313. In addition, any one of recording materials having various sizes can be used as the recording material 313 irrespective of a width or a length. Furthermore, an envelope, a postcard, label paper, or the like can be used as the recording material 313.

In addition, the intermediate transfer belt 305 is excellent in flexibility, hence the nip between the belt and the photosensitive drum 301 or the recording material 313 can be freely set. Therefore, the intermediate transfer belt 305 is characterized in that it has a high degree of freedom in design and its transfer efficiency or the like can be easily optimized.

As described above, an image forming apparatus using the intermediate transfer belt 305 has various advantages.

Hereinafter, the present invention will be described in more detail by way of examples. However, the present invention is by no means limited to these examples.

EXAMPLE 1

A plasma CVD apparatus shown in FIG. 2 was used to sequentially superimpose deposition films under the conditions shown in Table 1 on an aluminum cylinder (support), which had a diameter of 84 mm and a length of 381 mm and was subjected to mirror finish, to thereby produce a photosensitive member composed of a top injection-blocking layer and a surface layer. All lower injection-blocking layers and photoconductive layers were produced under the conditions shown in Table 1 as common conditions. Surface layers were produced under the conditions shown in Table 2 for the flow rate of an $SiH_4$ gas, the mixing ratio between $SiH_4$ and $N_2$ and electric energy per amount of an $SiH_4$ gas, and under the conditions shown in Table 1 for the others. Thus, photosensitive members A to H different from each other in nitrogen atom concentration in a surface layer were produced.

The photosensitive members A to H thus produced were evaluated as follows.

Each photosensitive member was set in an image forming apparatus of an electrophotographic system (a machine obtained by remodeling an electrophotographic device iRC6800 manufactured by Canon Inc. for the experiment, in which the charging unit was modified into a magnetic brush system, the charge polarity was made to be changeable, the image exposure system was modified into an IAE system, the light source for image exposure was modified into a blue light-emitting semiconductor laser having an oscillation wavelength of 405 nm, and the optical system for image exposure was so modified that the drum surface irradiation spot diameter would be adjustable (hereinafter referred to as the iRC6800-405 nm remodeled machine)), and evaluation was made on the following evaluation items concerning the electrophotographic properties. Table 2 shows the measurement results.

(1) Actual Nitrogen Atom Concentration in Surface Layer

About 20 nm of the outermost surface were removed. Thus, the part of the outermost surface affected by the environment was removed. After that, analysis was made by means of secondary-ion mass spectrometry (SIMS) [IMS-4F, manufactured by CAMECA].

(2) Surface Layer Thickness

Thicknesses at 60 points (10 points in the peripheral direction at each of 6 positions in the axial direction) were measured by means of an interference thickness meter (MCPD-2000, manufactured by Otsuka Electronics Co., Ltd.), and the value obtained by dividing the value of (maximum value−minimum value) by an average thickness was represented as thickness unevenness (unit: %).

As the thickness unevenness exceeded 30%, hardness unevenness and resistance unevenness also increased. However, such increases raised no problems in practical use. The thickness unevenness in excess of 40% is not preferable because hardness unevenness and resistance unevenness are large and a phenomenon occurs in which a photosensitive member is partially abraded in the form of stripes owing to continuous.

(3) Property of Transmitting Light Having a Wavelength of 405 nm

Each of the produced photosensitive members A to H was evaluated for the property of transmitting light having a wavelength of 405 nm on the basis of spectral sensitivity with respect to light having a wavelength of 405 nm. That is, the spectral sensitivity characteristics of the produced photosensitive members A to H were measured, and each photosensitive member was evaluated for the property of transmitting light having a wavelength of 405 nm by means of a value obtained by normalizing spectral sensitivity with respect to light having a wavelength of 405 nm on the basis of spectral sensitivity at the wavelength at which the spectral sensitivity became maximum (a peak value of the spectral sensitivity).

Figure 6:
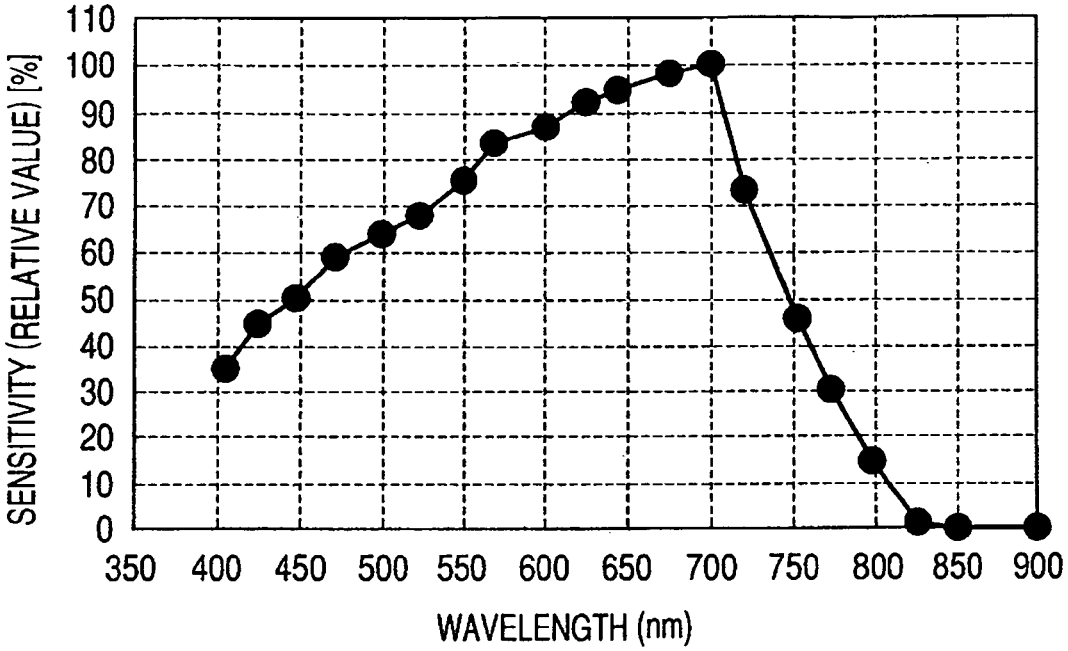
FIG. 6 is a graph showing an example of the measurement result of spectral sensitivity characteristics of an electrophotographic photosensitive member.
Figure 7:
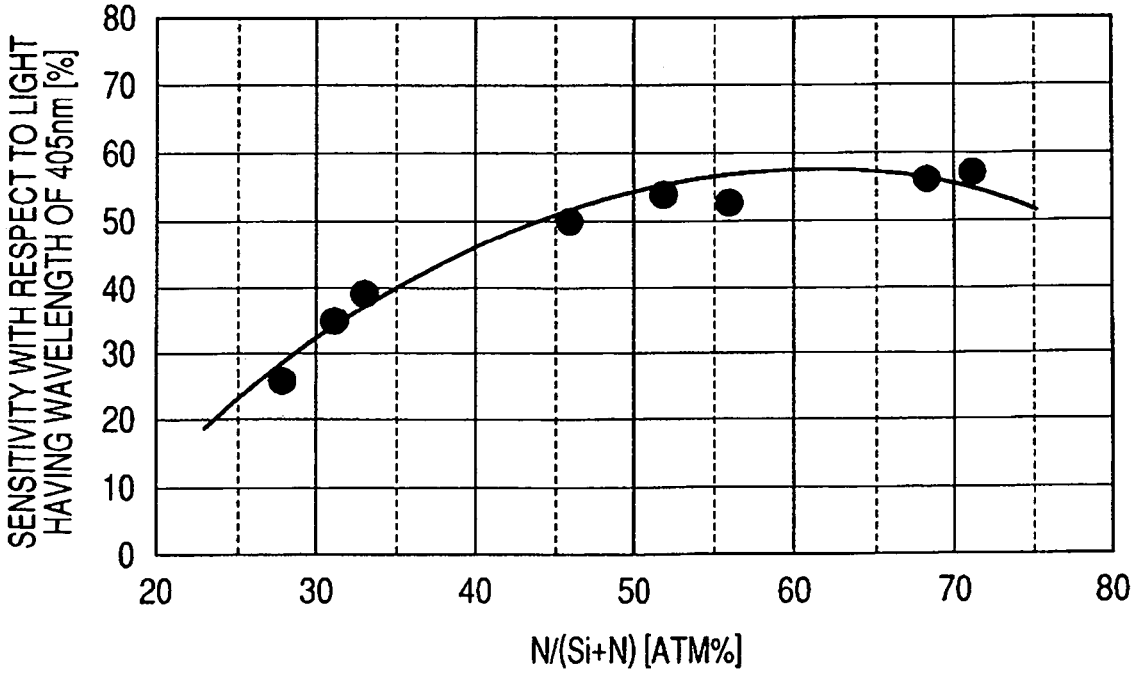
FIG. 7 is a graph showing measurements of the correlation between a nitrogen atom concentration in the surface layer of an electrophotographic photosensitive member produced in Example 1 and a sensitivity with respect to light having a wavelength of 405 nm.

The term "spectral sensitivity" used herein refers to the attenuated amount of a surface potential per unit light quantity (unit area) (unit: $V \cdot cm^2/\mu J$) when the surface of a photosensitive member is charged to a certain potential, for example, 450 V, and then irradiated with light beams having various wavelengths. The attenuated amount of a surface potential was measured by a method according to the method by Kajita et al. (Academic Journal of Electrophotography, vol. 22, first edition, 1983). Briefly, a transparent electrode such as an ITO electrode is brought into close contact with the surface of a photosensitive member for reproducing behavior in a copying machine, and exposure and the application of a voltage are performed in imitation of a sequence in the copying machine, thereby measuring a change in potential of the surface. When the potential of the surface is measured, an electric potential is preferably applied to the photosensitive member, which is regarded as a capacitor, connected to a known capacity in series because information about the chargeability of the photosensitive member can be acquired. The method by Kajita et al. involves sandwiching a transparent insulating film between a photosensitive member and an ITO electrode. Devising an electrical circuit, a fixed capacitor may be used. Specifically, the surface is irradiated with de-charging light (for example, 50 $mW/cm^2$) for a certain time period (for example, 0.1 sec), and is then left for a certain time period (for example, 0.01 sec). After that, a voltage is applied (for about 20 msec, for example) to charge the surface. The electric potential of the surface of a conductor connected to the ITO electrode is measured by means of a potentiometer a certain time period (about 0.1 to 0.5 sec, for example, 0.25 sec) after the application of a voltage has been stopped. This time period corresponds to the timing at which the portion of the photosensitive member to which an electric potential is applied reaches a developing unit in a copying machine, and the electric potential corresponds to an electric potential at the position of the developing unit. Next, in the same sequence, exposure is performed by means of light beams having various wavelengths between the application of a voltage and the measurement of an electric potential (for example, 0.1 sec after the application of a voltage). Similarly, an electric potential at the timing corresponding to the position of the developing unit is measured, and the difference between an electric potential in the case where light is applied and an electric potential in the case where light is not applied is calculated. This calculation corresponds to the measurement of the attenuated amount of an electric potential due to exposure light at the position of the developing unit. The sensitivity of a photosensitive member as described above varies depending on a wavelength. FIG. 6 is a graph with wavelength as abscissa and spectral sensitivity as ordinate, in which spectral sensitivity is plotted as a value normalized on the basis of spectral sensitivity at a wavelength at which spectral sensitivity becomes maximum. Furthermore, FIG. 7 shows a graph in which spectral sensitivity with respect to light having a wavelength of 405 nm is plotted against a nitrogen atom concentration in a surface layer. As can be seen from FIG. 7, there is the clear correlation between the nitrogen atom concentration and the spectral sensitivity with respect to light having a wavelength of 405 nm. It can be found that the spectral sensitivity with respect to light having a wavelength of 405 nm generally tends to increase as the nitrogen atom concentration increases.

The value of sensitivity required in an electrophotographic process depends on the performance of a laser device or optical system to be used. Therefore, it is difficult to generally refer to the absolute value of the sensitivity. Here, the photosensitive member B was placed in an image forming apparatus for evaluation, and a charging unit was so adjusted that a surface potential at the position of a developing unit would be −450 V (dark potential). After that, image exposure having a wavelength of 405 nm was applied, and the light quantity of an image exposure light source was so adjusted that the surface potential would be −100 V (light potential). An exposure value in this case was defined as a reference exposure value. Any other photosensitive members were similarly placed in an image forming apparatus for evaluation, and a sensitivity was judged to be insufficient when an electric potential at the time of applying image exposure having a wavelength 405 nm at the reference exposure value was not −100 V or less.

Thus, as a result of various studies on the sensitivity made by the inventors of the present invention, it has been found that a photosensitive member preferably has a sensitivity of 30% or more (more preferably 40% or more) as an index normalized on the basis of the peak value of the spectral sensitivity as shown in FIG. 6.

Accordingly, it has been revealed that if the nitrogen atom concentration in the surface layer of a photosensitive member having such sensitivity is set to be preferably 30 atm % or more, or more preferably 35 atm % or more, an additional effect is exhibited such that the photosensitive member is provided with sensitivity with respect to laser light having a wavelength as short as about 405 nm such as blue light-emitting semiconductor laser light.

On the other hand, as is apparent from Table 2, the photosensitive member G has large thickness unevenness, and it has been found to be desirable that the nitrogen concentration in a surface layer is not too high. From such a viewpoint, the nitrogen atom concentration in a surface layer has been found to be preferably 70 atm % or less, or more preferably 60 atm % or less.

TABLE 1

| | | | Surface region layer | |
|---|---|---|---|---|
| Kind and flow rate of gas | Lower injection-blocking layer | Photoconductive layer | Top injection-blocking layer | Surface layer |
| $SiH_4$ [mL/min (normal)] | 150 | 200 | 50 | 10 to 50 |
| $H_2$ [mL/min (normal)] | 600 | 1200 | | |
| $B_2H_6$ [ppm (with respect to $SiH_4$)] | | | 500→2000 →500 | 500→1600 →500 |
| NO [% (with respect to $SiH_4$)] | 8 | | | |
| $N_2$ [mL/min (normal)] | | | 500 | 20 to 1000 |
| $CH_4$ [mL/min (normal)] | 600 | | | 2 |
| Support temperature [° C.] | 270 | 260 | 220 | 220 |
| Pressure [Pa] | 75 | 78 | 52 | 50 |
| RF power [W] | 150 | 500 | 250 | 150 to 300 |
| Thickness [μm] | 2 | 30 | 0.1 | 0.6 |

TABLE 2

| Photosensitive member | $SiH_4$ mL/min (normal) | $N_2$ mL/min (normal) | Power W | N/(Si + N) atm % | Sensitivity with respect to light having a wavelength of 405 nm (%) | Thickness unevenness of surface layer (%) | Local maximum value of B on photoconductive layer side atoms/cm$^3$ | Local maximum value of B on surface side atoms/cm$^3$ |
|---|---|---|---|---|---|---|---|---|
| A | 50 | 300 | 300 | 28 | 25 | 11 | $5.4 \times 10^{18}$ | $2.4 \times 10^{18}$ |
| B | 50 | 500 | 250 | 36 | 41 | 10 | $5.4 \times 10^{18}$ | $2.1 \times 10^{18}$ |
| C | 50 | 1000 | 250 | 52 | 55 | 9 | $5.4 \times 10^{18}$ | $1.9 \times 10^{18}$ |
| D | 25 | 250 | 200 | 46 | 49 | 10 | $5.4 \times 10^{18}$ | $2.2 \times 10^{18}$ |
| E | 25 | 500 | 200 | 59 | 56 | 12 | $5.4 \times 10^{18}$ | $1.9 \times 10^{18}$ |

TABLE 2-continued

| Photosensitive member | $SiH_4$ mL/min (normal) | $N_2$ mL/min (normal) | Power W | N/(Si + N) atm % | Sensitivity with respect to light having a wavelength of 405 nm (%) | Thickness unevenness of surface layer (%) | Local maximum value of B on photoconductive layer side atoms/cm$^3$ | Local maximum value of B on surface side atoms/cm$^3$ |
|---|---|---|---|---|---|---|---|---|
| F | 10 | 100 | 200 | 70 | 59 | 31 | $5.4 \times 10^{18}$ | $2.7 \times 10^{18}$ |
| G | 10 | 500 | 200 | 72 | 60 | 42 | $5.4 \times 10^{18}$ | $2.4 \times 10^{18}$ |
| H | 10 | 20 | 150 | 30 | 32 | 10 | $5.4 \times 10^{18}$ | $3.1 \times 10^{18}$ |

EXAMPLE 2

A plasma CVD apparatus shown in FIG. 2 was used to sequentially superimpose deposition films composed of a lower injection-blocking layer, a photoconductive layer, a top injection-blocking layer, and a surface layer under the conditions shown in Table 3 on an aluminum cylinder (support), which had a diameter of 84 mm and a length of 381 mm and was subjected to mirror finish, to thereby produce a photosensitive member. All lower injection-blocking layers and photoconductive layers were produced under the conditions shown in Table 1 as common conditions. Surface layers were produced with the flow rate of a $CH_4$ gas changed variously as shown in Table 4. Thus, photosensitive members 2A to 2H different from each other in carbon atom concentration in a surface layer were produced.

Each of the photosensitive members 2A to 2H thus produced was evaluated for the following items in addition to (1) a nitrogen atom concentration and (3) the property of transmitting light having a wavelength of 405 nm in the same manner as in Example 1.

(4) Actual Carbon Atom Concentration in Surface Layer

About 20 nm of an outermost surface was removed. Thus, the part of the outermost surface affected by the environment was removed. After that, the remainder was analyzed by means of secondary-ion mass spectrometry (SIMS) [manufactured by CAMECA: IMS-4F].

(5) Residual Potential

A charging unit was so adjusted that a surface potential at the position of a developing unit would be −450 V (dark potential). After that, each of the produced electrophotographic photosensitive members was irradiated with image exposure with the light quantity of an image exposure light source adjusted to be maximum. Then, the surface potential of the electrophotographic photosensitive member was measured by means of a surface potentiometer placed at the position of the developing unit, and was defined as a residual potential. The evaluation was performed by ranking the electrophotographic photosensitive members on the basis of the following judgement criteria with the photosensitive member 2A as a reference.

A: An extremely good level at which a residual potential reduces by 10% or more as compared with the reference.

B: A good level at which a residual potential reduces by 5% or more as compared with the reference.

C: A level at which a residual potential is comparable to the reference.

(6) Electric Potential Unevenness

The in-plane distribution of the dark potential and light potential of each of the produced electrophotographic photosensitive members were measured in a state in which a charging unit was so adjusted that a dark potential at the position of a developing unit was −450 V and the light quantity of an image exposure light source was so adjusted that a light potential at the position of the developing unit was −100 V. Then, the difference between the maximum value and the minimum value was defined as electric potential unevenness. The evaluation was performed by ranking the electrophotographic photosensitive members on the basis of the following judgement criteria with the photosensitive member 2A as a reference.

A: An extremely good level at which electric potential unevenness reduces by 10% or more as compared with the reference.

B: A good level at which electric potential unevenness reduces by 5% or more as compared with the reference.

C: A level at which electric potential unevenness is comparable to the reference.

Table 4 shows the evaluation results.

As can be seen from the evaluation results, when incorporating a trace amount of carbon atoms, properties in connection with a residual potential and electric potential unevenness can be improved.

TABLE 3

| Kind and flow rate of gas | Lower injection-blocking layer | Photo-conductive layer | Surface region layer: Top injection-blocking layer | Surface region layer: Surface layer |
|---|---|---|---|---|
| $SiH_4$ [mL/min (normal)] | 150 | 200 | 50 | 50 |
| $H_2$ [mL/min (normal)] | 600 | 1200 | | |
| $B_2H_6$ [ppm (with respect to $SiH_4$)] | | | 500→2000 →500 | 500→1500 →500 |
| NO [mL/min (normal)] | 8 | | | |
| $N_2$ [mL/min (normal)] | | | 500 | 500 |
| $CH_4$ [mL/min (normal)] | 600 | | | (*) |
| Support temperature [° C.] | 270 | 260 | 220 | 220 |
| Pressure [Pa] | 75 | 78 | 52 | 50 |
| RF power [W] | 150 | 500 | 250 | 250 |
| Thickness [μm] | 2 | 30 | 0.1 | 0.6 |

(*): See table 4.

TABLE 4

| Photosensitive member | $CH_4$ mL/min (normal) | N/(Si + N) atm % | C atoms/cm$^3$ | Sensitivity with respect to light having a wavelength of 405 nm (%) | Residual potential | Electric potential unevenness | Local maximum value of B on photoconductive layer side atoms/cm$^3$ | Local maximum value of B on surface side atoms/cm$^3$ |
|---|---|---|---|---|---|---|---|---|
| 2A | 0.1 | 33 | $9.0 \times 10^{16(**)}$ | 39 | C | C | $5.5 \times 10^{18}$ | $1.4 \times 10^{18}$ |
| 2B | 1 | 33 | $1.7 \times 10^{17}$ | 39 | C | C | $5.5 \times 10^{18}$ | $1.4 \times 10^{18}$ |
| 2C | 2 | 33 | $2.0 \times 10^{17}$ | 39 | B | B | $5.5 \times 10^{18}$ | $1.4 \times 10^{18}$ |
| 2D | 5 | 33 | $5.8 \times 10^{18}$ | 39 | B | B | $5.5 \times 10^{18}$ | $1.4 \times 10^{18}$ |
| 2E | 10 | 33 | $7.2 \times 10^{19}$ | 39 | B | B | $5.5 \times 10^{18}$ | $1.3 \times 10^{18}$ |
| 2F | 25 | 33 | $1.4 \times 10^{20}$ | 39 | B | B | $5.5 \times 10^{18}$ | $1.3 \times 10^{18}$ |
| 2G | 100 | 32 | $5.0 \times 10^{20}$ | 37 | B | B | $5.5 \times 10^{18}$ | $1.2 \times 10^{18}$ |
| 2H | 120 | 31 | $5.4 \times 10^{20}$ | 34 | B | C | $5.5 \times 10^{18}$ | $1.2 \times 10^{18}$ |

The measured value represented by (**) is probably a measurement limit.

EXAMPLE 3

A plasma CVD apparatus shown in FIG. 2 was used to sequentially superimpose deposition films composed of a lower injection-blocking layer, a photoconductive layer, and a surface region layer under the conditions shown in Table 5 on an aluminum cylinder (support), which had a diameter of 84 mm and a length of 381 mm and was subjected to mirror finish, to thereby produce a photosensitive member.

In this case, each of a carbon atom concentration and a boron atom concentration (boron is a Group 13 element in the periodic table) was caused to have a local maximum value by changing the amount of each of a $CH^4$ gas and a $B_2H_6$ gas to be introduced during the formation of a surface region layer. A method of introducing a gas for forming a local maximum value in a surface region layer shown in Table 3 involved: increasing the amount of each of the $CH_4$ gas and the $B_2H_6$ gas from a certain value in a linear fashion over a predetermined time period as shown in Table 5 when forming the change layer and the surface layer; reducing the amount to the initial certain value in a linear fashion again at the same rate as the rate at which the amount was increased; and changing the amount of each of an NO gas and an $SiF_4$ gas to be introduced to provide a local maximum value.

Figure 10:
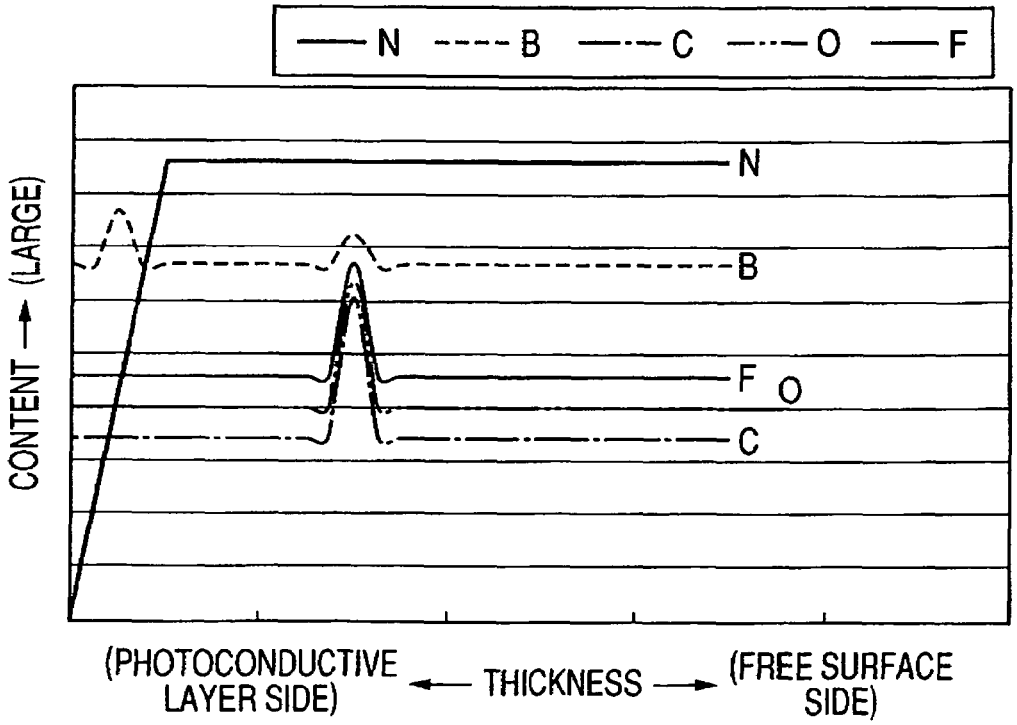
FIG. 10 shows a depth profile of a surface region layer of Example 3 in the present invention.

In this way, SIMS measurement confirmed that the content of each of a carbon atom and a boron atom showed such distribution having local maximum values as shown in FIG. 10.

The local maximum value of the carbon atom content was $1.0\times10^{20}$ atoms/cm$^3$, and the local maximum values of the boron atom content were $2.1\times10^{18}$ atoms/cm$^3$ and $6.5\times10^{18}$ atoms/cm$^3$ from the photoconductive layer side. The interval between the local maximum values of the boron atom content was 250 nm.

In addition, the amount of nitrogen in the surface layer represented by N/(Si+N) was 43 atm %.

TABLE 5

| Kind and flow rate of gas | Lower injection-blocking layer | Photoconductive layer | Surface region layer: Change layer | Surface region layer: Surface layer |
|---|---|---|---|---|
| $SiH_4$ [mL/min(normal)] | 170 | 170 | 170→30 | 30 |
| $H_2$ [mL/min(normal)] | 600 | 1000 | | |
| $B_2H_6$ [ppm (with respect to $SiH_4$)] | | | 500→3000 →500 | 500→1500 →500 |
| $N_2$ [mL/min(normal)] | | | 0→300 | 300 |
| $CH_4$ [mL/min(normal)] | 300 | | 5 | 5→18→5 |
| NO [mL/min(normal)] | 5 | | 2 | 2→5→2 |
| $SiF_4$ [mL/min(normal)] | | | 8 | 8→20→8 |
| Support temperature [° C.] | 270 | 260 | 220 | 220 |
| Pressure [Pa] | 80 | 75 | 60 | 56 |
| RF power [W] | 200 | 400 | 180 | 180 |
| Thickness [μm] | 2.5 | 30 | 0.1 | 0.6 |

The resultant photosensitive member was set in an image forming apparatus of an electrophotographic system (a machine obtained by remodeling an electrophotographic device iRC6800 manufactured by Canon Inc. for the experiment, in which a charging unit was modified into a magnetic brush system, the charge polarity was made to be changeable, an image exposure system was modified into an IAE system, a light source for image exposure was modified into a blue light-emitting semiconductor laser having an oscillation wavelength of 405 nm, and an optical system for image exposure was so modified that a drum surface irradiation spot diameter would be adjustable), and the following evaluation was made. Table 8 shows the evaluation results together with Comparative Example 1 and Example 4 described later.

(1) Resolution

A test chart in which alphabets (A to Z) and complicated Chinese characters (such as "Den" (meaning "electricity" in Japanese) and "Kyo" (meaning "surprise" in Japanese)) each having a two-point size or a three-point size were arranged at a resolution of 1,200 dpi was created by means of a personal computer. A photosensitive member was evaluated for resolution by means of an image obtained by printing out the test chart. Specifically, the outputted image was read by means of a scanner (CanoScan 9900F manufactured by Canon Inc.) at a resolution of 1,600 dpi. Then, the read image data and the original data on the test chart were compared with each other in order to calculate the area of misalignment portions (a thick portion or a thin portion) from the character on the test original. The photosensitive member was evaluated for resolution on the basis of the calculated value. The evaluation was performed by ranking the electrophotographic photosensitive members through relative evaluation where the value for a photosensitive member having such a layer constitution as shown in Comparative Example 1 described later was regarded as a reference (100%).

A: An extremely good level at which a value is less than 80% of the reference.

B: A good level at which a value is 80% or more and less than 95% of the reference.

C: A level at which a value is comparable to the reference.

(2) Chargeability

Each of the produced electrophotographic photosensitive members was placed in an electrophotographic device to be charged. The dark surface potential of the electrophotographic photosensitive member was measured by means of a surface potentiometer placed at the position of a developing unit, and was defined as chargeability. In this case, charging conditions (such as a DC voltage to be applied to a charging unit, a superimposed AC amplitude, and a frequency) were kept constant for comparison. The evaluation was performed by ranking the electrophotographic photosensitive members on the basis of the following judgement criteria where the photosensitive member having the layer constitution shown in Comparative Example 1 described later was used as a reference.

A: An extremely good level at which chargeability increases by 10% or more as compared with the reference.

B: A good level at which chargeability increases by 5% or more as compared with the reference.

C: A level at which chargeability is comparable to the reference.

(3) Residual Potential

A charging unit was so adjusted that a surface potential at the position of a developing unit would be −450 V (dark potential). After that, each of the produced electrophotographic photosensitive members was irradiated with image exposure having the light quantity of an image exposure light source adjusted to be maximum. Then, the surface potential of the electrophotographic photosensitive member was measured by means of a surface potentiometer placed at the position of the developing unit, and was defined as a residual potential. The evaluation was performed by ranking the electrophotographic photosensitive members on the basis of the following judgement criteria where the photosensitive member having the layer constitution shown in Comparative Example 1 described later was used as a reference.

A: An extremely good level at which a residual potential reduces by 10% or more as compared with the reference.

B: A good level at which a residual potential reduces by 5% or more as compared with the reference.

C: A level at which a residual potential is comparable to the reference.

(4) Sensitivity

A charging unit was so adjusted that a surface potential at the position of a developing unit would be −450 V (dark potential). After that, each of the produced electrophotographic photosensitive members was irradiated with image exposure light of the light quantity of an image exposure light source adjusted in such a manner that the surface potential would be −100 V (light potential). An exposure value in this case was defined as a sensitivity. The evaluation was performed by ranking the electrophotographic photosensitive members on the basis of the following judgement criteria where the photosensitive member having the layer constitution shown in Comparative Example 1 described later was used as a reference.

A: An extremely good level at which a sensitivity increases by 10% or more as compared with the reference.

B: A good level at which a sensitivity increases by 5% or more as compared with the reference.

C: A level at which a sensitivity is comparable to the reference.

(5) Electric Potential Unevenness

The in-plane distribution of the dark potential and light potential of each of the produced electrophotographic photosensitive members were measured in a state in which a charging unit was so adjusted that a dark potential at the position of a developing unit would be −450 V and the light quantity of an image exposure light source was so adjusted that a light potential at the position of the developing unit would be −100 V. Then, the difference between the maximum value and the minimum value was defined as electric potential unevenness. The evaluation was performed by ranking the electrophotographic photosensitive members on the basis of the following judgement criteria where the photosensitive member having the layer constitution shown in Comparative Example 1 described later was used as a reference.

A: An extremely good level at which electric potential unevenness reduces by 10% or more as compared with the reference.

B: A good level at which electric potential unevenness reduces by 5% or more as compared with the reference.

C: A level at which electric potential unevenness is comparable to the reference.

(6) Optical Memory

The difference in surface potential between a non-image-exposure state and a state in which an electrophotographic photosensitive member was charged again after image exposure was measured once by means of a similar electric potential sensor in a state in which a charging unit was so adjusted that a dark potential at the position of a developing unit would be −450 V and the light quantity of an image exposure light source was so adjusted that a light potential at the position of the developing unit would be −100 V. The measured potential difference was defined as an optical memory. The evaluation was performed by ranking the electrophotographic photosensitive members on the basis of the following judgement criteria where the photosensitive member having the layer constitution shown in Comparative Example 1 described later was used as a reference.

A: An extremely good level at which an optical memory reduces by 10% or more as compared with the reference.

B: A good level at which an optical memory reduces by 5% or more as compared with the reference.

C: A level at which an optical memory is comparable to the reference.

(7) Property of Transmitting Light Having a Wavelength of 405 nm

The reciprocal of a light quantity necessary for causing optical attenuation from a certain dark potential to a certain light potential, that is, the attenuated amount of an electric potential per unit energy of light was defined as spectral sensitivity with respect to the exposure wavelength. Spectral sensitivity was measured at each of exposure wavelengths which were changed. The measured sensitivity was normalized by sensitivity at a wavelength at which the sensitivity became maximum (the peak value of the spectral sensitivity), and evaluation was made according to the normalized values. More specifically, the property of transmitting light having a wavelength of 405 nm was evaluated by means of the spectral sensitivity with respect to light having a wavelength of 405 nm.

(8) Cleaning Property (Abbreviated as CLN Property)

The CLN property was evaluated by means of the pressure of a cleaning blade at which cleaning residual toner started to generate. Specifically, an experiment was carried out in which the surface of a photosensitive member was observed after extensive operation (running test) of printing 1,000 sheets of A4 copy paper had been performed and the presence or absence of cleaning residual toner was judged. This experiment was repeated while the pressure of a cleaning blade was gradually lowered. Thus, the pressure of the cleaning blade at which cleaning residual toner started to generate was investigated. The evaluation was performed by ranking the electrophotographic photosensitive members through relative evaluation where the value of the photosensitive member having the layer constitution shown in Comparative Example 1 described later was used as a reference (100%). The lower the pressure of the cleaning blade at which cleaning residual toner started to generate is, the wider the latitude of cleaning is. Therefore, it can be seen that low pressure results in an excellent CLN property.

A: An extremely good level at which a value is less than 80% of the reference.

B: A good level at which a value is 80% or more and less than 95% of the reference.

C: A level at which a value is comparable to the reference.

COMPARATIVE EXAMPLE 1

In the same manner as in Example 3, a plasma CVD apparatus shown in FIG. 2 was used to sequentially superimpose deposition films composed of a lower injection-blocking layer, a photoconductive layer, a top injection-blocking layer, and a surface layer under the conditions shown in Table 6 on an aluminum cylinder (support), which had a diameter of 84 mm and a length of 381 mm and was subjected to mirror finish, to thereby produce a photosensitive member.

The produced photosensitive member was evaluated in the same manner as in Example 3.

Table 8 shows the evaluation results.

Figure 11:
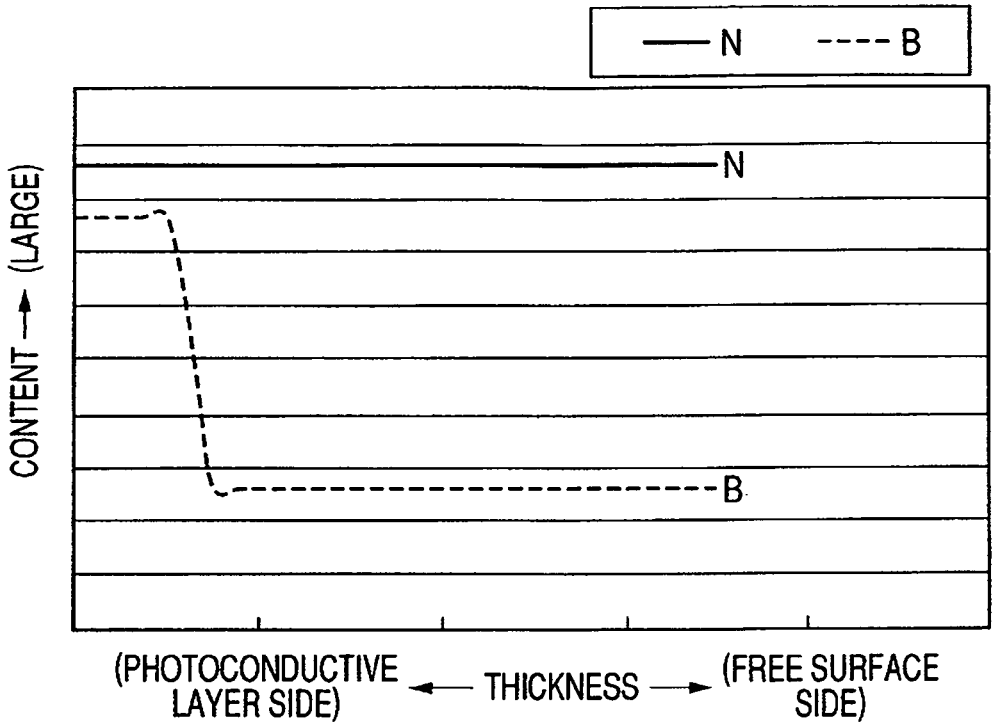
FIG. 11 shows a depth profile of a surface region layer of Comparative Example 1.

The content was adapted to have such a local maximum value and distribution as shown in FIG. 11.

TABLE 6

| Kind and flow rate of gas | Lower injection-blocking layer | Photoconnductive layer | Top injection-blocking layer | Surface layer |
|---|---|---|---|---|
| $SiH_4$ [mL/min (normal)] | 170 | 170 | 30 | 30 |
| $H_2$ [mL/min (normal)] | 600 | 1000 | | |
| $B_2H_6$ [ppm (with respect to $SiH_4$)] | | | 3000 | |
| $N_2$ [mL/min (normal)] | | | 300 | 300 |
| $CH_4$ [mL/min (normal)] | 300 | | | |
| NO [mL/min (normal)] | 5 | | | |
| $SiF_4$ [mL/min (normal)] | | | | |
| Support temperature [° C.] | 270 | 260 | 220 | 220 |
| Pressure [Pa] | 80 | 75 | 60 | 56 |
| RF power [W] | 200 | 400 | 180 | 180 |
| Thickness [μm] | 2.5 | 30 | 0.1 | 0.6 |

EXAMPLE 4

In the same manner as in Example 3, a plasma CVD apparatus shown in FIG. 2 was used to sequentially superimpose deposition films composed of a lower injection-blocking layer, a photoconductive layer, a top injection-blocking layer, and a surface layer under the conditions shown in Table 7 on an aluminum cylinder (support), which had a diameter of 84 mm and a length of 381 mm and was subjected to mirror finish, in order to provide a layer constitution shown in FIG. 1B, to thereby produce a photosensitive member.

In that case, the photosensitive member was produced under the same conditions as in Example 3 except that neither an NO gas nor an $SiF_4$ gas was used for a surface region layer as shown in Table 7.

The produced photosensitive member was evaluated in the same manner as in Example 3.

Table 8 shows the evaluation results together with Example 3 and Comparative Example 1.

Figure 12:
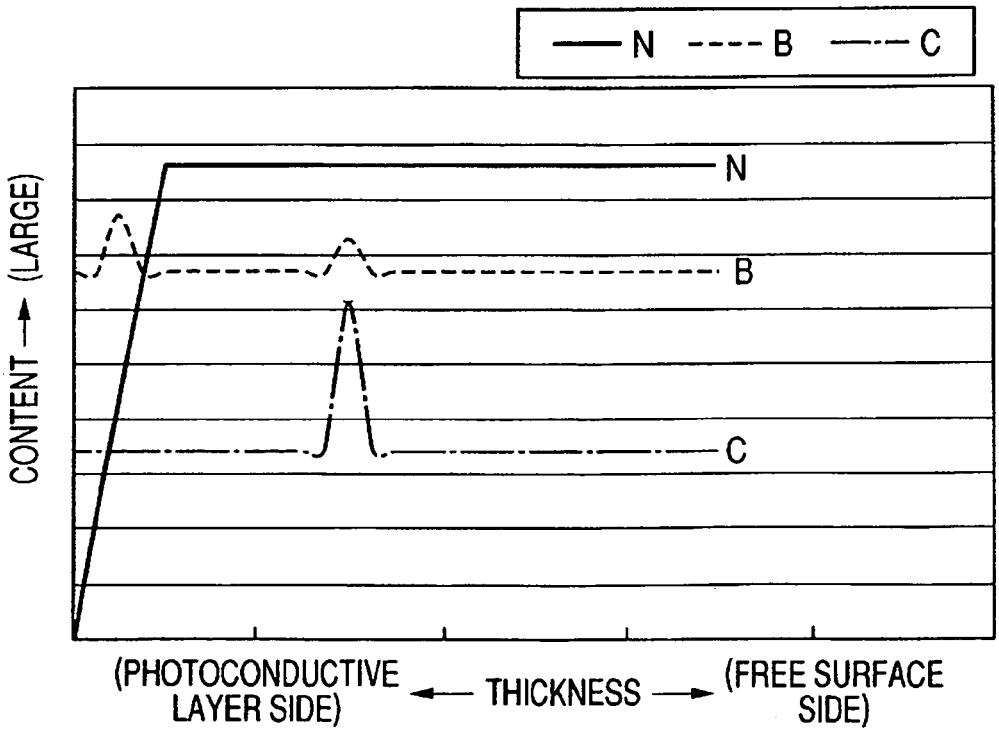
FIG. 12 shows a depth profile of a surface region layer of Example 4 in the present invention.

The content was adapted to have such local maximum values and distribution as shown in FIG. 12.

TABLE 7

| Kind and flow rate of gas | Lower injection-blocking layer | Photo-conductive layer | Surface region layer: Change layer | Surface region layer: Surface layer |
|---|---|---|---|---|
| $SiH_4$ [mL/min (normal)] | 170 | 170 | 170→30 | 30 |
| $H_2$ [mL/min (normal)] | 600 | 1000 | | |
| $B_2H_6$ [ppm (with | | | 500→3000 | 500→1500 |

TABLE 7-continued

| Kind and flow rate of gas | Lower injection-blocking layer | Photo-conductive layer | Surface region layer: Change layer | Surface region layer: Surface layer |
|---|---|---|---|---|
| respect to $SiH_4$)] | | | →500 | →500 |
| $N_2$ [mL/min (normal)] | | | 0→300 | 300 |
| $CH_4$ [mL/min (normal)] | 300 | | 5 | 5→18→5 |
| NO [mL/min (normal)] | 5 | | | |
| Support temperature [° C.] | 270 | 260 | 220 | 220 |
| Pressure [Pa] | 80 | 75 | 60 | 56 |
| RF power [W] | 200 | 400 | 180 | 180 |
| Thickness [μm] | 2.5 | 30 | 0.1 | 0.6 |

It was observed that the photosensitive member in which the distribution of the boron atom content in the surface region layer had two local maximum values as with the photosensitive member in Example 3 or Example 4 was improved in properties in all the evaluated items. In Example 4, the distribution of the carbon atom content had one local maximum value. It can be seen that resolution, reduction in residual electric potential, reduction in optical memory, and CLN property can be additionally improved with the constitution in which the distribution of each of the carbon atom content, oxygen atom content and fluorine atom content has one local maximum value as in Example 3.

EXAMPLE 5

In the same manner as in Example 3, a plasma CVD apparatus shown in FIG. 2 was used to sequentially superimpose deposition films composed of a lower injection-blocking layer, a photoconductive layer, a change layer, and a surface layer under the conditions shown in Table 9 on an aluminum cylinder (support), which had a diameter of 84 mm and a length of 381 mm and was subjected to mirror finish, in order to provide a layer constitution shown in FIG. 1C, to thereby produce a photosensitive member.

In that case, several kinds of photosensitive members were produced under the same conditions as in Example 3 except that the flow rate of each of an $SiH_4$ gas and a $B_2H_6$ gas to be incorporated into a surface region layer was changed to vary a content and a local maximum value as shown in Table 9, where the content and local maximum value are shown in Table 13.

Each of the produced photosensitive members was evaluated in the same manner as in Example 3.

Table 14 shows the evaluation results.

Figure 13:
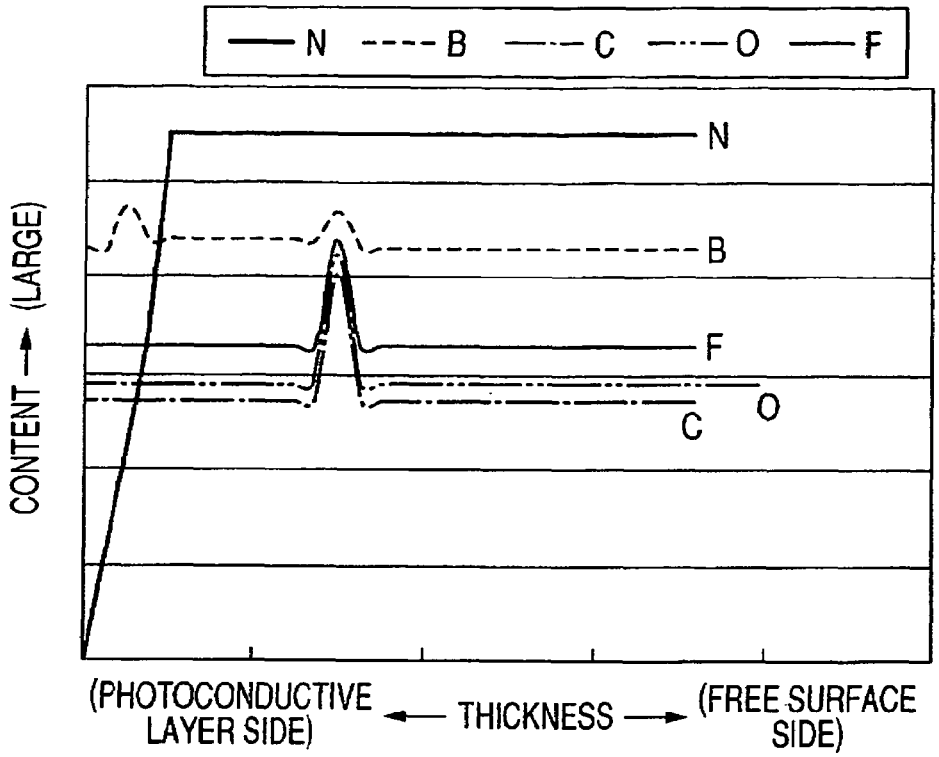
FIG. 13 shows a depth profile of a surface region layer of Example 5 in the present invention.

The content had such local maximum values and distribution as shown in FIG. 13.

TABLE 8

| Photosensitive member | Resolution | Chargeability | Residual potential | Sensitivity | Electric potential unevenness | Optical memory | Transmitting property | CLN |
|---|---|---|---|---|---|---|---|---|
| Comparative Example 1 | C | C | C | C | C | C | C | C |
| Example 3 | A | A | A | A | A | A | A | A |
| Example 4 | B | A | B | A | A | B | A | B |

As is apparent from Table 8, the resolution of an image of a test chart in which characters were arranged at a resolution of 1,200 dpi with blue light semiconductor laser (405 nm) was improved. This shows that dot reproducibility can be improved by using a surface region layer such as a surface region layer in Example 3 produced in such a manner that the distribution of a boron atom content in the surface region layer has two local maximum values and the distributions of a carbon atom content, an oxygen atom content, and a fluorine atom content each have one local maximum value or a surface region layer in Example 4 produced in such a manner that the distribution of a boron atom content in the surface region layer has two local maximum values and the distribution of a carbon atom content has one local maximum value, and hence the original effect of reducing a spot diameter can be sufficiently exerted.

TABLE 9

| Kind and flow rate of gas | Lower injection-blocking layer | Photoconductive layer | Surface region layer: Change layer | Surface region layer: Surface layer |
|---|---|---|---|---|
| $SiH_4$ [mL/min (normal)] | 170 | 170 | 170→10 | 10 |
| $H_2$ [mL/min (normal)] | 600 | 1000 | | |
| $B_2H_6$ [ppm (with respect to $SiH_4$)] | | | 1500 to 3500(*) | 2500 to 4000(*) |
| $N_2$ [mL/min (normal)] | | | 0→80 | 80 |
| $CH_4$ [mL/min (normal)] | 300 | | 2 | 2→20→4 |
| NO [mL/min (normal)] | 5 | | 1 | 1→2→1 |
| $SiF_4$ [mL/min (normal)] | | | 1 | 1→4→1 |
| Support temperature [° C.] | 270 | 260 | 240 | 250 |

TABLE 9-continued

| Kind and flow rate of gas | Lower injection-blocking layer | Photoconductive layer | Surface region layer: Change layer | Surface region layer: Surface layer |
|---|---|---|---|---|
| Pressure [Pa] | 80 | 75 | 58 | 52 |
| RF power [W] | 200 | 400 | 250 | 200 |
| Thickness [μm] | 2.5 | 30 | 0.08 | 0.6 |

(*)The higher the flow rate, the larger the local maximum value is.

EXAMPLE 6

In the same manner as in Example 3, a plasma CVD apparatus shown in FIG. 2 was used to sequentially superimpose deposition films composed of a lower injection-blocking layer, a photoconductive layer, a change layer, and a surface layer under the conditions shown in Table 10 on an aluminum cylinder (support), which had a diameter of 84 mm and a length of 381 mm and was subjected to mirror finish, in order to provide a layer constitution shown in FIG. 1C, to thereby produce a photosensitive member.

In that case, photosensitive members were produced under the same conditions as in Example 3 except that the flow rate of a $B_2H_6$ gas to be incorporated into a surface region layer was changed as shown in Table 10 in such a manner that a local maximum value on a surface side would be larger than a local maximum value on a photoconductive layer side, where the content and local maximum value are shown in Table 13.

Each of the produced photosensitive members was evaluated in the same manner as in Example 3.

Table 14 shows the evaluation results.

Figure 14:
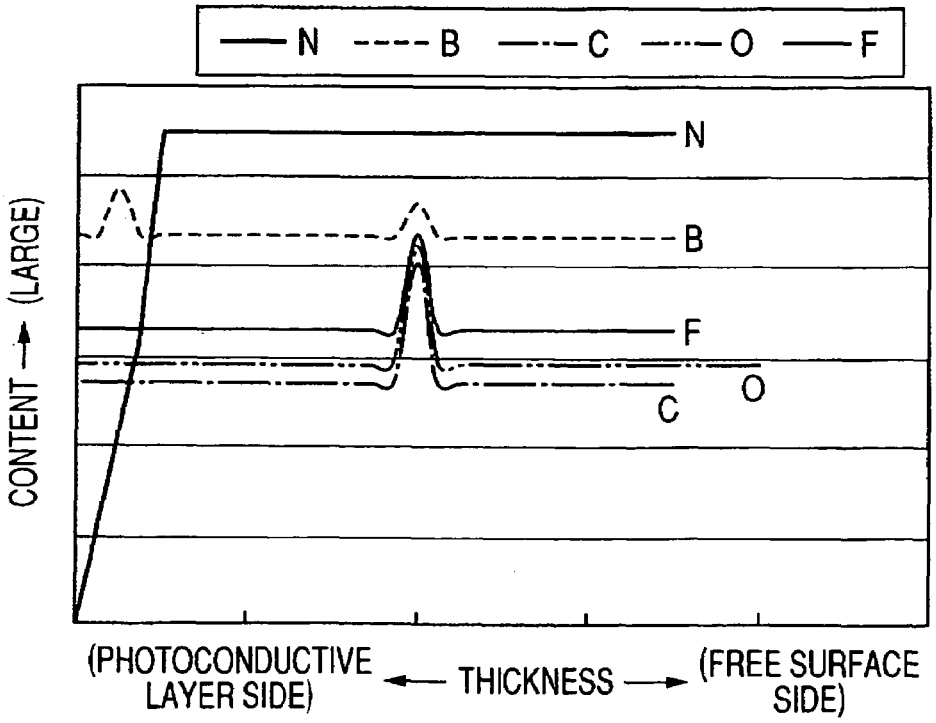
FIG. 14 shows a depth profile of a surface region layer of Example 6 in the present invention.

The content had such local maximum values and distribution as shown in FIG. 14.

TABLE 10

| Kind and flow rate of gas | Lower injection-blocking layer | Photoconductive layer | Surface region layer: Change layer | Surface region layer: Surface layer |
|---|---|---|---|---|
| $SiH_4$ [mL/min (normal)] | 170 | 170 | 170→10 | 10 |
| $H_2$ [mL/min (normal)] | 600 | 1000 | | |
| $B_2H_6$ [ppm (with respect to $SiH_4$)] | | | 1500 to 3500(*) | 2500 to 4000(*) |
| $N_2$ [mL/min (normal)] | | | 0→80 | 80 |
| $CH_4$ [mL/min (normal)] | 300 | | 2 | 2→20→4 |
| NO [mL/min (normal)] | 5 | | 1 | 1→2→1 |
| $SiF_4$ [mL/min (normal)] | | | 1 | 1→4→1 |
| Support temperature [° C.] | 270 | 260 | 240 | 250 |
| Pressure [Pa] | 80 | 75 | 58 | 52 |
| RF power [W] | 200 | 400 | 250 | 200 |
| Thickness [μm] | 2.5 | 30 | 0.08 | 0.6 |

(*)The higher the flow rate, the larger the local maximum value is.

EXAMPLE 7

In the same manner as in Example 3, a plasma CVD apparatus shown in FIG. 2 was used to sequentially superimpose deposition films composed of a lower injection-blocking layer, a photoconductive layer, a change layer, and a surface layer under the conditions shown in Table 11 on an aluminum cylinder (support), which had a diameter of 84 mm and a length of 381 mm and was subjected to mirror finish, in order to provide a layer constitution shown in FIG. 1C, to thereby produce a photosensitive member.

In that case, photosensitive members were produced under the same conditions as in Example 3 except that the flow rate of a $B_2H_6$ gas to be incorporated into a surface region layer was not changed, as shown in Table 11, for a certain time period during which it was at the maximum value to provide a local maximum region, where the content and local maximum value are shown in Table 13.

Each of the produced photosensitive members was evaluated in the same manner as in Example 3.

Table 14 shows the evaluation results.

Figure 15:
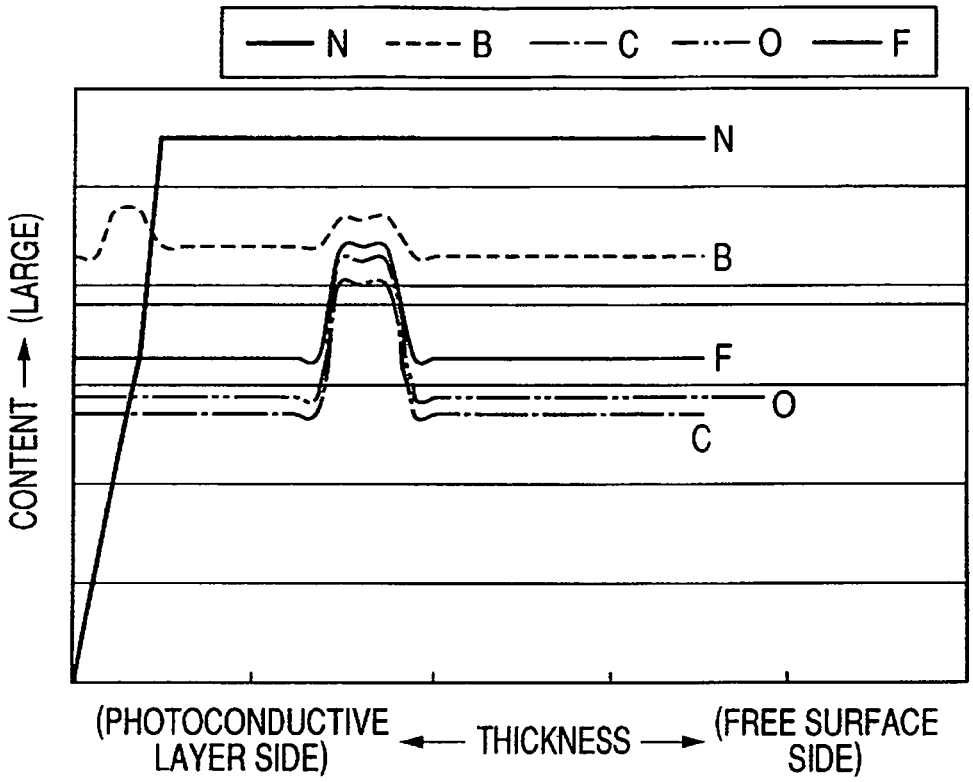
FIG. 15 shows a depth profile of a surface region layer of Example 7 in the present invention.

The content had such local maximum values and distribution as shown in FIG. 15.

TABLE 11

| Kind and flow rate of gas | Lower injection-blocking layer | Photoconductive layer | Surface region layer: Change layer | Surface region layer: Surface layer |
|---|---|---|---|---|
| $SiH_4$ [mL/min (normal)] | 170 | 170 | 170→10 | 10 |
| $H_2$ [mL/min (normal)] | 600 | 1000 | | |
| $B_2H_6$ [ppm (with respect to $SiH_4$)] | | | 1500 to 3500(*) | 2500 to 4000(*) |
| $N_2$ [mL/min (normal)] | | | 0→80 | 80 |
| $CH_4$ [mL/min (normal)] | 300 | | 2 | 2→20→4 |
| NO [mL/min (normal)] | 5 | | 1 | 1→2→1 |
| $SiF_4$ [mL/min (normal)] | | | 1 | 1→4→1 |
| Support temperature [° C.] | 270 | 260 | 240 | 250 |
| Pressure [Pa] | 80 | 75 | 58 | 52 |
| RF power [W] | 200 | 400 | 250 | 200 |
| Thickness [μm] | 2.5 | 30 | 0.08 | 1 |

(*)The higher the flow rate, the larger the local maximum value is.

EXAMPLE 8

In the same manner as in Example 3, a plasma CVD apparatus shown in FIG. 2 was used to sequentially superimpose deposition films composed of a lower injection-blocking layer, a photoconductive layer, a change layer, and a surface layer under the conditions shown in Table 12 on an aluminum cylinder (support), which had a diameter of 84 mm and a length of 381 mm and was subjected to mirror finish, in order to provide a layer constitution shown in FIG. 1C, to thereby produce a photosensitive member.

In that case, photosensitive members were produced under the same conditions as in Example 3 except that the flow rate of a $B_2H_6$ gas to be incorporated into a surface region layer was changed as shown in Table 12 to change the interval between a local maximum value and an adjacent local maximum value, where the content and local maximum value are shown in Table 13.

Each of the produced photosensitive members was evaluated in the same manner as in Example 3.

Table 14 shows the evaluation results.

Figure 16:
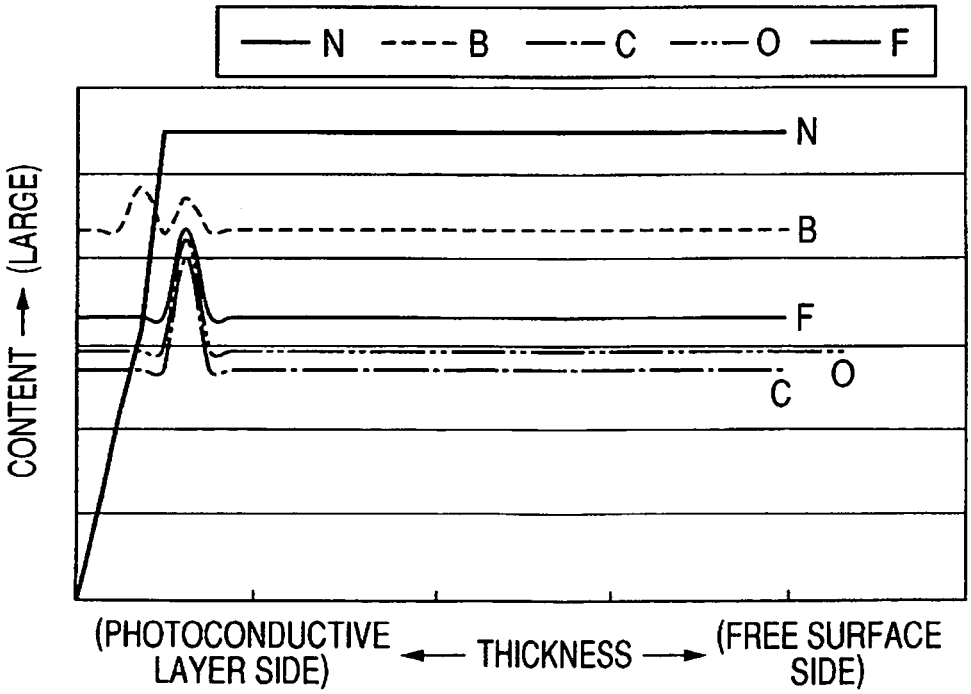
FIG. 16 shows a depth profile of a surface region layer of Example 8 in the present invention.

The content was adapted to have such local maximum values and distribution as shown in FIG. 16.

TABLE 12

| Kind and flow rate of gas | Lower injection-blocking layer | Photoconductive layer | Surface region layer: Change layer | Surface region layer: Surface layer |
|---|---|---|---|---|
| $SiH_4$ [mL/min (normal)] | 170 | 170 | 170→10 | 10 |
| $H_2$ [mL/min (normal)] | 600 | 1000 | | |
| $B_2H_6$ [ppm (with respect to $SiH_4$)] | | | 1500 to 3500(*) | 2500 to 4000(*) |
| $N_2$ [mL/min (normal)] | | | 0→80 | 80 |
| $CH_4$ [mL/min (normal)] | 300 | | 2 | 2→20→4 |
| NO [mL/min (normal)] | 5 | | 1 | 1→2→1 |
| $SiF_4$ [mL/min (normal)] | | | 1 | 1→4→1 |
| Support temperature [° C.] | 270 | 260 | 240 | 200 |
| Pressure [Pa] | 80 | 75 | 58 | 52 |
| RF power [W] | 200 | 400 | 250 | 250 |
| Thickness [μm] | 2.5 | 30 | 0.08 | 0.6 |

(*)The higher the flow rate, the larger the local maximum value is.

Table 13 shows the local maximum values of the boron atom content on the surface side and the photoconductive layer side, the minimum value of the boron content between the local maximum values, the interval between the local maximum values, the amount of nitrogen represented by N/(Si+N), and the carbon atom content in each of the surface region layers of the photosensitive members produced in Examples 5 to 8.

TABLE 13

| Photosensitive member | Local maximum values on surface side atoms/cm$^3$ | Local maximum values on photoconductive layer side atoms/cm$^3$ | Minimum value between local maximum values atoms/cm$^3$ | Interval between local maximum values nm | N/(Si + N) atm % | C local maximum value atoms/cm$^3$ |
|---|---|---|---|---|---|---|
| Example 5-A | $4.5 \times 10^{18}$ | $5.0 \times 10^{18}$ | $2.5 \times 10^{18}$ | 480 nm | 55 | $1.2 \times 10^{20}$ |
| Example 5-B | $4.5 \times 10^{18}$ | $4.8 \times 10^{18}$ | $1.2 \times 10^{18}$ | 480 nm | 55 | $1.2 \times 10^{20}$ |
| Example 5-C | $4.1 \times 10^{18}$ | $5.8 \times 10^{18}$ | $2.7 \times 10^{18}$ | 520 nm | 55 | $1.2 \times 10^{20}$ |
| Example 5-D | $3.9 \times 10^{18}$ | $4.6 \times 10^{18}$ | $3.1 \times 10^{18}$ | 500 nm | 55 | $1.2 \times 10^{20}$ |
| Example 6-A | $4.2 \times 10^{18}$ | $5.5 \times 10^{18}$ | $1.4 \times 10^{18}$ | 470 nm | 55 | $1.2 \times 10^{20}$ |
| Example 6-B | $5.3 \times 10^{18}$ | $7.2 \times 10^{18}$ | $2.1 \times 10^{18}$ | 550 nm | 55 | $1.2 \times 10^{20}$ |
| Example 7-A | $4.8 \times 10^{18}$ | $4.2 \times 10^{18}$ | $1.3 \times 10^{18}$ | 460 nm | 55 | $1.2 \times 10^{20}$ |
| Example 7-B | $4.2 \times 10^{18}$ | $5.2 \times 10^{18}$ | $1.6 \times 10^{18}$ | 520 nm | 55 | $1.2 \times 10^{20}$ |
| Example 8-A | $4.5 \times 10^{18}$ | $5.5 \times 10^{18}$ | $1.2 \times 10^{18}$ | 100 nm | 55 | $1.2 \times 10^{20}$ |
| Example 8-B | $4.5 \times 10^{18}$ | $5.5 \times 10^{18}$ | $1.2 \times 10^{18}$ | 90 nm | 55 | $1.2 \times 10^{20}$ |
| Example 8-C | $4.5 \times 10^{18}$ | $5.5 \times 10^{18}$ | $1.2 \times 10^{18}$ | 1000 nm | 55 | $1.2 \times 10^{20}$ |
| Example 8-D | $4.5 \times 10^{18}$ | $5.5 \times 10^{18}$ | $1.2 \times 10^{18}$ | 1020 nm | 55 | $1.2 \times 10^{20}$ |

TABLE 14

| | Resolution | Chargeability | Residual potential | Sensitivity | Electric potential unevenness | Optical memory | Transmitting property | CLN |
|---|---|---|---|---|---|---|---|---|
| Example 5-A | A | A | A | A | A | A | A | A |
| Example 5-B | B | C | A | A | A | A | A | A |
| Example 5-C | B | A | A | A | A | A | A | A |
| Example 5-D | C | C | A | A | A | A | A | A |
| Example 6-A | B | A | A | A | A | A | A | A |
| Example 6-B | B | A | A | A | A | A | A | A |
| Example 7-A | B | B | A | A | A | A | A | A |
| Example 7-B | B | C | A | A | A | A | A | A |
| Example 8-A | A | A | A | A | A | A | A | A |
| Example 8-B | C | C | C | B | A | A | A | A |
| Example 8-C | A | A | A | A | A | A | A | A |
| Example 8-D | B | C | B | B | A | A | A | A |

As can be seen from the evaluation results in Example 5 shown in Table 14, when setting the local maximum value on a photoconductive layer side to be equal to or larger than $5\times10^{18}$ atoms/cm$^3$, chargeability can be improved, and when setting the minimum content between local maximum values to be equal to or less than $2.5\times10^{18}$ atoms/cm$^3$, resolution can be improved. When the minimum content between local maximum values is in excess of $2.5\times10^{18}$ atoms/cm$^3$, the effect of improving resolution is not exhibited because the number of local maximum values is substantially equal to one.

As can be seen from the results in Example 6, the effect of the present invention can be obtained and the properties in all the items are improved as compared with the comparative example even when a Group 13 element in the periodic table is incorporated to have a local maximum region. It is also found that when incorporating the element to have a local maximum value, resolution is additionally improved.

As can be seen from the results in Example 7, a resolution and chargeability can be improved when setting a local maximum value on the photoconductive layer side to be larger than a local maximum value on the surface side and setting the local maximum value on the photoconductive layer side to be equal to or larger than $5\times10^{18}$ atoms/cm$^3$.

As can be seen from the results of Example 8, when the interval between local maximum values is less than 100 nm, almost no effects of improving resolution, chargeability and residual potential are exhibited because the number of local maximum values is substantially equal to one. It is also found that when the interval is in excess of 1,000 nm, the effects of improving resolution, residual potential and sensitivity are somewhat reduced.

In view of the foregoing, when causing a Group 13 element in the periodic table to have at least two local maximum values, resolution is improved. Furthermore, electrical properties such as chargeability, residual potential and sensitivity can be improved when setting the local maximum value on the photoconductive layer side to be equal to or larger than $5\times10^{18}$ atoms/cm$^3$ and setting the interval between local maximum values to fall in the range of 100 nm to 1,000 nm.

EXAMPLE 9

In the same manner as in Example 3, a plasma CVD apparatus shown in FIG. 2 was used to sequentially superimpose deposition films composed of a lower injection-blocking layer, a photoconductive layer, a change layer, and a surface layer under the conditions shown in Table 15 on an aluminum cylinder (support), which had a diameter of 84 mm and a length of 381 mm and was subjected to mirror finish, to thereby produce a photosensitive member.

In that case, photosensitive members were produced under the same conditions as in Example 3 except that the combination of a change pattern for gradually reducing the flow rate of an $SiH_4$ gas and a change pattern for gradually increasing the flow rate of an $N_2$ gas in the change layer was variously changed in such a manner that the surface layer and the photoconductive layer would be optically continuous.

The spectral reflection spectrum of each of the produced photosensitive members was measured for evaluating optical continuity.

The spectral reflection spectrum is a reflectivity with respect to the wavelength of incident light, and refers to the value of the reflectivity (percentage) measured by means of a spectrophotometer (MCPD-2000 manufactured by Otsuka Electronics Co., Ltd.). Specifically, the spectral emission intensity I(o) of the light source of a spectroscope is measured, the spectral reflected light intensity I(D) of a photosensitive member is measured, and a reflectivity R=I(D)/I(o) is determined.

Figure 8A:
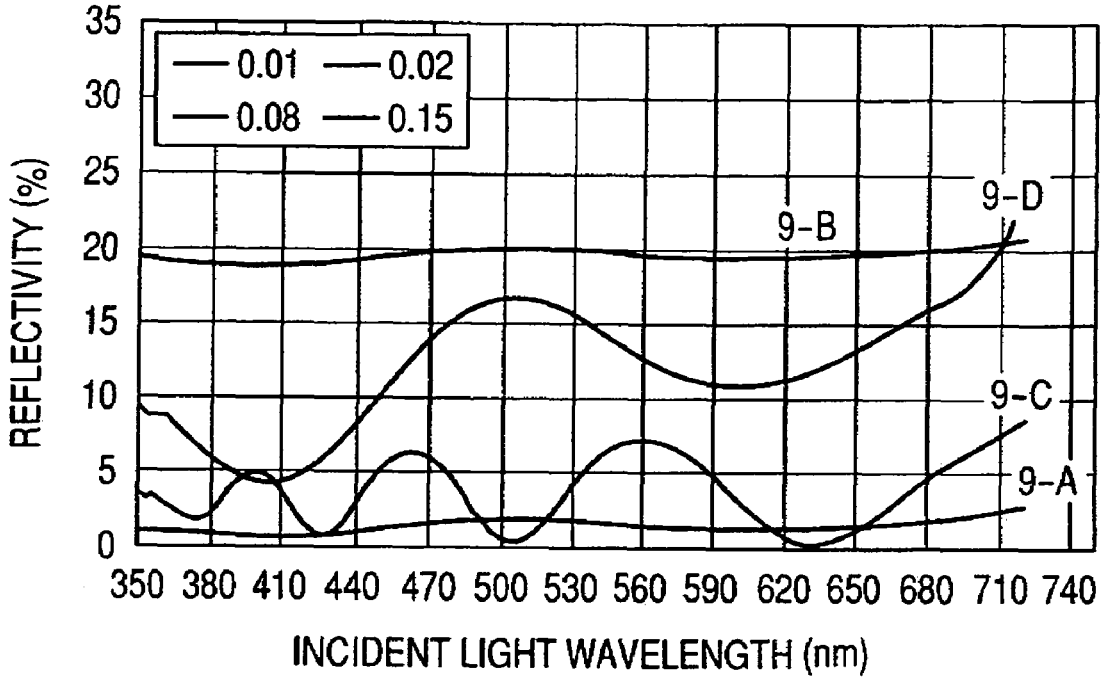
FIGS. 8A and 8B are graphs each showing an example of a spectro-reflection spectrum in the case where an optically continuous change layer is positioned in the present invention.
Figure 8B:
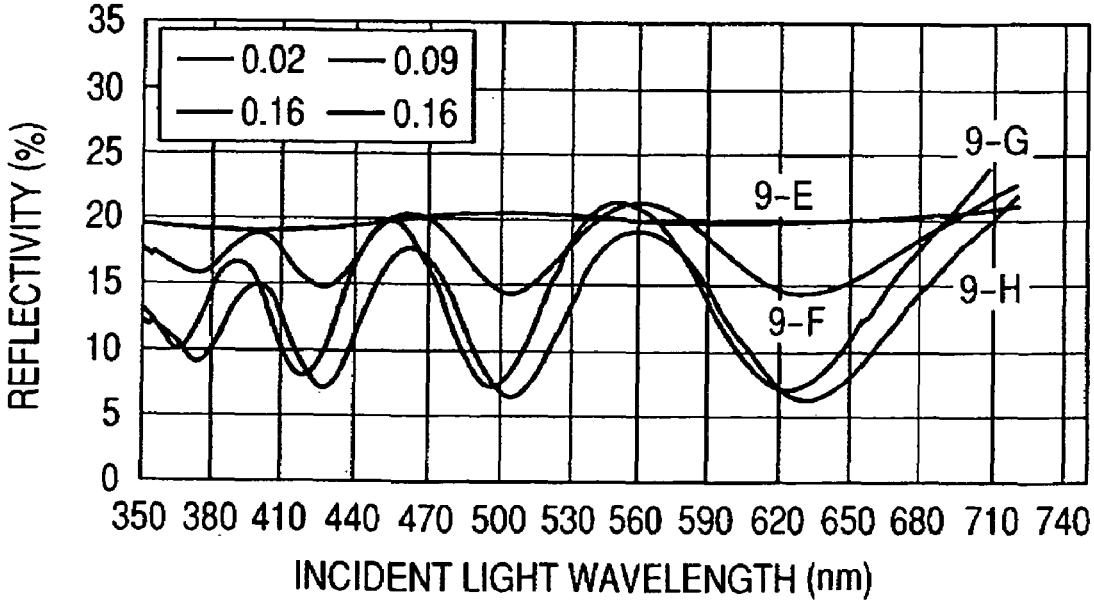

FIGS. 8A and 8B show the measurement results of the spectral reflection spectrum.

Each of the produced photosensitive members was evaluated in the same manner as in Example 3.

The local maximum value of the carbon atom content was $1.7\times10^{20}$ atoms/cm$^3$, and the local maximum values of the boron atom content were $7.3\times10^{18}$ atoms/cm$^3$ and $6.4\times10^{18}$ atoms/cm$^3$ from the photoconductive layer side. The interval between the local maximum values of the boron atom content was 400 nm. In addition, the amount of nitrogen in the surface layer represented by N/(Si+N) was 69 atm %.

Table 16 shows the evaluation results.

Figure 17:
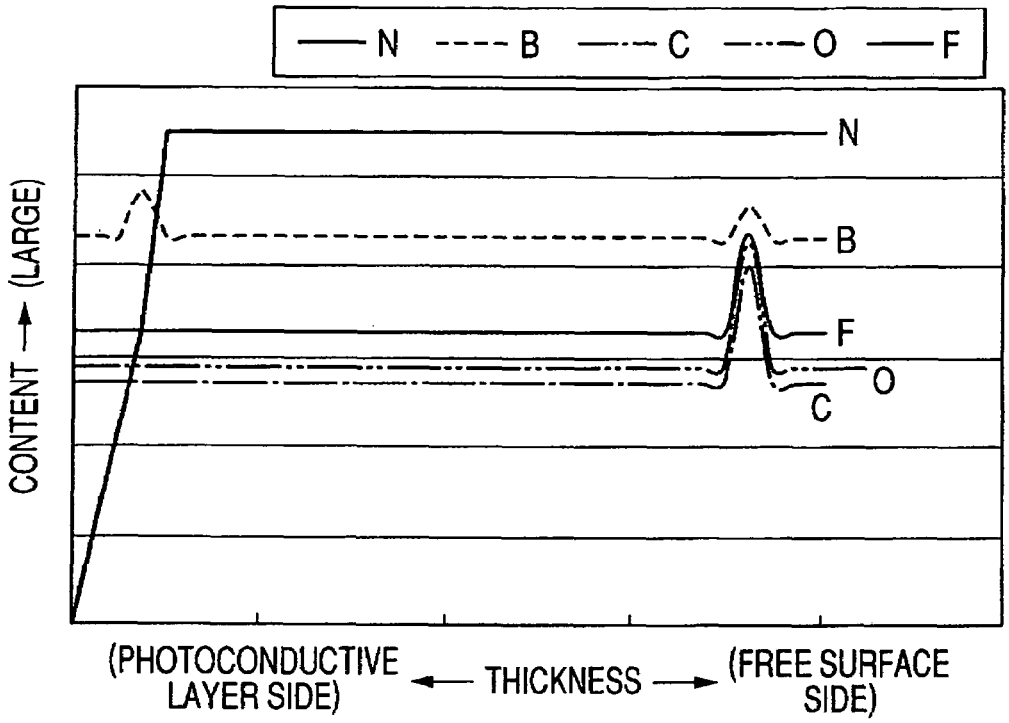
FIG. 17 shows a depth profile of a surface region layer of Example 9 in the present invention.

The content had such local maximum values and distribution as shown in FIG. 17.

TABLE 15

| Kind and flow rate of gas | Lower injection-blocking layer | Photo-conductive layer | Surface region layer: Change layer | Surface region layer: Surface layer |
|---|---|---|---|---|
| $SiH_4$ [mL/min (normal)] | 250 | 200 | 200→20 | 20 |
| $H_2$ [mL/min (normal)] | 750 | 1200 | | |
| $B_2H_6$ [ppm (with respect to $SiH_4$)] | | | 0→2000→50 | 50→1500→10 |
| $N_2$ [mL/min (normal)] | | | 0→600 | 600 |
| $CH_4$ [mL/min (normal)] | 500 | | 2 | 2→25→3 |
| NO [mL/min (normal)] | 6 | | 2 | 2→4→2 |
| $SiF_4$ [mL/min (normal)] | | | 3 | 3→5→1 |
| Support temperature [° C.] | 280 | 270 | 240 | 250 |
| Pressure [Pa] | 85 | 72 | 58 | 52 |
| RF power [W] | 300 | 450 | 200 | 200 |
| Thickness [μm] | 3 | 35 | 0.12 | 0.6 |

TABLE 16

| | Resolution | Chargeability | Residual potential | Sensitivity | Electric potential unevenness | Optical memory | Transmitting property | CLN |
|---|---|---|---|---|---|---|---|---|
| Example 9-A | A | A | A | A | A | A | A | A |
| Example 9-B | A | A | A | A | A | A | A | A |
| Example 9-C | A | A | A | A | A | A | A | A |
| Example 9-D | A | A | A | A | A | A | A | A |
| Example 9-E | A | A | A | A | C | A | A | A |
| Example 9-F | A | A | A | A | C | A | A | A |
| Example 9-G | A | A | A | A | C | A | A | A |
| Example 9-H | A | A | A | A | C | A | A | A |

FIG. 8A shows the spectral reflection spectra in Example 9-A to Example 9-D.

In each of the spectral reflection spectra of the four photosensitive members, the minimum value (Min) and maximum value (Max) of a reflectivity (%) in the wavelength range of 350 nm to 680 nm satisfy the relationship of 0% ≦Max (%)≦20% and the relationship of 0≦(Max−Min)/(100−Max)≦0.15.

FIG. 8B shows the spectral reflection spectra in Example 9-E to Example 9-H. In each of those photosensitive members, the minimum value and maximum value do not satisfy the above conditional ranges.

The results shown in Table 16 show that electric potential unevenness, in particular, exposure unevenness can be reduced by producing a photosensitive member in such a manner that layers ranging from a photoconductive layer to a surface layer are optically continuous so that the minimum value and maximum value in the spectral reflection spectrum satisfy the above conditional ranges.

Figure 9:
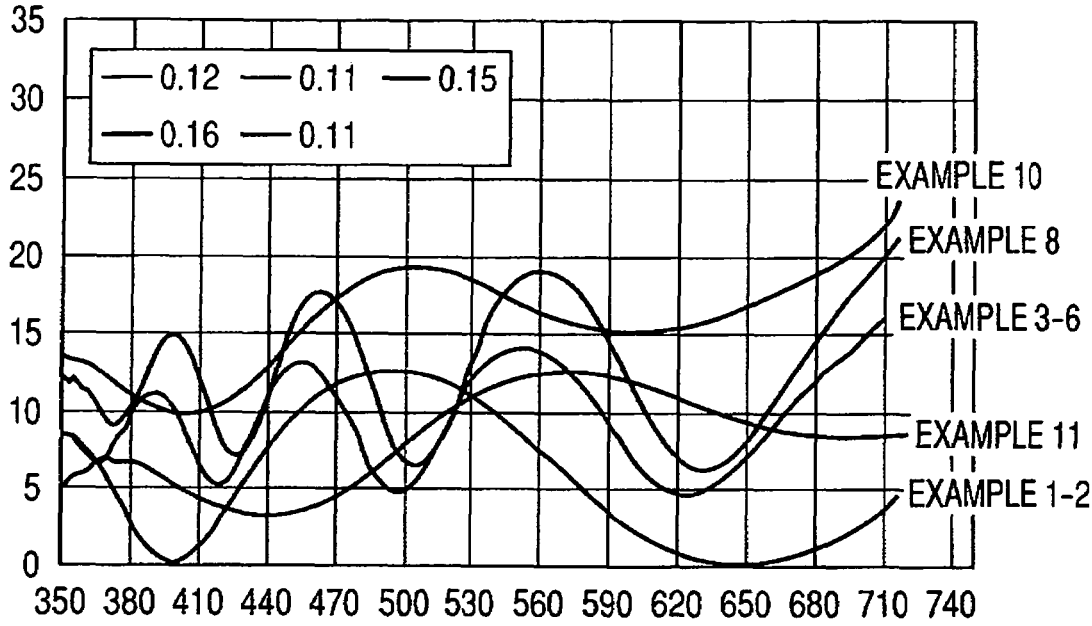
FIG. 9 is a graph showing the spectro-reflection spectra of Examples.

In addition, as shown in FIG. 9, in all the Examples other than Example 9, the photosensitive members were so produced that the minimum value and maximum value of a reflectivity fall within the conditional ranges.

EXAMPLE 10

In the same manner as in Example 3, a plasma CVD apparatus shown in FIG. 2 was used to sequentially superimpose deposition films composed of a lower injection-blocking layer, a photoconductive layer, a change layer, and a surface layer under the conditions shown in Table 17 on an aluminum cylinder (support), which had a diameter of 84 mm and a length of 381 mm and was subjected to mirror finish, in order to provide a layer constitution shown in FIG. 1C, to thereby produce a photosensitive member.

In that case, the photosensitive member different in the local maximum value of the carbon atom content was produced under the same conditions as in Example 3 except that the flow rate of a $CH_4$ gas was changed.

The produced photosensitive member was evaluated in the same manner as in Example 3.

Figure 18:
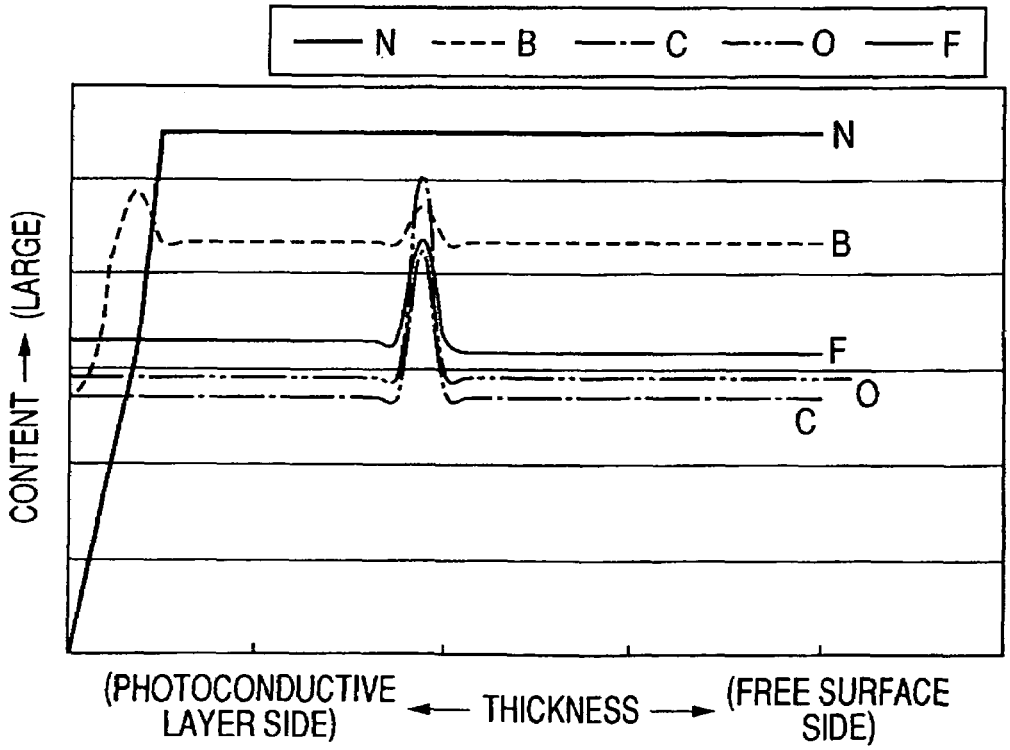
FIG. 18 shows a depth profile of a surface region layer of Example 10 in the present invention.

The content was adapted to have such local maximum values and distribution as shown in FIG. 18.

The local maximum value of the carbon atom content was $9.8\times10^{19}$ atoms/cm$^3$, and the local maximum values of the boron atom content were $7.3\times10^{18}$ atoms/cm$^3$ and $6.4\times10^{18}$ atoms/cm$^3$ from a photoconductive layer side. The interval between the local maximum values of the boron atom content was 300 nm. In addition, the amount of nitrogen in the surface layer represented by N/(Si+N) was 48 atm %.

Table 18 shows the evaluation results.

Making a comparison between Table 18 and Example 3 of Table 8, it can be seen that the carbon atom content of less than $1.0\times10^{20}$ atoms/cm$^3$ has no effect of improving the CLN property, but provides good results concerning resolution, chargeability, and the like similar to Example 3.

EXAMPLE 11

In the same manner as in Example 3, a plasma CVD apparatus shown in FIG. 2 was used to sequentially superimpose deposition films composed of a lower injection-blocking layer, a photoconductive layer, a change layer, and a surface layer under the conditions shown in Table 19 on an aluminum cylinder (support), which had a diameter of 84 mm and a length of 381 mm and was subjected to mirror finish, in order to provide a layer constitution shown in FIG. 1C, to thereby produce a photosensitive member.

In that case, the photosensitive member was produced under the same conditions as in Example 3 except that the flow rate of a $CH_4$ gas was changed in the change layer portion in such a manner that the carbon atom content would have a local maximum value.

The produced photosensitive member was evaluated in the same manner as in Example 3.

The local maximum values of the carbon atom content were $1.1\times10$ atoms/cm$^3$ and $1.5\times10^{20}$ atoms/cm$^3$ from the photoconductive layer side, and the local maximum values of the boron atom content were $7.1\times10^{18}$ atoms/cm$^3$ and $6.5\times10^{18}$ atoms/cm$^3$ from the photoconductive layer side. The interval between the local maximum values of the boron atom content was 280 nm. In addition, the amount of nitrogen in the surface layer represented by N/(Si+N) was 48 atm %.

Table 20 shows the evaluation results.

Figure 19:
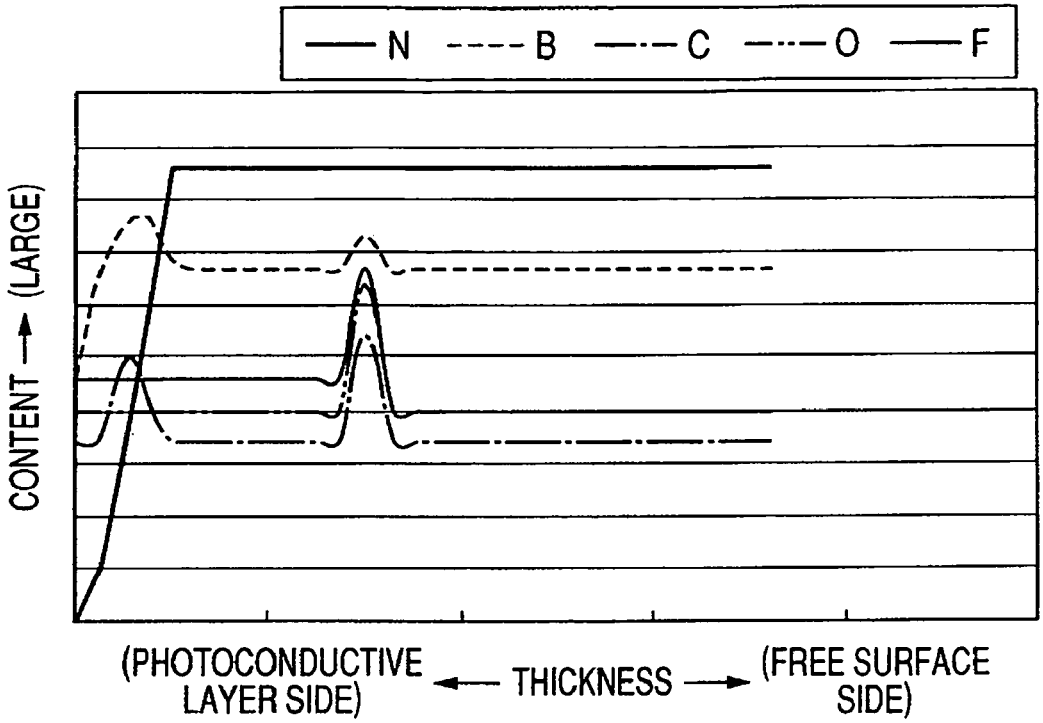
FIG. 19 shows a depth profile of a surface region layer of Example 11 in the present invention.

The content was adapted to have such local maximum values and distribution as shown in FIG. 19.

TABLE 17

| Kind and flow of gas | Lower injection-blocking layer | Photoconductive layer | Surface region layer: Change layer | Surface region layer: Surface layer |
|---|---|---|---|---|
| $SiH_4$ [mL/min (normal)] | 250 | 200 | 200→20 | 20 |
| $H_2$ [mL/min (normal)] | 750 | 1600 | | |
| $B_2H_6$ [ppm (with respect to $SiH_4$)] | | | 0→2000→50 | 50→1500→10 |
| $N_2$ [mL/min (normal)] | | | 0→150 | 150 |
| $CH_4$ [mL/min (normal)] | 500 | | 2 | 2→15→2 |
| NO [mL/min (normal)] | 6 | | 1 | 1→2→1 |
| $SiF_4$ [mL/min (normal)] | | | 1 | 1→4→1 |
| Support temperature [° C.] | 280 | 270 | 240 | 250 |
| Pressure [Pa] | 85 | 72 | 56 | 52 |
| RF power [W] | 300 | 600 | 280 | 250 |
| Thickness [μm] | 3 | 32 | 0.1 | 0.6 |

TABLE 18

| | Resolution | Chargeability | Residual potential | Sensitivity | Electric potential unevenness | Optical memory | Transmitting property | CLN |
|---|---|---|---|---|---|---|---|---|
| Example 10 | A | A | B | A | A | A | A | C |

TABLE 19

| Kind and flow rate of gas | Lower injection-blocking layer | Photoconductive layer | Surface region layer: Change layer | Surface region layer: Surface layer |
|---|---|---|---|---|
| $SiH_4$ [mL/min (normal)] | 250 | 200 | 200→100→20 | 20 |
| $H_2$ [mL/min (normal)] | 750 | 1600 | | |
| $B_2H_6$ [ppm (with respect to $SiH_4$)] | | | 0→2000→50 | 50→1500→10 |
| $N_2$ [mL/min (normal)] | | | 0→100→150 | 150 |
| $CH_4$ [mL/min (normal)] | 500 | | 2→15→3 | 3→20→5 |
| NO [mL/min (normal)] | 6 | | 1 | 1→2→1 |
| $SiF_4$ [mL/min (normal)] | | | 1 | 1→4→1 |
| Support temperature [° C.] | 280 | 270 | 240 | 250 |
| Pressure [Pa] | 85 | 72 | 56 | 52 |
| RF power [W] | 300 | 600 | 280 | 250 |
| Thickness [μm] | 3 | 32 | 0.1 | 0.6 |

TABLE 20

| | Resolution | Chargeability | Residual potential | Sensitivity | Electric potential unevenness | Optical memory | Transmitting property | CLN |
|---|---|---|---|---|---|---|---|---|
| Example 11 | A | A | A | A | A | A | A | A |

Table 20 shows that as with Example 3. good results concerning all the properties were obtained even when the carbon atom content was caused to have two peaks of $1.0\times10^{20}$ atoms/cm$^3$ or more at the change layer portion and the surface layer portion.

EXAMPLE 12

In the same manner as in Example 3, a plasma CVD apparatus shown in FIG. 2 was used to sequentially superimpose deposition films under the conditions shown in Table 21 on an aluminum cylinder (support), which had a diameter of 84 mm and a length of 381 mm and was subjected to mirror finish, in order to provide a layer constitution composed of a lower injection-blocking layer, a photoconductive layer, a change layer, and a surface layer shown in FIG. 1C, to thereby produce a photosensitive member.

The photosensitive member was produced under the same conditions as in Example 3 except that the flow rate of an $SiH_4$ gas and the flow rate of an $N_2$ gas were kept nearly constant and the flow rate of a $CH_4$ gas was changed in the formation of the surface layer in such a manner that the carbon atom content would have a local maximum value.

The produced photosensitive member was evaluated in the same manner as in Example 3.

The local maximum values of the carbon atom content were $1.0\times10^{20}$ atoms/cm$^3$ and $2.2\times10^{20}$ atoms/cm$^3$ from the photoconductive layer side, and the local maximum values of the boron atom content were $7.1\times10^{18}$ atoms/cm$^3$ and $6.5\times10^{18}$ atoms/cm$^3$ from the photoconductive layer side. The interval between the local maximum values of the boron atom content was 400 nm. In addition, the amount of nitrogen in the surface layer represented by N/(Si+N) was 48 atm %.

Table 22 shows the evaluation results.

Figure 20:
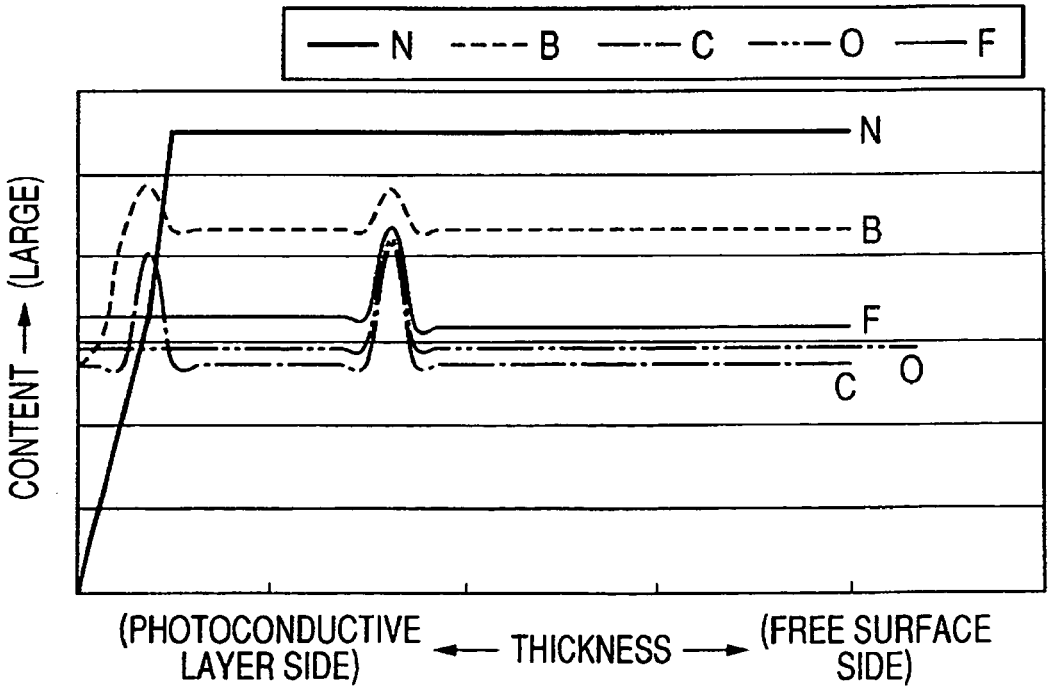
FIG. 20 shows a depth profile of a surface region layer of Example 12 in the present invention.

The content was adapted to have such local maximum values and distribution as shown in FIG. 20.

TABLE 21

| Kind and flow rate of gas | Lower injection-blocking layer | Photoconductive layer | Surface region layer: Change layer | Surface region layer: Surface layer |
|---|---|---|---|---|
| $SiH_4$ [mL/min (normal)] | 250 | 200 | 100 | 20 |
| $H_2$ [mL/min (normal)] | 750 | 1600 | | |
| $B_2H_6$ [ppm (with respect to $SiH_4$)] | | | 0→2000→50 | 50→1500→10 |
| $N_2$ [mL/min (normal)] | | | 100 | 150 |
| $CH_4$ [mL/min (normal)] | 500 | | 2→18→3 | 3→22→5 |
| NO [mL/min (normal)] | 6 | | 1 | 1→2→1 |
| $SiF_4$ [mL/min (normal)] | | | 1 | 1→4→1 |
| Support temperature [° C.] | 280 | 270 | 240 | 250 |
| Pressure [Pa] | 85 | 72 | 56 | 52 |
| RF power [W] | 300 | 600 | 280 | 250 |
| Thickness [μm] | 3 | 32 | 0.1 | 0.6 |

TABLE 22

| | Resolution | Chargeability | Residual potential | Sensitivity | Electric potential unevenness | Optical memory | Transmitting property | CLN |
|---|---|---|---|---|---|---|---|---|
| Example 12 | A | A | A | A | A | A | A | A |

Table 22 shows that as with Example 3, good results concerning all the properties were obtained by causing the content of a Group 13 element in the periodic table to have at least two peaks in the thickness direction of a film and causing each of a carbon atom content, an oxygen atom content, and a fluorine atom content to have a local maximum value even when the change layer was a constant layer.

EXAMPLE 13

In the same manner as in Example 3, a plasma CVD apparatus shown in FIG. 2 was used to sequentially superimpose deposition films under the conditions shown in Table 23 on an aluminum cylinder (support), which had a diameter of 84 mm and a length of 381 mm and was subjected to mirror finish, in order to provide a layer constitution composed of a lower injection-blocking layer, a photoconductive layer, a change layer, and a surface layer shown in FIG. 1C, to thereby produce a photosensitive member.

In that case, the layer constitution was the same as in Example 3 except that the lower injection-blocking layer was changed from an Si-based layer in Example 3 to an SiN-based layer.

Figure 21:
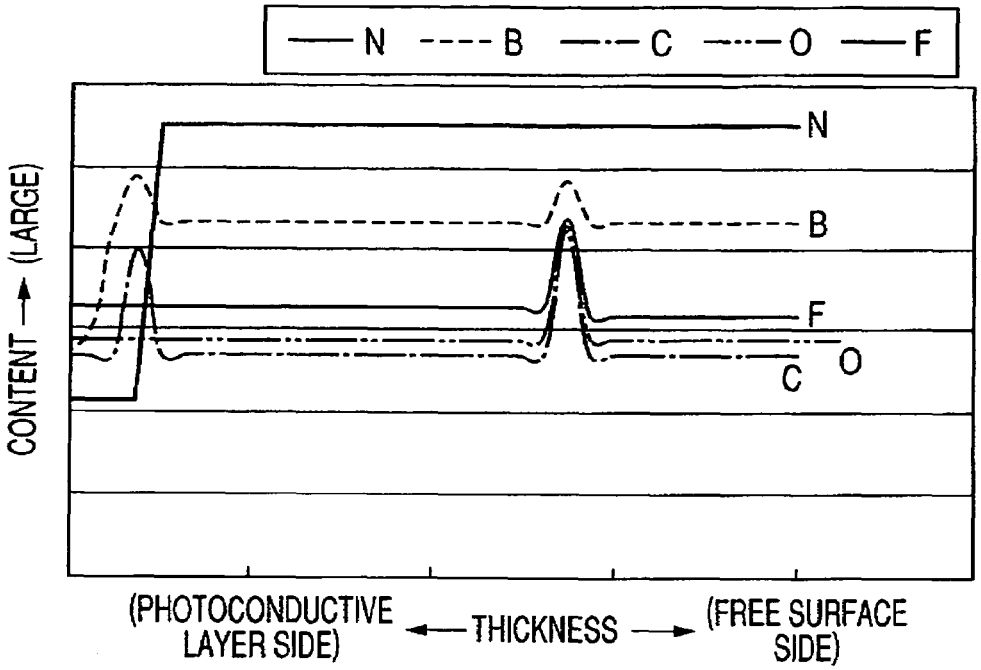
FIG. 21 shows a depth profile of a surface region layer of Example 13 in the present invention.

A gas flow rate was controlled in such a manner that a nitrogen content, a boron content, a fluorine content, an oxygen content, and a carbon content in the change layer would have distributions having local maximum values as shown in FIG. 21. Thus, the distributions shown in FIG. 21 were obtained.

The local maximum value of the carbon atom content was $2.8\times10^{20}$ atoms/cm$^3$, and the local maximum values of the boron atom content were $9.4\times10^{18}$ atoms/cm$^3$ and $5.2\times10^{18}$ atoms/cm$^3$ from the photoconductive layer side. The interval between the local maximum values of the boron atom content was 480 nm. In addition, the amount of nitrogen in the surface layer represented by N/(Si+N) was 58 atm %.

The produced photosensitive member was evaluated in the same manner as in Example 3.

Table 24 shows the evaluation results.

TABLE 23

| Kind and flow rate of gas | Lower injection-blocking layer | Photoconductive layer | Surface region layer: Change layer | Surface region layer: Surface layer |
|---|---|---|---|---|
| $SiH_4$ [mL/min (normal)] | 360 | 400 | 170→80→25 | 25 |
| $H_2$ [mL/min (normal)] | 800 | 2000 | | |
| $B_2H_6$ [ppm (with respect to $SiH_4$)] | | | 0→2500→80 | 80→1000→20 |
| $N_2$ [mL/min (normal)] | 450 | | 0→100→400 | 400 |
| $CH_4$ [mL/min (normal)] | | | 2 | 2→35→4 |
| NO [mL/min (normal)] | 5 | | 1 | 1→4→1 |
| $SiF_4$ [mL/min (normal)] | | | 1 | 1→5→1 |
| Support temperature [° C.] | 280 | 280 | 260 | 250 |
| Pressure [Pa] | 78 | 75 | 56 | 55 |
| RF power [W] | 300 | 750 | 280 | 300 |
| Thickness [μm] | 2.8 | 35 | 0.15 | 0.7 |

TABLE 24

| | Resolution | Chargeability | Residual potential | Sensitivity | Electric potential unevenness | Optical memory | Transmitting property | CLN |
|---|---|---|---|---|---|---|---|---|
| Example 13 | A | A | A | A | A | A | A | A |

Table 24 shows that as with Example 3, good results concerning-all the properties were obtained even when the lower injection-blocking layer was changed to an SiN-based layer.

EXAMPLE 14

A plasma CVD apparatus shown in FIG. 2 was used to sequentially superimpose deposition films under the conditions shown in Table 25 on an aluminum cylinder (support), which had a diameter of 84 mm and a length of 381 mm and was subjected to mirror finish, to thereby produce a photosensitive member having a surface region layer composed of a top injection-blocking layer (TBL-1), an intermediate layer, a top injection-blocking layer (TBL-2), and a surface protective layer (SL). All the lower injection-blocking layers and photoconductive layers were produced under the conditions shown in Table 25 as common conditions. Surface protective layers were produced under the conditions shown in Table 26 for the flow rate of an $SiH_4$ gas, the mixing ratio between $SiH_4$ and $N_2$, and electric energy per amount of an $SiH_4$ gas, and under the conditions shown in Table 25 for the others. Thus, photosensitive members 14A to 14H different from each other in nitrogen atom concentration in a surface protective layer were produced.

30 atm % or more, or more preferably 35 atm % or more, an additional effect is exhibited such that the photosensitive member is provided with sensitivity with respect to laser light having a wavelength as short as around 405 nm such as a blue light-emitting semiconductor laser.

On the other hand, as is apparent from Table 26, the photosensitive member 14G has large thickness unevenness, and it has been found to be desirable that the nitrogen concentration in a surface protective layer is not too high. From such a viewpoint, the nitrogen atom concentration in a surface protective layer has been found to be preferably 70 atm % or less, or more preferably 60 atm % or less.

TABLE 25

| Kind and flow rate of gas | Lower injection-blocking layer | Photoconductive layer | Surface region layer: TBL-1 | Intermediate layer | TBL-2 | SL |
|---|---|---|---|---|---|---|
| $SiH_4$ [mL/min (normal)] | 150 | 200 | 10 | 30 | 10 | 10 to 50 |
| $H_2$ [mL/min (normal)] | 600 | 1200 | — | — | — | — |
| $B_2H_6$ [ppm (with respect to $SiH_4$)] | — | — | 1000 | — | 500 | — |
| $N_2$ [mL/min (normal)] | — | — | 300 | 500 | 300 | 20 to 1000 |
| NO [% (with respect to $SiH_4$] | 8 | — | — | — | — | — |
| $CH_4$ [mL/min (normal)] | 600 | — | 10 | 10 | 50 | 10 |
| Support temperature [° C.] | 270 | 260 | 260 | 260 | 220 | 220 |
| Pressure [Pa] | 75 | 78 | 52 | 50 | 52 | 50 |
| RF power [W] | 150 | 400 | 200 | 300 | 200 | 150 to 300 |
| Thickness [μm] | 2 | 30 | 0.1 | 0.2 | 0.1 | 0.6 |

TABLE 26

| Photosensitive member | $SiH_4$ mL/min (normal) | $N_2$ mL/min (normal) | Power W | N/(Si + N) atm % | Sensitivity with respect to light having a wavelength of 405 nm (%) | Thickness unevenness of surface layer (%) |
|---|---|---|---|---|---|---|
| 14A | 50 | 300 | 300 | 28 | 25 | 11 |
| 14B | 50 | 500 | 250 | 36 | 41 | 10 |
| 14C | 50 | 1000 | 250 | 52 | 55 | 9 |
| 14D | 25 | 250 | 200 | 46 | 49 | 11 |
| 14E | 25 | 500 | 200 | 59 | 56 | 12 |
| 14F | 10 | 100 | 200 | 70 | 59 | 31 |
| 14G | 10 | 500 | 200 | 72 | 60 | 42 |
| 14H | 10 | 20 | 150 | 30 | 32 | 10 |

The photosensitive members 14A to 14H thus produced were evaluated in the same manner as in Example 1.

Table 26 shows the evaluation results.

In this Example as well, results similar to those of Example 1 were obtained. That is, it has been found that a photosensitive member preferably has sensitivity of 30% or more (more preferably 40% or more) as an index normalized on the basis of the peak value for the spectral sensitivity as shown in FIG. 6.

Accordingly, it has been revealed that if a nitrogen atom concentration in the surface protective layer of a photosensitive member having such sensitivity is set to be preferably

EXAMPLE 15

A plasma CVD apparatus shown in FIG. 2 was used to sequentially superimpose deposition films under the conditions shown in Table 27 on an aluminum cylinder (support), which had a diameter of 84 mm and a length of 381 mm and was subjected to mirror finish, to thereby produce a photosensitive member composed of a lower injection-blocking layer, a photoconductive layer, a top injection-blocking layer (TBL-1), an intermediate layer, a top injection-blocking layer (TBL-2), and a surface protective layer. All the lower injection-blocking layers and photoconductive layers were produced under the conditions shown in Table 27 as common conditions. Surface protective layers were produced under the conditions shown in Table 27 except for the flow rate of a $CH_4$ gas for which the condition shown in Table 28 was adopted. Thus, photosensitive members 15A to 15H different from each other in carbon atom concentration in a surface protective layer were produced. The photosensitive members 15A to 15H thus produced were evaluated in the same manner as in Example 2, where the photosensitive member 15A was used as a reference. Table 28 shows the measurement results.

As can be seen from the results, when incorporating a slight amount of carbon atoms, a residual potential resulting from a surface region layer can be reduced. As a result, an effect of exposure with light having a short wavelength is obtained, and hence an increase in resolution is achieved. On the other hand, sensitivity unevenness such as potential unevenness tends to increase as the amount of carbon atoms incorporated increases. In addition, the property of transmitting light having a somewhat short wavelength tends to be lowered. This is probably because the number of Si—C bonds increases.

TABLE 27

| Kind and flow rate of gas | Lower injection-blocking layer | Photoconductive layer | Surface region layer: TBL-1 | Surface region layer: Intermediate layer | Surface region layer: TBL-2 | Surface region layer: SL |
|---|---|---|---|---|---|---|
| $SiH_4$ [mL/min (normal)] | 150 | 200 | 10 | 30 | 10 | 50 |
| $H_2$ [mL/min (normal)] | 600 | 1200 | — | — | — | — |
| $B_2H_6$ [ppm (with respect to $SiH_4$)] | — | — | 1000 | — | 500 | — |
| $N_2$ [mL/min (normal)] | — | — | 300 | 500 | 300 | 500 |
| NO [% (with respect to $SiH_4$)] | 8 | — | — | — | — | — |
| $CH_4$ [mL/min (normal)] | 600 | — | 10 | 10 | 50 | (*) |
| Support temperature [° C.] | 270 | 260 | 260 | 260 | 220 | 220 |
| Pressure [Pa] | 75 | 78 | 52 | 50 | 52 | 50 |
| RF power [W] | 150 | 400 | 200 | 300 | 200 | 250 |
| Thickness [μm] | 2 | 30 | 0.1 | 0.2 | 0.1 | 0.6 |

(*) See table 28.

TABLE 28

| Photosensitive member | $CH_4$ mL/min (normal) | N/(Si + N) atm % | C atoms/cm$^3$ | Sensitivity with respect to light having a wavelength of 405 nm (%) | Residual potential | Electric potential unevenness |
|---|---|---|---|---|---|---|
| 15A | 0.1 | 33 | $9.0 \times 10^{16}$ (**) | 39% | C | C |
| 15B | 1 | 33 | $1.7 \times 10^{17}$ | 39% | C | C |
| 15C | 2 | 33 | $2.0 \times 10^{17}$ | 39% | B | B |
| 15D | 5 | 33 | $5.8 \times 10^{18}$ | 39% | B | B |
| 15E | 10 | 33 | $7.2 \times 10^{19}$ | 39% | B | B |
| 15F | 25 | 33 | $1.4 \times 10^{20}$ | 39% | B | B |
| 15G | 100 | 32 | $5.0 \times 10^{20}$ | 37% | B | B |
| 15H | 120 | 31 | $5.4 \times 10^{20}$ | 34% | B | C |

The measured value represented by (**) is probably a measurement limit.

EXAMPLE 16

A plasma CVD apparatus shown in FIG. 2 was used to sequentially superimpose deposition films under the conditions shown in Table 29 on an aluminum cylinder (support), which had a diameter of 84 mm and a length of 381 mm and was subjected to mirror finish, to thereby produce a photosensitive member composed of a lower injection-blocking layer, a photoconductive layer, and a surface region layer. As shown in Table 5, the surface region layer was composed of a first top injection-blocking layer (TBL-1), an intermediate layer, a second top injection-blocking layer (TBL-2), and a surface protective layer (SL). In addition, the amount of each of an $N_2$ gas, a $B_2H_6$ gas, and a $CH_4$ gas to be introduced was changed during the formation of the surface region layer.

The surface region layer of the produced photosensitive member was subjected to SIMS measurement in the same manner as in Example 1. The measurement showed that a nitrogen atom content, a boron atom content and a carbon atom content had peaks shown in FIG. 25B, FIG. 26E and FIG. 27B, respectively. The local maximum values of the nitrogen atom content represented by N/(Si+N) were 38 atm % and 43 atm % from the photoconductive layer side. The local maximum values of the boron atom content were $6.5\times10^{18}$ atoms/cm$^3$ and $2.1\times10^{18}$ atoms/cm$^3$ from the photoconductive layer side. The local maximum value of the carbon atom content was $1.0\times10^{20}$ atoms/cm$^3$. The interval between the local maximum value and minimum value of the nitrogen atom content was 150 nm. The interval between the local maximum values of the boron atom content was 300 nm.

TABLE 29

| Kind and flow rate of gas | Lower injection-blocking layer | Photoconductive layer | Surface region layer TBL-1 | Intermediate layer | TBL-2 | SL |
|---|---|---|---|---|---|---|
| $SiH_4$ [mL/min (normal)] | 170 | 170 | 10 | 30 | 10 | 30 |
| $H_2$ [mL/min (normal)] | 600 | 1000 | — | — | — | — |
| $B_2H_6$ [ppm (with respect to $SiH_4$)] | — | — | 1000 | — | 500 | — |
| $N_2$ [mL/min (normal)] | — | — | 300 | 500 | 300 | 580 |
| $CH_4$ [mL/min (normal)] | 300 | — | 5 | 5 | 18 | 5 |
| NO [% (with respect to $SiH_4$)] | 5 | — | 2 | 2 | 5 | 2 |
| $SiF_4$ [mL/min (normal)] | — | — | 8 | 8 | 20 | 8 |
| Support temperature [° C.] | 270 | 260 | 260 | 260 | 220 | 220 |
| Pressure [Pa] | 80 | 75 | 52 | 50 | 52 | 50 |
| RF power [W] | 200 | 40 | 200 | 300 | 200 | 300 |
| Thickness [μm] | 2.5 | 30 | 0.1 | 0.2 | 0.1 | 0.6 |

The resultant photosensitive member was set in the iRC6800-405 nm modified machine and evaluated in the same manner as in Example 3, where a photosensitive member in Comparative Example 2 described later was used as a reference. Table 32 shows the evaluation results.

COMPARATIVE EXAMPLE 2

In the same manner as in Example 16, deposition films were sequentially superimposed under the conditions shown in Table 30, to thereby produce a photosensitive member composed of a lower injection-blocking layer, a photoconductive layer, a top injection-blocking layer, and a surface layer. The produced photosensitive member was subjected to SIMS measurement in the same manner as in Example 1. The measurement showed that a nitrogen atom content and a boron atom content had peaks shown in FIG. 25E and FIG. 26F, respectively.

The produced photosensitive member was evaluated in the same manner as in Example 16. Table 32 shows the results.

TABLE 30

| Kind and flow rate of gas | Lower injection-blocking layer | Photo-conductive layer | Top injection-blocking layer | Surface |
|---|---|---|---|---|
| $SiH_4$ [mL/min (normal)] | 170 | 170 | 30 | 30 |
| $H_2$ [mL/min (normal)] | 600 | 1000 | — | — |
| $B_2H_6$ [ppm (with respect to $SiH_4$)] | — | — | 3000 | — |
| $N_2$ [mL/min (normal)] | — | — | 300 | 300 |
| $CH_4$ [mL/min (normal)] | 300 | — | — | — |
| NO [% (with respect to $SiH_4$)] | 5 | — | — | — |
| Support temperature [° C.] | 270 | 260 | 220 | 220 |
| Pressure [Pa] | 80 | 75 | 60 | 56 |
| RF power [W] | 200 | 400 | 180 | 180 |
| Thickness [μm] | 2.5 | 30 | 0.1 | 0.6 |

EXAMPLE 17

In the same manner as in Example 16, deposition films were sequentially superimposed under the conditions shown in Table 31, to thereby produce a photosensitive member composed of a lower injection-blocking layer, a photoconductive layer, and a surface region layer (a TBL-1, an intermediate layer, a TBL-2, and an SL). The photosensitive member was produced in the same manner as in Example 16 except that neither an NO gas nor an $SiF^4$ gas was used for the surface region layer. The surface region layer of the produced photosensitive member was subjected to SIMS measurement in the same manner as in Example 1. The measurement showed that a nitrogen atom content, a boron atom content, and a carbon atom content had peaks shown in FIG. 25B, FIG. 26E, and FIG. 27B, respectively. The local maximum values of the nitrogen atom content represented by N/(Si+N) were 38 atm % and 43 atm % from the photoconductive layer side. The local maximum values of the boron atom content were $6.5\times10^{18}$ atoms/cm$^3$ and $2.1\times10^{18}$ atoms/cm$^3$ from the photoconductive layer side. The local maximum value of the carbon atom content was $1.0\times10^{20}$ atoms/cm$^3$. The interval between the local maximum value and minimum value of the nitrogen atom content was 150 nm. The interval between the local maximum values of the boron atom content was 300 nm.

The produced photosensitive member was evaluated for photoelectric properties in the same manner as in Example 16. Table 32 shows the evaluation results together with Example 16 and Comparative Example 2.

TABLE 31

| Kind and flow rate of gas | Lower injection-blocking layer | Photoconductive layer | Surface region layer TBL-1 | Intermediate layer | TBL-2 | SL |
|---|---|---|---|---|---|---|
| $SiH_4$ [mL/min (normal)] | 170 | 170 | 10 | 30 | 10 | 30 |
| $H_2$ [mL/min (normal)] | 600 | 1000 | — | — | — | — |
| $B_2H_6$ [ppm (with respect to $SiH_4$)] | — | — | 1000 | — | 500 | — |
| $N_2$ [mL/min (normal)] | — | — | 300 | 500 | 300 | 580 |
| $CH_4$ [mL/min (normal)] | 3000 | — | 10 | 10 | 50 | 10 |
| NO [% (with respect to $SiH_4$)] | 5 | — | — | — | — | — |
| Support temperature [° C.] | 270 | 260 | 260 | 260 | 220 | 220 |
| Pressure [Pa] | 80 | 75 | 52 | 50 | 52 | 50 |
| RF power [W] | 200 | 400 | 200 | 300 | 200 | 300 |
| Thickness [μm] | 2.5 | 30 | 0.1 | 0.2 | 0.1 | 0.6 |

TABLE 32

| | Resolution | Chargeability | Residual potential | Sensitivity | Electric potential unevenness | Optical memory | Transmitting property | CLN | Image defect |
|---|---|---|---|---|---|---|---|---|---|
| Comparative Example 2 | C | C | C | C | C | C | C | C | C |
| Example 16 | A | A | A | A | A | A | A | A | A |
| Example 17 | B | A | B | A | A | B | A | B | A |

As is apparent from the above results, the resolution of an image of 1,200 dpi with blue light semiconductor laser (405 nm) was increased. It has been found that dot reproducibility can be improved by using a surface region layer such as a surface region layer in Example 3 in which the distributions of a boron atom content and a nitrogen atom content each have two local maximum values and the distributions of a carbon atom content, an oxygen atom content, and a fluorine atom content each have a local maximum value in the layer region on the surface side, and hence the original effect of reducing a spot diameter can be sufficiently exerted. It has been also found that the photosensitive member having the surface region layer in Example 16 has excellent photoelectric properties.

It has been also found that the resolution, reduction in residual electric potential, reduction in optical memory, and CLN property can be improved when the photosensitive member is produced in such a manner that the distributions of an oxygen atom content and a fluorine atom content each have a local maximum value.

EXAMPLE 18

In the same manner as in Example 16, deposition films were sequentially superimposed under the conditions shown in Table 33, to thereby produce a photosensitive member composed of a lower injection-blocking layer, a photoconductive layer, and a surface region layer (a TBL-1, an intermediate layer, a TBL-2, and an SL). Six kinds of photosensitive members were produced in the same manner as in Example 3 except that the flow rate of a $B_2H_6$ gas to be introduced into a surface region layer was changed. The surface region layer of each of the produced photosensitive members was subjected to SIMS measurement in the same manner as in Example 1. The measurement showed that a nitrogen atom content, a boron atom content, and a carbon atom content had peaks shown in FIG. 25B, FIG. 26C or 26B, and FIG. 27A, respectively. The local maximum values of the nitrogen atom content represented by N/(Si+N) were 38 atm % and 43 atm % from a photoconductive layer side. The local maximum value of the carbon atom content was $1.0\times10^{20}$ atoms/cm$^3$. The interval between the local maximum value and minimum value of the nitrogen atom content was 175 nm. The interval between the local maximum values of the boron atom content was 350 nm.

Each of the produced photosensitive members was evaluated for photoelectric properties in the same manner as in Example 16. Table 35 shows the evaluation results.

TABLE 33

| Kind and flow rate of gas | Lower injection-blocking layer | Photoconductive layer | Surface region layer TBL-1 | Intermediate layer | TBL-2 | SL |
|---|---|---|---|---|---|---|
| $SiH_4$ [mL/min (normal)] | 170 | 170 | 100 | 50 | 100 | 50 |
| $H_2$ [mL/min (normal)] | 600 | 1000 | — | — | — | — |
| $B_2H_6$ [ppm (with respect to $SiH_4$)] | — | — | Variable | Variable | Variable | — |
| $N_2$ [mL/min (normal)] | — | — | 800 | 1000 | 800 | 1100 |
| $CH_4$ [mL/min (normal)] | 300 | — | 2 | 2 | 20 | 4 |
| NO [% (with respect to $SiH_4$)] | 5 | — | 1 | 1 | 2 | 1 |
| $SiF_4$ [mL/min (normal)] | — | — | 1 | 1 | 4 | 1 |
| Support temperature [° C.] | 270 | 260 | 260 | 260 | 260 | 260 |
| Pressure [Pa] | 80 | 75 | 52 | 50 | 52 | 50 |
| RF power [W] | 200 | 400 | 250 | 200 | 250 | 200 |
| Thickness [μm] | 2.5 | 30 | 0.15 | 0.2 | 0.15 | 0.6 |

TABLE 34

Figure 25B:
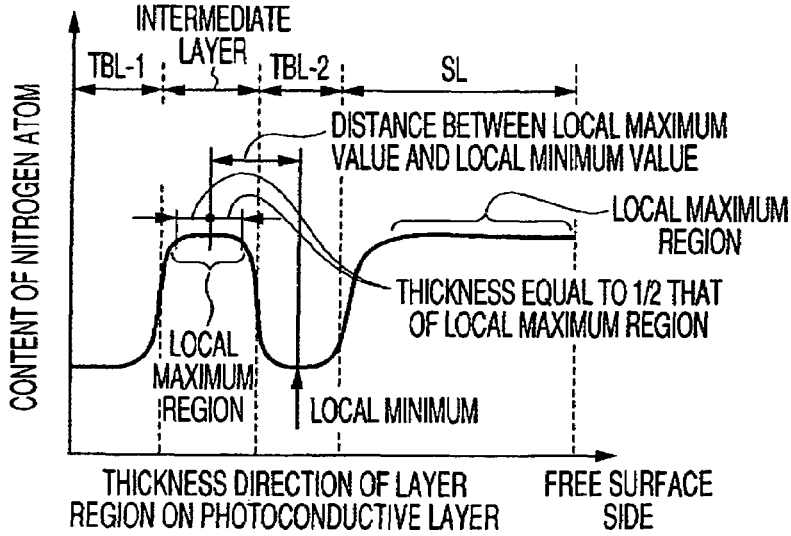
FIG. 25B is a view showing the content distribution of a nitrogen atom in the thickness direction of the surface region layer of an example of the electrophotographic photosensitive member of the present invention.
Figure 26C:
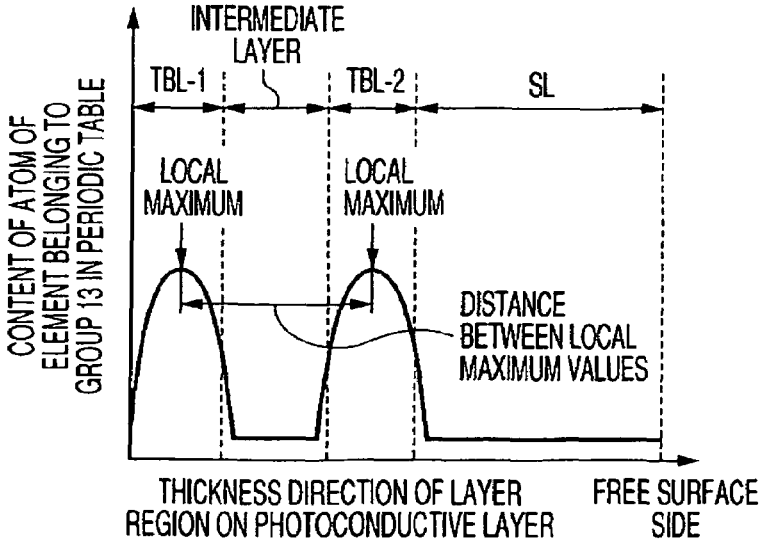
FIG. 26C is a view showing the content distribution of a Group 13 element in the periodic table in the thickness direction of the surface region layer of an example of the electrophotographic photosensitive member of the present invention.
Figure 26D:
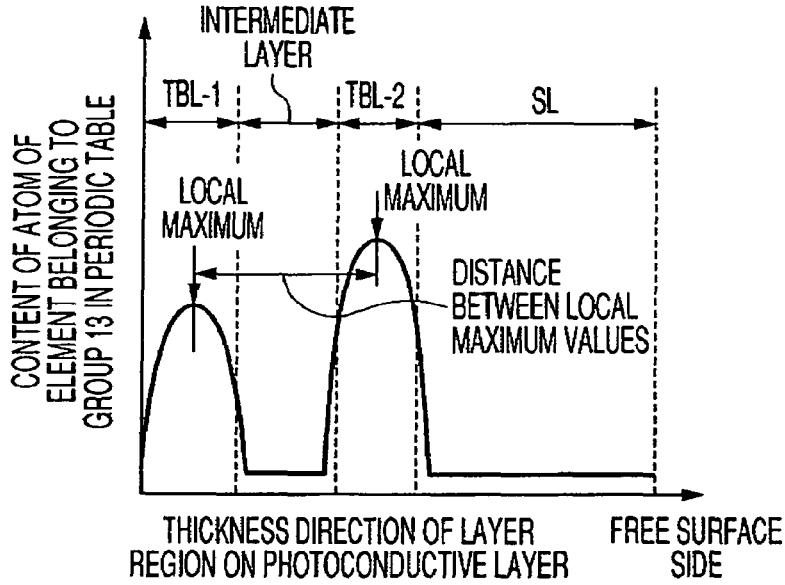
FIG. 26D is a view showing the content distribution of a Group 13 element in the periodic table in the thickness direction of the surface region layer of an example of the electrophotographic photosensitive member of the present invention.
Figure 26E:
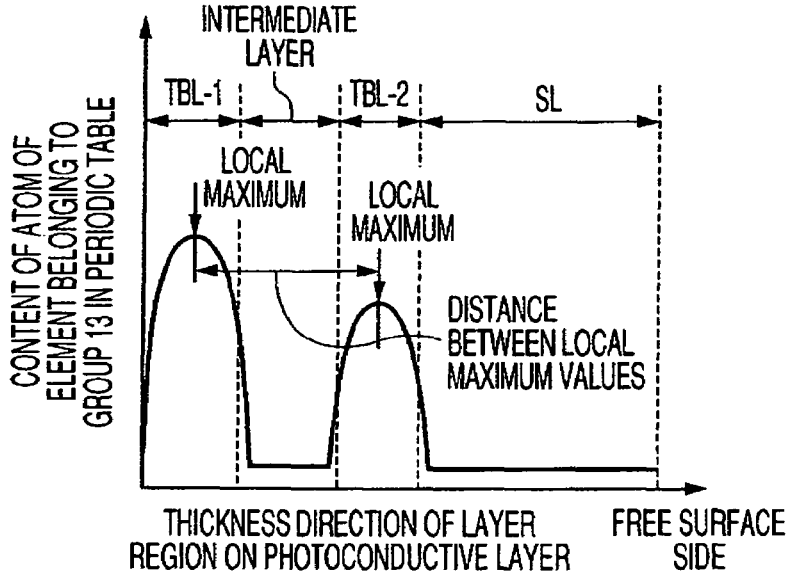
FIG. 26E is a view showing the content distribution of a Group 13 element in the periodic table in the thickness direction of the surface region layer of an example of the electrophotographic photosensitive member of the present invention.
Figure 26F:
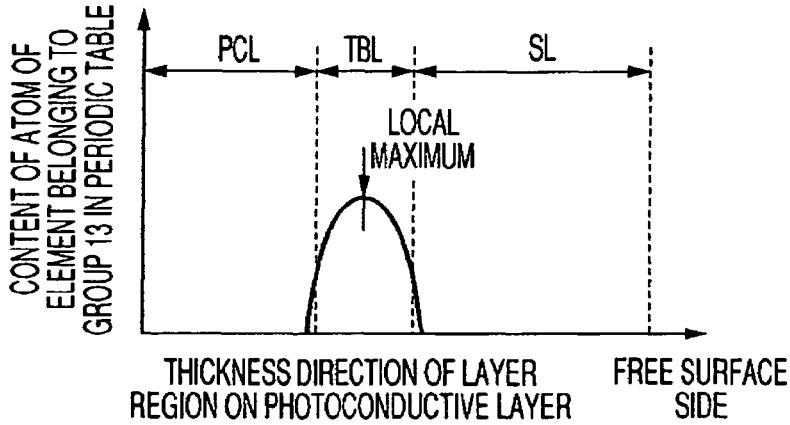
FIG. 26F is a view showing the content distribution of a Group 13 element in the periodic table in the thickness direction of the surface region layer of an electrophotographic photosensitive member of a comparative example.

| Photosensitive member | Local maximum value of boron atom content on photoconductive layer side ($\times 10^{18}/cm^3$) | Local minimum value of boron atom content between local maximum values of boron atom content ($\times 10^{18}/cm^3$) | Content distribution of nitrogen atom | Content distribution of boron atom | Content distribution of carbon atom |
|---|---|---|---|---|---|
| 18A | 5.5 | 2.0 | FIG. 25B | FIG. 26C | FIG. 27A |
| 18B | 5.0 | 2.0 | FIG. 25B | FIG. 26C | FIG. 27A |
| 18C | 4.5 | 2.0 | FIG. 25B | FIG. 26C | FIG. 27A |
| 18D | 5.5 | 2.5 | FIG. 25B | FIG. 26C | FIG. 27A |
| 18E | 5.5 | 3.0 | FIG. 25B | FIG. 26C | FIG. 27A |
| 18F | 5.5 | 3.0 | FIG. 25B | FIG. 26B | FIG. 27A |

TABLE 35

| Photosensitive member | Resolution | Chargeability | Residual potential | Sensitivity | Electric potential unevenness | Optical memory | Transmitting property | CLN | Image defect |
|---|---|---|---|---|---|---|---|---|---|
| 18A | B | A | A | A | A | A | A | A | A |
| 18B | B | A | A | A | A | A | A | A | A |
| 18C | C | C | A | A | A | A | A | A | A |
| 18D | C | B | A | A | A | A | A | A | A |
| 18E | C | C | A | A | A | A | A | A | A |
| 18F | B | A | A | A | A | A | A | A | A |

As is apparent from the above results, properties in terms of resolution and chargeability are additionally improved when the local maximum value of the content of an Group G element in the periodic table placed on the side closest to the photoconductive layer is $5.0\times10^{18}$ atoms/cm$^3$ or more. In addition, the additional improvement of chargeability is observed when the minimum value of the content of the Group 13 element in the periodic table present between two adjacent local maximum values of the Group 13 element in the periodic table is $2.5\times10^{18}$ atoms/cm$^3$ or less. It has been also found that even the case where the Group 13 element in the periodic table is incorporated in the form of a local maximum region provides photoelectric properties similar to those in the case where the element is incorporated in the form of a peak.

EXAMPLE 19

In the same manner as in Example 16, deposition films were sequentially superimposed under the conditions shown in Table 36, to thereby produce a photosensitive member composed of a lower injection-blocking layer, a photoconductive layer, and a surface region layer (a TBL-1, an intermediate layer, a TBL-2, and an SL). The photosensitive member was produced in the same manner as in Example 1 except that the flow rate of a $B_2H_6$ gas to be introduced into the surface region layer was changed. The surface region layer of the produced photosensitive member was subjected to SIMS measurement in the same manner as in Example 1. The measurement showed that the boron atom content had peaks shown in FIG. 26D. The local maximum values of the nitrogen atom content represented by N/(Si+N) were 38 atm % and 43 atm % from the photoconductive layer side. The local maximum values of the boron atom content were $4.0\times10^{18}$ atoms/cm$^3$ and $6.0\times10^{18}$ atoms/cm$^3$ from the photoconductive layer side. The local maximum value of the carbon atom content was $1.0\times10^{20}$ atoms/cm$^3$. The interval between the local maximum value and minimum value of the nitrogen atom content was 90 nm. The interval between the local maximum values of the boron atom content was 180 nm.

The produced photosensitive member was evaluated for photoelectric properties in the same manner as in Example 16. Table 37 shows the evaluation results.

As is apparent from the above results, properties, in particular, the reduction in electric potential unevenness, reduction in optical memory, transmitting property, CLN property, and reduction in image defects are improved even when a Group 13 element is incorporated into the surface region layer in such a manner that a local maximum value on the free surface side is larger between two local maximum values of the content of the element.

EXAMPLE 20

In the same manner as in Example 16, deposition films were sequentially superimposed under the conditions shown in Table 38, to thereby produce a photosensitive member composed of a lower injection-blocking layer, a photoconductive layer, and a surface region layer (a TBL-1, an intermediate layer, a TBL-2, and an SL). Five kinds of photosensitive members were produced in the same manner as in Example 16 except that: a time period for forming an intermediate layer in a surface region layer was changed; and the distance between two local maximum values of the content of a Group 13 element in the periodic table present in the surface region layer was changed. The surface region layer of each of the produced photosensitive members was subjected to SIMS measurement in the same manner as in Example 1. The local maximum values of the nitrogen atom content represented by N/(Si+N) were 38 atm % and 43 atm % from the photoconductive layer side. The local maximum values of the boron atom content were $6.5\times10^{18}$ atoms/cm$^3$ and $2.1\times10^{18}$ atoms/cm$^3$ from the photoconductive layer side. The local maximum value of the carbon atom content was $1.0\times10^{20}$ atoms/cm$^3$.

TABLE 36

| Kind and flow rate of gas | Lower injection-blocking layer | Photoconductive layer | Surface region layer: TBL-1 | Surface region layer: Intermediate layer | Surface region layer: TBL-2 | Surface region layer: SL |
|---|---|---|---|---|---|---|
| $SiH_4$ [mL/min (normal)] | 170 | 170 | 20 | 50 | 20 | 50 |
| $H_2$ [mL/min (normal)] | 600 | 1000 | — | — | — | — |
| $B_2H_6$ [ppm (with respect to $SiH_4$)] | — | — | 400 | — | 800 | — |
| $N_2$ [mL/min (normal)] | — | — | 300 | 1000 | 300 | 1200 |
| $CH_4$ [mL/min (normal)] | 300 | — | 2 | 2 | 20 | 4 |
| NO [% (with respect to $SiH_4$)] | 5 | — | 1 | 1 | 2 | 1 |
| $SiF_4$ [mL/min (normal)] | — | — | 1 | 1 | 4 | 1 |
| Support temperature [° C.] | 270 | 260 | 260 | 260 | 260 | 260 |
| Pressure [Pa] | 80 | 75 | 52 | 50 | 52 | 50 |
| RF power [W] | 200 | 400 | 180 | 200 | 180 | 200 |
| Thickness [μm] | 2.5 | 30 | 0.08 | 0.1 | 0.08 | 0.6 |

TABLE 37

| | Resolution | Chargeability | Residual potential | Sensitivity | Electric potential unevenness | Optical memory | Transmitting property | CLN | Image defect |
|---|---|---|---|---|---|---|---|---|---|
| Example 19 | B | B | B | B | A | A | A | A | A |

Each of the produced photosensitive members was evaluated for photoelectric properties in the same manner as in Example 3. Table 40 shows the evaluation results.

TABLE 38

| Kind and flow rate of gas | Lower injection-blocking layer | Photoconductive layer | Surface region layer: TBL-1 | Surface region layer: Intermediate layer | Surface region layer: TBL-2 | Surface region layer: SL |
|---|---|---|---|---|---|---|
| $SiH_4$ [mL/min (normal)] | 170 | 170 | 20 | 50 | 20 | 50 |
| $H_2$ [mL/min (normal)] | 600 | 1000 | — | — | — | — |
| $B_2H_6$ [ppm (with respect to $SiH_4$)] | — | — | 700 | — | 700 | — |
| $N_2$ [mL/min (normal)] | — | — | 500 | 1000 | 5000 | 1200 |
| $CH_4$ [mL/min (normal)] | 300 | — | 2 | 2 | 20 | 4 |
| NO [% (with respect to $SiH_4$)] | 5 | — | 1 | 1 | 2 | 1 |
| $SiF_4$ [mL/min (normal)] | — | — | 1 | 1 | 4 | 1 |
| Support temperature [° C.] | 270 | 260 | 260 | 260 | 220 | 220 |
| Pressure [Pa] | 80 | 75 | 52 | 50 | 52 | 50 |
| RF power [W] | 200 | 400 | 180 | 200 | 180 | 200 |
| Thickness [μm] | 2.5 | 30 | 0.07 | 0.01 to 1.0 | 0.07 | 0.6 |

TABLE 39

| | Photosensitive member: 20A | 20B | 20C | 20D | 20E |
|---|---|---|---|---|---|
| Distance between local maximum values of content of Group 13 element in periodic table (nm) | 80 | 100 | 500 | 1000 | 1070 |

TABLE 40

| Photosensitive member | Resolution | Chargeability | Residual potential | Sensitivity | Electric potential unevenness | Optical memory | Transmitting property | CLN | Image defect |
|---|---|---|---|---|---|---|---|---|---|
| 20A | B | B | B | B | A | A | A | A | A |
| 20B | A | A | A | A | A | A | A | A | A |
| 20C | A | A | A | A | A | A | A | A | A |
| 20D | A | A | A | A | A | A | A | A | A |
| 20E | B | C | B | B | A | A | A | A | A |

As is apparent from the above results, the distance between two local maximum values of the content of the Group 13 element in the periodic table present in the surface region layer is more preferably in the range of 100 nm to 1,000 nm in the thickness direction of the film in terms of resolution, chargeability, reduction in residual potential, and sensitivity.

EXAMPLE 21

In the same manner as in Example 16, deposition films were sequentially superimposed under the conditions shown in Table 41, to thereby produce a photosensitive member composed of a lower injection-blocking layer, a photoconductive layer, and a surface region layer (a TBL-1, an intermediate layer, a TBL-2, and an SL). Five kinds of photosensitive members were produced in the same manner as in Example 16 except that: the flow rate of an $N_2$ gas to be introduced into the intermediate layer of the surface region layer was changed; and the ratio of the local maximum value to the minimum value of the content of nitrogen atoms present in the surface region layer (local maximum value/minimum value) and the distribution of the content of nitrogen atoms were changed as shown in Table 42. The surface region layer of each of the produced photosensitive members was subjected to SIMS measurement in the same manner as in Example 1. The local maximum values of the nitrogen atom content represented by N/(Si+N) were 38 atm % and 43 atm % from the photoconductive layer side. The local maximum values of the boron atom content were $6.5\times10^{18}$ atoms/cm$^3$ and $2.1\times10^{18}$ atoms/cm$^3$ from the photoconductive layer side. The local maximum value of the carbon atom content was $1.0\times10^{20}$ atoms/cm$^3$. The interval between the local maximum value and minimum value of the nitrogen atom content was 150 nm. The interval between the local maximum values of the boron atom content was 300 nm.

Each of the produced photosensitive members was evaluated for photoelectric properties in the same manner as in Example 16. Table 43 shows the evaluation results.

TABLE 41

| Kind and flow rate of gas | Lower injection-blocking layer | Photoconductive layer | Surface region layer TBL-1 | Intermediate layer | TBL-2 | SL |
|---|---|---|---|---|---|---|
| $SiH_4$ [mL/min (normal)] | 170 | 170 | 20 | 50 | 20 | 50 |
| $H_2$ [mL/min (normal)] | 600 | 1000 | — | — | — | — |
| $B_2H_6$ [ppm (with respect to $SiH_4$)] | — | — | 1000 | — | 1000 | — |
| $N_2$ [mL/min (normal)] | — | — | 600 | Variable | 600 | 1000 |
| $CH_4$ [mL/min (normal)] | 300 | — | 10 | 10 | 50 | 10 |
| NO [% (with respect to $SiH_4$)] | 5 | — | 2 | 2 | 5 | 2 |
| $SiF_4$ [mL/min (normal)] | — | — | 8 | 8 | 20 | 8 |
| Support temperature [° C.] | 270 | 260 | 260 | 260 | 220 | 220 |
| Pressure [Pa] | 80 | 75 | 52 | 50 | 52 | 50 |
| RF power [W] | 200 | 400 | 200 | 300 | 200 | 300 |
| Thickness [μm] | 2.5 | 30 | 0.1 | 0.2 | 0.1 | 0.6 |

TABLE 42

Figure 25C:
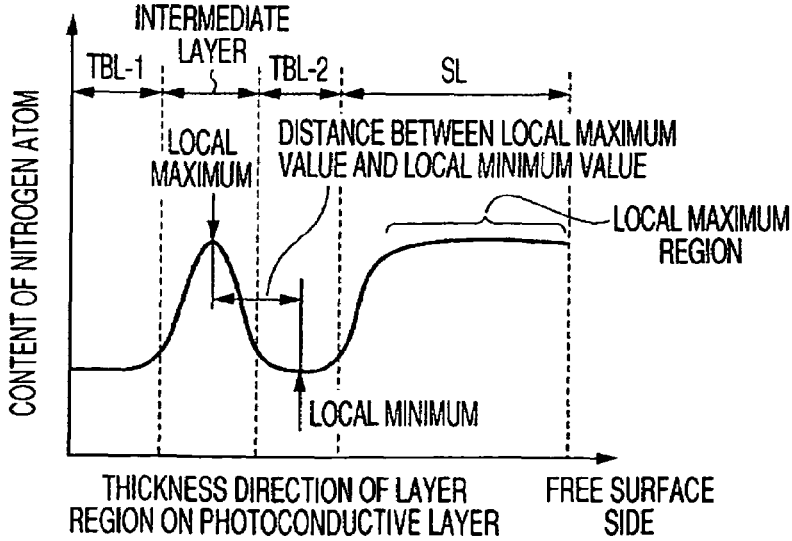
FIG. 25C is a view showing the content distribution of a nitrogen atom in the thickness direction of the surface region layer of an example of the electrophotographic photosensitive member of the present invention.
Figure 25D:
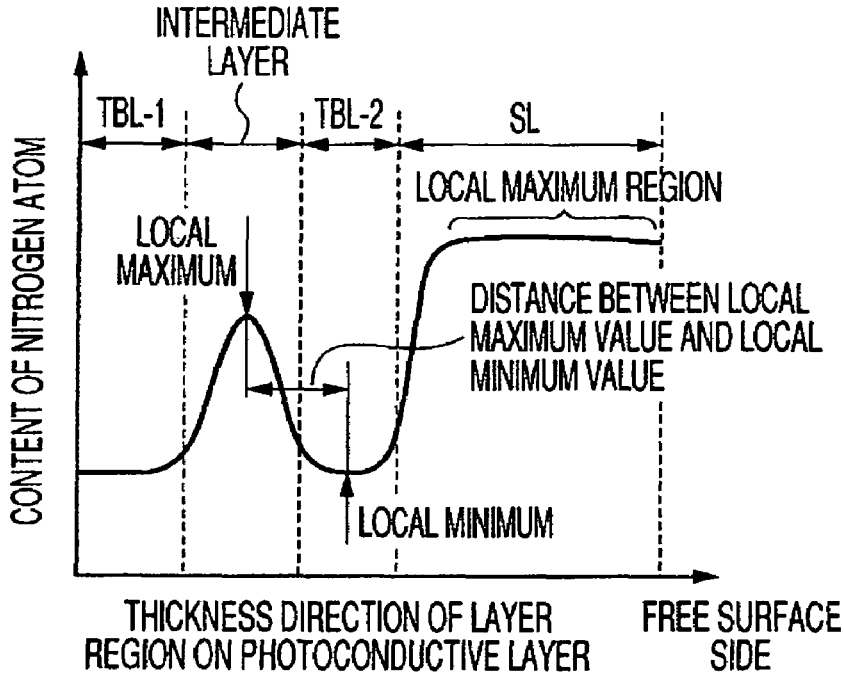
FIG. 25D is a view showing the content distribution of a nitrogen atom in the thickness direction of the surface region layer of an example of the electrophotographic photosensitive member of the present invention.
Figure 25E:
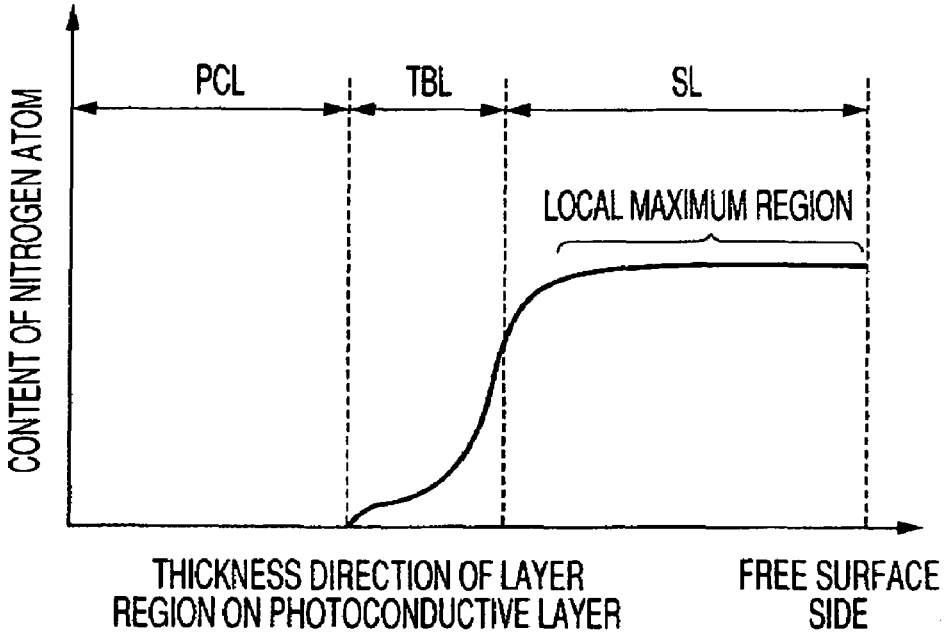
FIG. 25E is a view showing the content distribution of a nitrogen atom in the thickness direction of the surface region layer of an electrophotographic photosensitive member of a comparative example.
Figure 27B:
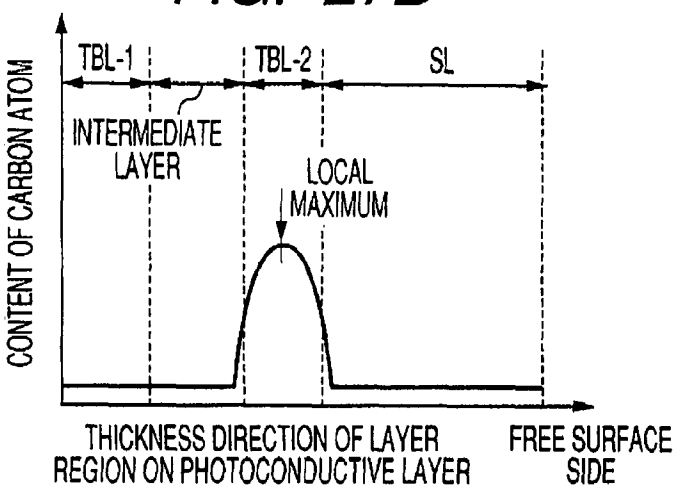
FIG. 27B is a view showing the content distribution of a carbon atom in the thickness direction of the surface region layer of an example of the electrophotographic photosensitive member of the present invention.
Figure 27C:
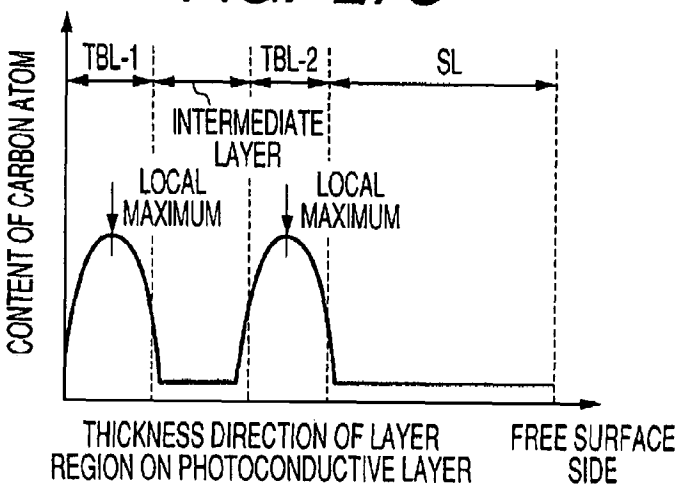
FIG. 27C is a view showing the content distribution of a carbon atom in the thickness direction of the surface region layer of an example of the electrophotographic photosensitive member of the present invention.
Figure 27D:
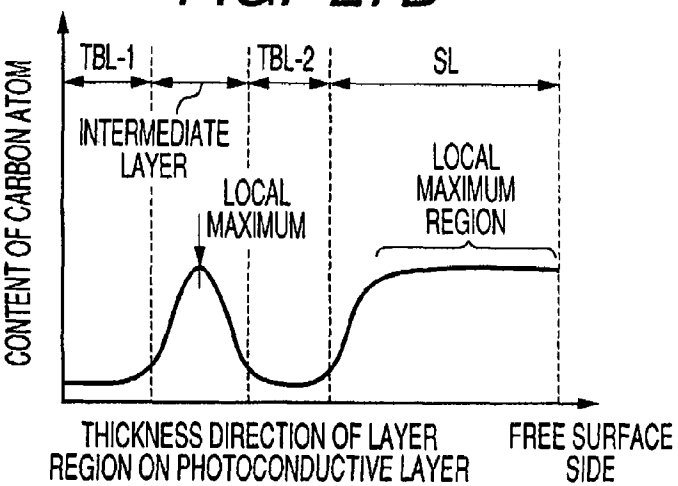
FIG. 27D is a view showing the content distribution of a carbon atom in the thickness direction of the surface region layer of an example of the electrophotographic photosensitive member of the present invention.

| Photo-sensitive member | Ratio of local maximum value of nitrogen atom content to minimum value of the content (%) | Content distribution of nitrogen atom | Content distribution of boron atom | Content distribution of carbon atom |
|---|---|---|---|---|
| 21A | 105 | FIG. 25C | FIG. 26C | FIG. 27B |
| 21B | 110 | FIG. 25C | FIG. 26C | FIG. 27B |
| 21C | 120 | FIG. 25C | FIG. 26C | FIG. 27B |
| 21D | 130 | FIG. 25C | FIG. 26C | FIG. 27B |
| 21E | 120 | FIG. 25B | FIG. 26C | FIG. 27B |

TABLE 43

| Photosensitive member | Resolution | Chargeability | Residual potential | Sensitivity | Electric potential unevenness | Optical memory | Transmitting property | CLN | Image defect |
|---|---|---|---|---|---|---|---|---|---|
| 21A | A | A | A | A | A | A | A | A | C |
| 21B | A | A | A | A | A | A | A | A | A |
| 21C | A | A | A | A | A | A | A | A | A |
| 21D | A | A | A | A | A | A | A | A | A |
| 21E | A | A | A | A | A | A | A | A | A |

As is apparent from the above results, the ratio of the local maximum value to the minimum value of the content of nitrogen atoms present in the surface region layer is more preferably 1.10 or more in terms of reduction in image defects. It has been also found that even the case where nitrogen atoms are incorporated in the form of a local maximum region having a certain portion provides an effect similar to the case where it is incorporated in the form of a peak.

EXAMPLE 22

In the same manner as in Example 16, deposition films were sequentially superimposed under the conditions shown in Table 44, to thereby produce a photosensitive member composed of a lower injection-blocking layer, a photoconductive layer, and a surface region layer (a TBL-1, an intermediate layer, a TBL-2, and an SL). Six kinds of photosensitive members were produced in the same manner as in Example 16 except that: time periods for forming the intermediate layer and the second top injection-blocking layer (TBL-2) in the surface region layer were changed; and the distance between the minimum value between two adjacent local maximum values of the nitrogen atom content and the local maximum value on the photoconductive layer side was changed. The surface region layer of each of the produced photosensitive members was subjected to SIMS measurement in the same manner as in Example 1. The local maximum values of the nitrogen atom content represented by N/(Si+N) were 38 atm % and 43 atm % from the photoconductive layer side. The local maximum values of the boron atom content were $6.5\times10^{18}$ atoms/cm$^3$ and $2.1\times10^{18}$ atoms/cm$^3$ from the photoconductive layer side. The local maximum value of the carbon atom content was $1.0\times10^{20}$ atoms/cm$^3$.

Each of the produced photosensitive members was evaluated for photoelectric properties in the same manner as in Example 16. Table 46 shows the evaluation results.

TABLE 44

| Kind and flow rate of gas | Lower injection-blocking layer | Photoconductive layer | Surface region layer: TBL-1 | Surface region layer: Intermediate layer | Surface region layer: TBL-2 | Surface region layer: SL |
|---|---|---|---|---|---|---|
| $SiH_4$ [mL/min (normal)] | 170 | 170 | 20 | 50 | 20 | 50 |
| $H_2$ [mL/min (normal)] | 600 | 1000 | — | — | — | — |
| $B_2H_6$ [ppm (with respect to $SiH_4$)] | — | — | 1000 | — | 1000 | — |
| $N_2$ [mL/min (normal)] | — | — | 400 | 600 | 400 | 600 |
| $CH_4$ [mL/min (normal)] | 300 | — | 10 | 10 | 50 | 10 |
| NO [% (with respect to $SiH_4$)] | 5 | — | 4 | 4 | 8 | 4 |
| $SiF_4$ [mL/min (normal)] | — | — | 6 | 6 | 15 | 6 |
| Support temperature [° C.] | 270 | 260 | 220 | 220 | 220 | 220 |
| Pressure [Pa] | 80 | 75 | 60 | 56 | 60 | 56 |
| RF power [W] | 200 | 400 | 180 | 180 | 180 | 180 |
| Thickness [μm] | 2.5 | 30 | 0.08 | * | * | 0.7 |

* The thickness of each layer was changed by adjusting a time period for forming the layer in such a manner that the distance between a local maximum value on the photoconductive layer side and a minimum value between the local maximum value and a local minimum value adjacent thereto would be a value shown in Table 45.

TABLE 45

| | Photosensitive member: 22A | 22B | 22C | 22D | 22E | 22F |
|---|---|---|---|---|---|---|
| Distance between local maximum value and minimum value of nitrogen atom content (nm) | 20 | 40 | 100 | 200 | 300 | 310 |

TABLE 46

| Photosensitive member | Resolution | Chargeability | Residual potential | Sensitivity | Electric potential unevenness | Optical memory | Transmitting property | CLN | Image defect |
|---|---|---|---|---|---|---|---|---|---|
| 22A | B | B | B | B | A | A | A | A | B |
| 22B | A | A | A | A | A | A | A | A | A |
| 22C | A | A | A | A | A | A | A | A | A |
| 22D | A | A | A | A | A | A | A | A | A |
| 22E | A | A | A | A | A | A | A | A | A |
| 22F | A | A | A | A | A | A | A | A | B |

As is apparent from the above results, the distance between the minimum value between two adjacent local maximum values of the content of nitrogen atoms present in the surface region layer and the local maximum value on the photoconductive layer side is more preferably in the range of 40 nm to 300 nm in the thickness direction of the film from the viewpoint of reduction in image defects.

EXAMPLE 23

In the same manner as in Example 16, deposition films were sequentially superimposed under the conditions shown in Table 47, to thereby produce a photosensitive member composed of a lower injection-blocking layer, a photoconductive layer, and a surface region layer (a TBL-1, an intermediate layer, a TBL-2, and an SL). The photosensitive member was produced in the same manner as in Example 16 except that: the flow rate of a $B_2H_6$ gas to be introduced into the surface region layer was changed; a Group 13 element in the periodic table was incorporated into the entire region of the surface region layer; and the Group 13 element in the periodic table was caused to have two local maximum values. The surface region layer of the produced photosensitive member was subjected to SIMS measurement in the same manner as in Example 1. The measurement showed that the boron atom content had peaks shown in FIG. 26C.

The local maximum values of the nitrogen atom content represented by N/(Si+N) were 38 atm % and 43 atm % from the photoconductive layer side. The local maximum values of the boron atom content were $6.5\times10^{18}$ atoms/cm$^3$ and $2.1\times10^{18}$ atoms/cm$^3$ from the photoconductive layer side. The local maximum value of the carbon atom content was $1.0\times10^{20}$ atoms/cm$^3$. The interval between the local maximum values of the nitrogen atom content was 150 nm. The interval between the local maximum values of the boron atom content was 300 nm.

The produced photosensitive member was evaluated for photoelectric properties in the same manner as in Example 16. Table 48 shows the evaluation results.

TABLE 47

| Kind and flow rate of gas | Lower injection-blocking layer | Photoconductive layer | Surface region layer TBL-1 | Intermediate layer | TBL-2 | SL |
|---|---|---|---|---|---|---|
| $SiH_4$ [mL/min (normal)] | 170 | 170 | 20 | 50 | 20 | 50 |
| $H_2$ [mL/min (normal)] | 600 | 1000 | — | — | — | — |
| $B_2H_6$ [ppm (with respect to $SiH_4$)] | — | — | 1000 | 400 | 1000 | 400 |
| $N_2$ [mL/min (normal)] | — | — | 400 | 600 | 400 | 650 |
| $CH_4$ [mL/min (normal)] | 300 | — | 10 | 10 | 50 | 10 |
| NO [% (with respect to $SiH_4$)] | 5 | — | 4 | 4 | 8 | 4 |
| $SiF_4$ [mL/min (normal)] | — | — | 6 | 6 | 15 | 6 |
| Support temperature [° C.] | 270 | 260 | 220 | 220 | 220 | 220 |
| Pressure [Pa] | 80 | 75 | 60 | 56 | 60 | 56 |
| RF power [W] | 200 | 400 | 180 | 180 | 180 | 180 |
| Thickness [μm] | 2.5 | 30 | 0.1 | 0.2 | 0.1 | 0.6 |

TABLE 48

| | Resolution | Chargeability | Residual potential | Sensitivity | Electric potential unevenness | Optical memory | Transmitting property | CLN | Image defect |
|---|---|---|---|---|---|---|---|---|---|
| Example 23 | A | A | A | A | A | A | A | A | A |

As is apparent from the above results, photoelectric properties were improved at all the evaluated items even when the Group 13 element 13 in the periodic table was incorporated into the entirety of the surface region layer and caused to have two local maximum values.

EXAMPLE 24

In the same manner as in Example 16, deposition films were sequentially superimposed under the conditions shown in Table 49, to thereby produce a photosensitive member composed of a lower injection-blocking layer, a photoconductive layer, and a surface region layer (a TBL-1, an intermediate layer, a TBL-2, and an SL). The photosensitive member was produced in the same manner as in Example 16 except that: the flow rate of each of an $N_2$ gas and a $B_2H_6$ gas to be introduced into the surface region layer was changed; and the nitrogen atom content and the content of a Group 13 element in the periodic table in the surface region layer were caused to have peaks in an identical phase. The surface region layer of the produced photosensitive member was subjected to SIMS measurement in the same manner as in Example 1. The measurement showed that the nitrogen atom content and the boron atom content had peaks shown in FIG. 24. The local maximum values of the nitrogen atom content represented by N/(Si+N) were 38 atm % and 43 atm % from a photoconductive layer side. The local maximum values of the boron atom content were $6.5\times10^{18}$ atoms/cm$^3$ and $2.1\times10^{18}$ atoms/cm$^3$ from the photoconductive layer side. The local maximum value of the carbon atom content was $1.0\times10^{20}$ atoms/cm$^3$. The interval between the local maximum value and minimum value of the nitrogen atom content was 150 nm. The interval between the local maximum values of the boron atom content was 500 nm.

The produced photosensitive member was evaluated for photoelectric properties in the same manner as in Example 16. Table 50 shows the evaluation results.

TABLE 49

| Kind and flow rate of gas | Lower injection-blocking layer | Photoconductive layer | Surface region layer TBL-1 | Intermediate layer | TBL-2 | SL |
|---|---|---|---|---|---|---|
| $SiH_4$ [mL/min (normal)] | 170 | 170 | 20 | 50 | 20 | 50 |
| $H_2$ [mL/min (normal)] | 600 | 1000 | — | — | — | — |
| $B_2H_6$ [ppm (with respect to $SiH_4$)] | — | — | 200 | 400 | 200 | 400 |
| $N_2$ [mL/min (normal)] | — | — | 300 | 600 | 300 | 600 |
| $CH_4$ [mL/min (normal)] | 300 | — | 10 | 10 | 50 | 10 |
| NO [% (with respect to $SiH_4$)] | 5 | — | 4 | 4 | 8 | 4 |

TABLE 49-continued

| Kind and flow rate of gas | Lower injection-blocking layer | Photoconductive layer | Surface region layer TBL-1 | Intermediate layer | TBL-2 | SL |
|---|---|---|---|---|---|---|
| $SiF_4$ [mL/min (normal)] | — | — | 6 | 6 | 15 | 6 |
| Support temperature [° C.] | 270 | 260 | 220 | 220 | 220 | 220 |
| Pressure [Pa] | 80 | 75 | 60 | 56 | 60 | 56 |
| RF power [W] | 200 | 400 | 180 | 180 | 180 | 180 |
| Thickness [μm] | 2.5 | 30 | 0.1 | 0.2 | 0.1 | 0.6 |

TABLE 50

| | Resolution | Chargeability | Residual potential | Sensitivity | Electric potential unevenness | Optical memory | Transmitting property | CLN | Image defect |
|---|---|---|---|---|---|---|---|---|---|
| Example 24 | A | A | A | A | A | A | A | A | C |

As is apparent from the above result, properties except a reduction in image defects were improved when the content of the Group 13 element in the periodic table and the nitrogen atom content in the surface region layer had peaks at an identical phase.

EXAMPLE 25

In the same manner as in Example 16, deposition films were sequentially superimposed under the conditions shown in Table 51, to thereby produce a photosensitive member composed of a lower injection-blocking layer, a photoconductive layer, and a surface region layer (a TBL-1, an intermediate layer, a TBL-2, and an SL). Four kinds of photosensitive members were produced in the same manner as in Example 16 except that the flow rate of a $CH_4$ gas to be introduced into a top charge injection-blocking layer (TBL-2) on the surface protective layer (SL) side was changed in such a manner that the local maximum value of the carbon atom content in the surface region layer would be varied. The surface region layer of each of the produced photosensitive members was subjected to SIMS measurement in the same manner as in Example 1. The local maximum values of the nitrogen atom content represented by N/(Si+N) were 38 atm % and 43 atm % from the photoconductive layer side. The local maximum values of the boron atom content were $6.5\times10^{18}$ atoms/cm$^3$ and $2.1\times10^{18}$ atoms/cm$^3$ from the photoconductive layer side. The local maximum value of the carbon atom content was $1.0\times10^{20}$ atoms/cm$^3$. The interval between the local maximum value and minimum value of the nitrogen atom content was 150 nm. The interval between the local maximum values of the boron atom content was 300 nm.

Each of the produced photosensitive members was evaluated for photoelectric properties in the same manner as in Example 16. Table 53 shows the evaluation results.

TABLE 51

| Kind and flow rate of gas | Lower injection-blocking layer | Photoconductive layer | Surface region layer TBL-1 | Intermediate layer | TBL-2 | SL |
|---|---|---|---|---|---|---|
| $SiH_4$ [mL/min (normal)] | 170 | 170 | 20 | 50 | 20 | 50 |
| $H_2$ [mL/min (normal)] | 600 | 1000 | — | — | — | — |
| $B_2H_6$ [ppm (with respect to $SiH_4$)] | — | — | 1000 | — | 500 | — |
| $N_2$ [mL/min (normal)] | — | — | 300 | 600 | 300 | 650 |
| $CH_4$ [mL/min (normal)] | 300 | — | 10 | 10 | Variable | 10 |
| NO [% (with respect to $SiH_4$)] | 5 | — | 4 | 4 | 8 | 4 |
| $SiF_4$ [mL/min (normal)] | — | — | 6 | 6 | 15 | 6 |
| Support temperature [° C.] | 270 | 260 | 220 | 220 | 220 | 220 |
| Pressure [Pa] | 80 | 75 | 60 | 56 | 60 | 56 |
| RF power [W] | 200 | 400 | 180 | 180 | 180 | 180 |
| Thickness [μm] | 2.5 | 30 | 0.1 | 0.2 | 0.1 | 0.6 |

TABLE 52

| | Photosensitive member | | | |
|---|---|---|---|---|
| | 25A | 25B | 25C | 25D |
| Local maximum value of carbon atom content (atoms/cm$^3$) | $1.5 \times 10^{17}$ | $2.5 \times 10^{17}$ | $4.6 \times 10^{18}$ | $8.3 \times 10^{19}$ |

TABLE 53

| Photosensitive member | Resolution | Chargeability | Residual potential | Sensitivity | Electric potential unevenness | Optical memory | Transmitting property | CLN | Image defect |
|---|---|---|---|---|---|---|---|---|---|
| 25A | A | A | B | A | A | A | A | C | A |
| 25B | A | A | A | A | A | A | A | A | A |
| 25C | A | A | A | A | A | A | A | A | A |
| 25D | A | A | A | A | A | A | A | A | A |

As is apparent from the above results, two local maximum values of the content of carbon atoms present in the surface region layer are each more preferably $2.5\times10^{18}$ atoms/cm$^3$ or more from the viewpoint of reduction in residual potential and the CLN property.

EXAMPLE 26

In the same manner as in Example 16, deposition films were sequentially superimposed under the conditions shown in Table 54, to thereby produce a photosensitive member composed of a lower injection-blocking layer, a photoconductive layer, and a surface region layer (a TBL-1, an intermediate layer, a TBL-2, and an SL). The photosensitive member was produced in the same manner as in Example 16 except that the flow rate of a $CH_4$ gas to be introduced into the surface region layer and a time period for forming a film were changed in such a manner that two local maximum values would be present. The surface region layer of the produced photosensitive member was subjected to SIMS measurement in the same manner as in Example 1. The measurement showed that the carbon atom content had peaks shown in FIG. 27C. The local maximum values of the nitrogen atom content represented by N/(Si+N) were 38 atm % and 43 atm % from the photoconductive layer side. The local maximum values of the boron atom content were $6.5\times10^{18}$ atoms/cm$^3$ and $2.1\times10^{18}$ atoms/cm$^3$ from the photoconductive layer side. The local maximum values of the carbon atom content were $1.1\times10^{20}$ atoms/cm$^3$ and $1.5\times10^{20}$ atoms/cm$^3$ from the photoconductive layer side. The interval between the local maximum value and minimum value of the nitrogen atom content was 150 nm. The interval between the local maximum values of the boron atom content was 300 nm.

The produced photosensitive member was evaluated for photoelectric properties in the same manner as in Example 16. Table 55 shows the evaluation results.

TABLE 54

| Kind and flow rate of gas | Lower injection-blocking layer | Photoconductive layer | Surface region layer: TBL-1 | Surface region layer: Intermediate layer | Surface region layer: TBL-2 | Surface region layer: SL |
|---|---|---|---|---|---|---|
| $SiH_4$ [mL/min (normal)] | 170 | 170 | 20 | 50 | 20 | 50 |
| $H_2$ [mL/min (normal)] | 600 | 1000 | — | — | — | — |
| $B_2H_6$ [ppm (with respect to $SiH_4$)] | — | — | 1000 | — | 1000 | — |
| $N_2$ [mL/min (normal)] | — | — | 300 | 600 | 300 | 650 |
| $CH_4$ [mL/min (normal)] | 300 | — | 50 | 10 | 50 | 10 |
| NO [% (with respect to $SiH_4$)] | 5 | — | 4 | 4 | 8 | 4 |
| $SiF_4$ [mL/min (normal)] | — | — | 6 | 6 | 15 | 6 |
| Support temperature [° C.] | 270 | 260 | 220 | 220 | 220 | 220 |
| Pressure [Pa] | 80 | 75 | 60 | 56 | 60 | 56 |
| RF power [W] | 200 | 400 | 180 | 180 | 180 | 180 |
| Thickness [μm] | 2.5 | 30 | 0.1 | 0.2 | 0.1 | 0.6 |

TABLE 55

| | Resolution | Chargeability | Residual potential | Sensitivity | Electric potential unevenness | Optical memory | Transmitting property | CLN | Image defect |
|---|---|---|---|---|---|---|---|---|---|
| Example 26 | A | A | A | A | A | A | A | A | A |

As is apparent from the above results, properties were improved in all the evaluated items even in the case of the photosensitive member in which the carbon atom content in the surface region layer had two local maximum values.

EXAMPLE 27

In the same manner as in Example 16, deposition films were sequentially superimposed under the conditions shown in Table 56, to thereby produce a photosensitive member composed of a lower injection-blocking layer, a photoconductive layer, and a surface region layer (a TBL-1, an intermediate layer, a TBL-2, and an SL). The photosensitive member was produced in the same manner as in Example 16 except that: the flow rate of an $N_2$ gas to be introduced into the lower injection-blocking layer was changed; and nitrogen atoms were introduced into the lower injection-blocking layer. The surface region layer of the produced photosensitive member was subjected to SIMS measurement in the same manner as in Example 1. The local maximum values of the nitrogen atom content represented by N/(Si+N) were 38 atm % and 43 atm % from the photoconductive layer side. The local maximum values of the boron atom content were $6.5\times10^{18}$ atoms/cm$^3$ and $2.1\times10^{18}$ atoms/cm$^3$ from the photoconductive layer side. The local maximum value of the carbon atom content was $1.0\times10^{20}$ atoms/cm$^3$. The interval between the local maximum value and minimum value of the nitrogen atom content was 150 nm. The interval between the local maximum values of the boron atom content was 300 nm.

The produced photosensitive member was evaluated for photoelectric properties in the same manner as in Example 16. Table 57 shows the evaluation results.

As is apparent from the above results, properties were improved in all the evaluated items even when nitrogen atoms were introduced into the lower injection-blocking layer.

EXAMPLE 28

In the same manner as in Example 16, deposition films were sequentially laminated under the conditions shown in Table 58, to thereby produce a photosensitive member composed of a lower injection-blocking layer, a photoconductive layer, and a surface region layer (a change layer, a TBL-1, an intermediate layer, a TBL-2, and an SL). Photosensitive members were produced in the same manner as in Example 16 except that: the change layer was introduced as a first layer in the surface region layer; and the flow rate of a gas was changed in such a manner that the photoconductive layer and a first top injection-blocking layer (TBL-1) would be optically continuous. The surface region layer of each of the produced photosensitive members was subjected to SIMS measurement in the same manner as in Example 1. The local maximum values of the nitrogen atom content represented by N/(Si+N) were 38 atm % and 43 atm % from the photoconductive layer side. The local maximum values of the boron atom content were $6.5\times10^{18}$ atoms/cm$^3$ and $2.1\times10^{18}$ atoms/cm$^3$ from the photoconductive layer side. The local maximum value of the carbon atom content was $1.0\times10^{20}$ atoms/cm$^3$. The interval between the local maximum value and minimum value of the nitrogen atom content was 150 nm. The interval between the local maximum values of the boron atom content was 300 nm.

Each of the produced photosensitive members was evaluated for optical continuity by measuring its spectral reflection spectrum. The spectral reflection spectrum is a reflectivity with respect to the wavelength of incident light, and refers to the value of a reflectivity (percentage) measured by

TABLE 56

| Kind and flow rate of gas | Lower injection-blocking layer | Photoconductive layer | Surface region layer: TBL-1 | Surface region layer: Intermediate layer | Surface region layer: TBL-2 | Surface region layer: SL |
|---|---|---|---|---|---|---|
| $SiH_4$ [mL/min (normal)] | 150 | 200 | 10 | 30 | 10 | 30 |
| $H_2$ [mL/min (normal)] | 500 | 1200 | — | — | — | — |
| $B_2H_6$ [ppm (with respect to $SiH_4$)] | — | — | 800 | — | 800 | — |
| $N_2$ [mL/min (normal)] | 400 | — | 300 | 600 | 300 | 650 |
| $CH_4$ [mL/min (normal)] | — | — | 10 | 10 | 50 | 10 |
| NO [% (with respect to $SiH_4$)] | 2 | — | 4 | 4 | 8 | 4 |
| $SiF_4$ [mL/min (normal)] | — | — | 6 | 6 | 15 | 6 |
| Support temperature [° C.] | 270 | 260 | 220 | 220 | 220 | 220 |
| Pressure [Pa] | 75 | 78 | 60 | 56 | 60 | 56 |
| RF power [W] | 150 | 500 | 180 | 180 | 180 | 180 |
| Thickness [μm] | 2.5 | 30 | 0.1 | 0.2 | 0.1 | 0.6 |

TABLE 57

Figure 28A:
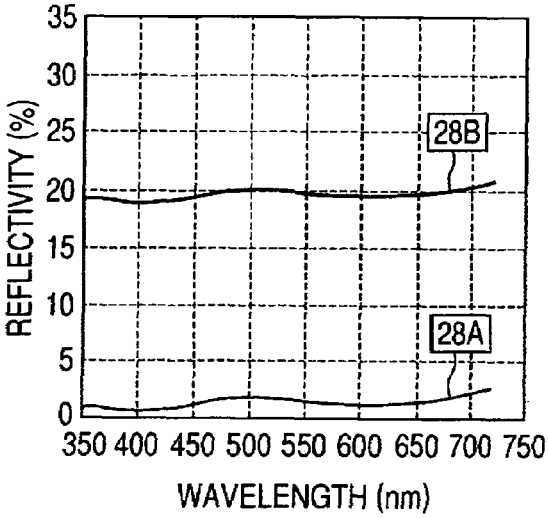
FIG. 28A is a view showing the spectro-reflection spectrum of an example of the electrophotographic photosensitive member of the present invention.
Figure 28C:
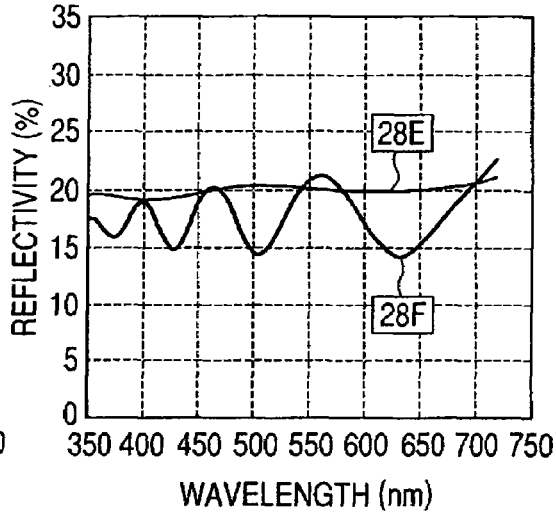
FIG. 28C is a view showing the spectro-reflection spectrum of an example of the electrophotographic photosensitive member of the present invention.
Figure 28B:
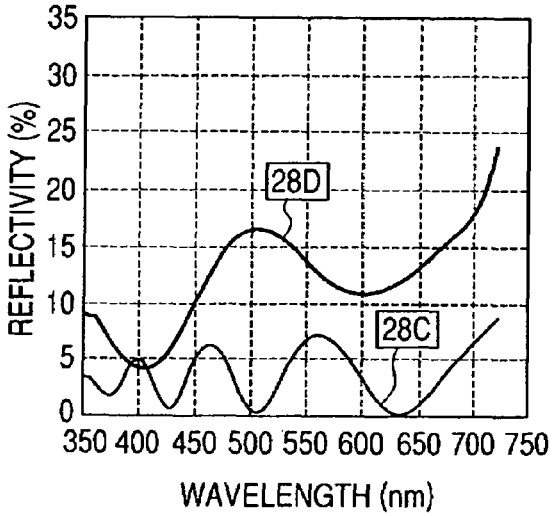
FIG. 28B is a view showing the spectro-reflection spectrum of an example of the electrophotographic photosensitive member of the present invention.
Figure 28D:
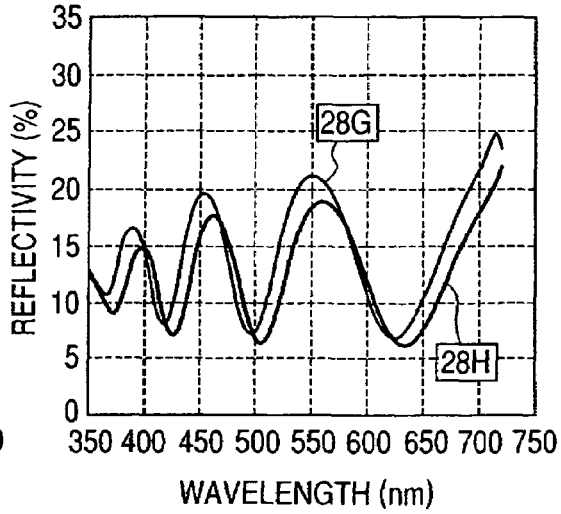
FIG. 28D is a view showing the spectro-reflection spectrum of an example of the electrophotographic photosensitive member of the present invention.

| | Resolution | Chargeability | Residual potential | Sensitivity | Electric potential unevenness | Optical memory | Transmitting property | CLN | Image defect |
|---|---|---|---|---|---|---|---|---|---|
| Example 27 | A | A | A | A | A | A | A | A | A |

means of a spectrophotometer (MCPD-2000, manufactured by Otsuka Electronics Co., Ltd.). Specifically, the spectral emission intensity I(o) of the light source of a spectroscope is measured, the spectral reflected light intensity I(D) of a photosensitive member is measured, and a reflectivity R=I(D)/I(o) is determined. FIGS. 28A and 28B show the measurements of the spectral reflection spectra of photosensitive members 28A to 28D. FIGS. 28C and 28D show the measurements of the spectral reflection spectra of photosensitive members 28E to 28H.

In each of the photosensitive members 28A to 28D, the minimum value (Min) and maximum value (Max) of a reflectivity (%) in the wavelength range of 350 nm to 680 nm satisfied the relationship of 0% ≦Max (%)≦20% and the relationship of 0≦(Max−Min)/(100−Max)≦0.15. In each of the photosensitive members 28E to 28H, the minimum value (Min) and maximum value (Max) of a reflectivity (%) in the wavelength range of 350 nm to 680 nm did not satisfy the above relationships.

Each of the produced photosensitive members was evaluated for photoelectric properties in the same manner as in Example 16. Table 59 shows the evaluation results.

the photosensitive members of Examples 1 to 28, the minimum value (Min) and maximum value (Max) of a reflectivity (%) in the wavelength range of 350 nm to 680 nm satisfy the above relationships.

In these Examples, all the evaluated films were amorphous. It is apparent that polycrystalline films also provide similar effects.

This application claims priorities from Japanese Patent Applications No. 2004-358096 filed Dec. 10, 2004 and No. 2004-358098 filed Dec. 10, 2004, which are hereby incorporated by reference herein.

What is claimed is:

1. An electrophotographic photosensitive member comprising:

a conductive substrate;

a photoconductive layer formed of a non-single-crystal silicon film using at least silicon atoms as a base material; and a surface region layer formed of a non-single-crystal silicon nitride film which uses silicon atoms and nitrogen atoms as base materials and at least part of which contains a Group 13 element in the periodic table and carbon atoms, the surface region layer being superimposed on the photoconductive layer, wherein a content of the Group 13 element in the periodic table with respect to a total amount of constituent atoms has distribution having at least two local maximum values in a thickness direction of the film in the surface region layer, and wherein a content of oxygen atoms and/or fluorine atoms in the surface region layer with respect to the total

TABLE 58

| Kind and flow rate of gas | Lower injection-blocking layer | Photoconductive layer | Surface region layer: Change layer | TBL-1 | Intermediate layer | TBL-2 | SL |
|---|---|---|---|---|---|---|---|
| $SiH_4$ [mL/min (normal)] | 150 | 200 | 200→20 | 20 | 30 | 20 | 30 |
| $H_2$ [mL/min (normal)] | 500 | 1200 | — | — | — | — | — |
| $B_2H_6$ [ppm (with respect to $SiH_4$)] | — | — | 0→200 | 200 | — | 200 | — |
| $N_2$ [mL/min (normal)] | 400 | — | 0→600 | 600 | 700 | 600 | 750 |
| $CH_4$ [mL/min (normal)] | — | — | 5 | 10 | 10 | 50 | 10 |
| NO [% (with respect to $SiH_4$)] | 2 | — | 4 | 4 | 4 | 8 | 4 |
| $SiF_4$ [mL/min (normal)] | — | — | 6 | 6 | 6 | 15 | 6 |
| Support temperature [° C.] | 270 | 260 | 240 | 220 | 220 | 220 | 220 |
| Pressure [Pa] | 75 | 78 | 58 | 60 | 56 | 60 | 56 |
| RF power [W] | 150 | 500 | 200 | 180 | 180 | 180 | 180 |
| Thickness [μm] | 2.5 | 30 | 0.12 | 0.1 | 0.2 | 0.1 | 0.6 |

TABLE 59

| Photosensitive member | Resolution | Chargeability | Residual potential | Sensitivity | Electric potential unevenness | Optical memory | Transmitting property | CLN | Image defect |
|---|---|---|---|---|---|---|---|---|---|
| 28A | A | A | A | A | A | A | A | A | A |
| 28B | A | A | A | A | A | A | A | A | A |
| 28C | A | A | A | A | A | A | A | A | A |
| 28D | A | A | A | A | A | A | A | A | A |
| 28E | A | A | A | A | C | A | A | A | A |
| 28F | A | A | A | A | C | A | A | A | A |
| 28G | A | A | A | A | C | A | A | A | A |
| 28H | A | A | A | A | C | A | A | A | A |

As is apparent from the above results, where the photoconductive layer to the top injection-blocking layer were optically continuous, and the minimum value (Min) and maximum value (Max) of a reflectivity (%) in the wavelength range of 350 nm to 680 nm satisfy the above relationships, the photosensitive member is seen tgo be improved in electric potential unevenness, in particular, electric potential unevenness due to exposure unevenness among all kinds of electric potential unevenness. In each of amount of the constituent atoms has at least one local maximum value in the thickness direction of the film.

2. An electrophotographic photosensitive member according to claim 1, wherein the surface region layer has in its thickness direction at least two of local maximum values of a nitrogen atom content with respect to the total amount of the constituent atoms.

3. An electrophotographic photosensitive member according to claim 2, wherein the surface region layer has alternately the local maximum value of the nitrogen atom content and a local maximum value of the content of the Group 13 element with respect to the total amount of the constituent atoms in the thickness direction.

4. An electrophotographic photosensitive member according to claim 3, wherein the surface region layer has the local maximum value of the nitrogen atom content and the local maximum value of the content of the Group 13 element in the periodic table in the order of the local maximum value of the content of the Group 13 element in the periodic table and the local maximum value of the nitrogen atom content from the photoconductive layer toward the free surface side.

5. An electrophotographic photosensitive member according to claim 2, wherein in the surface region layer, a distance between a local maximum value on the photoconductive layer side among two adjacent local maximum values of the nitrogen atom content with respect to the total amount of the constituent atoms in the thickness direction and a minimum value between the two local maximum values is 40 nm or more and 300 nm or less.

6. An electrophotographic photosensitive member according to claim 2, wherein the local maximum values of the nitrogen atom content in the thickness direction in the surface region layer each satisfy a relationship of $N/(Si+N) \geqq 30$ atom %, and are 110% or more of a minimum value present between the local maximum values.

7. An electrophotographic photosensitive member according to claim 1, wherein a carbon atom content in the surface region layer has distribution having at least one local maximum value in the thickness direction of the film.

8. An electrophotographic photosensitive member according to claim 7, wherein the local maximum value of the carbon atom content in the surface region layer is $2.0\times10^{17}$ atoms/cm$^3$ or more and $5.0\times10^{20}$ atoms/cm$^3$ or less.

9. An electrophotographic photosensitive member according to claim 1, wherein a distance between two adjacent local maximum values of the content of the Group 13 element in the periodic table is in a range of 100 nm to 1,000 nm.

10. An electrophotographic photosensitive member according to claim 1, wherein:

a local maximum value of the content of the Group 13 element in the periodic table closest to the photoconductive layer is $5.0\times10^{18}$ atoms/cm$^3$ or more; and a minimum value of the content of the Group 13 element in the periodic table between the local maximum value closest to the photoconductive layer and a local maximum value adjacent thereto is $2.5\times10^{18}$ atoms/cm$^3$ or less.

11. An electrophotographic photosensitive member according to claim 10, wherein the local maximum value of the content of the Group 13 element in the periodic table closest to the photoconductive layer is highest.

12. An electrophotographic photosensitive member according to claim 1, wherein an average concentration (N/(Si+N)) (atm %) of nitrogen atoms in a certain region of the surface region layer satisfies a relationship of $30 \text{ atm \%} \leqq N/(Si+N) \leqq 70 \text{ atm \%}$.

13. An electrophotographic photosensitive member according to claim 1, wherein the surface region layer has a change layer in which a composition ratio between a silicon atom and a nitrogen atom is changed and a surface layer having a constant composition ratio.

14. An electrophotographic photosensitive member according to claim 1, wherein a minimum value (Min) and a maximum value (Max) of a reflectivity (%) in a wavelength range of 350 nm to 680 nm satisfy a relationship of $0\% \leqq \text{Max}(\%) \leqq 20\%$ and a relationship of $0 \leqq (\text{Max}-\text{Min})/(100-\text{Max}) \leqq 0.15$.

* * * * *

UNITED STATES PATENT AND TRADEMARK OFFICE

CERTIFICATE OF CORRECTION

PATENT NO. : 7,255,969 B2
APPLICATION NO. : 11/396798
DATED : August 14, 2007
INVENTOR(S) : Satoshi Kojima et al.

It is certified that error appears in the above-identified patent and that said Letters Patent is hereby corrected as shown below:

COLUMN 4:

Line 23, “coped” should read --be coped--.
Line 63, “ans” should read --and--.

COLUMN 11:

Line 30, “reidue” should read --residue--.

COLUMN 21:

Line 52, “defiend” should read --defined--.

COLUMN 23:

Line 13, “≦N/(Si+N))≦70” should read --≦(N/(Si+N))≦70--.

COLUMN 25:

Line 46, “dose” should read --does--.

COLUMN 58:

Line 25, “1.1 × 10” should read --$1.1 \times 10^{20}$--.

COLUMN 59:

Line 28, “3.” should read --3,--.

COLUMN 68:

Line 40, “$SiF^{4}$” should read --$SiF_4$--.

COLUMN 72:

Line 66, “also” should read --been--.

UNITED STATES PATENT AND TRADEMARK OFFICE

CERTIFICATE OF CORRECTION

PATENT NO. : 7,255,969 B2
APPLICATION NO. : 11/396798
DATED : August 14, 2007
INVENTOR(S) : Satoshi Kojima et al.

It is certified that error appears in the above-identified patent and that said Letters Patent is hereby corrected as shown below:

COLUMN 89:

Line 64, “tgo” should read --to--.

Signed and Sealed this

Third Day of February, 2009

JOHN DOLL
*Acting Director of the United States Patent and Trademark Office*